US009785075B2

(12) United States Patent
Nakayama et al.

(10) Patent No.: US 9,785,075 B2
(45) Date of Patent: Oct. 10, 2017

(54) TONER, DEVELOPER, IMAGE FORMING APPARATUS, AND PROCESS CARTRIDGE

(71) Applicants: Shinya Nakayama, Shizuoka (JP); Atsushi Yamamoto, Osaka (JP); Minoru Masuda, Shizuoka (JP); Susumu Chiba, Shizuoka (JP); Toyoshi Sawada, Kanagawa (JP); Hiroshi Yamashita, Shizuoka (JP)

(72) Inventors: Shinya Nakayama, Shizuoka (JP); Atsushi Yamamoto, Osaka (JP); Minoru Masuda, Shizuoka (JP); Susumu Chiba, Shizuoka (JP); Toyoshi Sawada, Kanagawa (JP); Hiroshi Yamashita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 173 days.

(21) Appl. No.: 14/433,770

(22) PCT Filed: Oct. 11, 2013

(86) PCT No.: PCT/JP2013/078397
§ 371 (c)(1),
(2) Date: Apr. 6, 2015

(87) PCT Pub. No.: WO2014/069263
PCT Pub. Date: May 8, 2014

(65) Prior Publication Data

US 2015/0248073 A1 Sep. 3, 2015

(30) Foreign Application Priority Data

Nov. 1, 2012 (JP) ..... 2012-242166

(51) Int. Cl.
*G03G 9/087* (2006.01)
*G03G 9/08* (2006.01)

(52) U.S. Cl.
CPC ..... *G03G 9/08764* (2013.01); *G03G 9/0821* (2013.01); *G03G 9/08755* (2013.01); *G03G 9/08788* (2013.01); *G03G 9/08795* (2013.01); *G03G 9/08797* (2013.01)

(58) Field of Classification Search
None
See application file for complete search history.

(56) References Cited

U.S. PATENT DOCUMENTS

| | | | |
|---|---|---|---|
| 2001/0046636 | A1 | 11/2001 | Daimon et al. |
| 2004/0152003 | A1 | 8/2004 | Sato et al. |
| 2011/0229809 | A1 | 9/2011 | Nukada et al. |
| 2011/0294064 | A1 | 12/2011 | Miyaake et al. |
| 2012/0014730 | A1 | 1/2012 | Yoshizawa |
| 2012/0021349 | A1 | 1/2012 | Tani et al. |
| 2012/0282000 | A1 | 11/2012 | Nakayama et al. |
| 2013/0078563 | A1 | 3/2013 | Nakayama et al. |
| 2013/0095422 | A1 | 4/2013 | Yamamoto et al. |
| 2013/0115550 | A1 | 5/2013 | Amemori et al. |
| 2013/0130169 | A1 | 5/2013 | Aoki et al. |
| 2013/0266897 | A1 | 10/2013 | Aoki et al. |
| 2014/0051019 | A1* | 2/2014 | Sekiguchi ..... G03G 9/08764 430/105 |
| 2014/0301757 | A1 | 10/2014 | Sakashita et al. |
| 2015/0355563 | A1 | 12/2015 | Aoki et al. |

FOREIGN PATENT DOCUMENTS

| | | |
|---|---|---|
| JP | 04-024702 | 4/1992 |
| JP | 04-024703 | 4/1992 |
| JP | 2000-250252 | 9/2000 |
| JP | 2004-240421 | 8/2004 |
| JP | 2006-301618 | 11/2006 |
| JP | 2007-017962 | 1/2007 |
| JP | 3910338 | 2/2007 |
| JP | 2009-104193 | 5/2009 |
| JP | 2010-077419 | 4/2010 |
| JP | 2011-237790 | 11/2011 |
| JP | 2012-8530 | 1/2012 |
| JP | 2012-027212 | 2/2012 |
| JP | 2012-042939 | 3/2012 |
| JP | 2012-042941 | 3/2012 |
| JP | 2012-118466 | 6/2012 |

(Continued)

OTHER PUBLICATIONS

Official Decision of Grant issued Sep. 20, 2016 in Russian Patent Application No. 2015120344/28(031421) (with English translation).
U.S. Appl. No. 14/694,451, filed: Apr. 23, 2015 inventor: Sakashita, et al.
International Search Report Issued Nov. 19, 2013 in PCT/JP2013/078397 filed Oct. 11, 2013.
Extended Search Report issued Dec. 17, 2015 in Patent Application No. 13850048.3.
Information Offer Form issued Dec. 18, 2015 in Japanese Patent Application No. 2012-242166 (with English translation).
Korean Office Action issued Aug. 21, 2016 in Patent Application No. 10-2015-7014057 (with English translation).

*Primary Examiner* — Janis L Dote
(74) *Attorney, Agent, or Firm* — Oblon, McClelland, Maier & Neustadt, L.L.P.

(57) ABSTRACT

Provided is a toner containing a binder resin. The binder resin contains a crystalline resin. The toner has a maximum endothermic peak temperature (P1) of from 50° C. to 80° C. and a total endothermic amount (Q) of from 35 J/g to 90 J/g at a first temperature elevation of differential scanning calorimetry. A ratio ($Q_p$/Q) of a total endothermic amount ($Q_p$) of the toner in a temperature range of from 20° C. to the maximum endothermic peak temperature (P1) to the total endothermic amount (Q) of the toner is from 0.65 to 0.83.

16 Claims, 5 Drawing Sheets

(56) References Cited

FOREIGN PATENT DOCUMENTS

| | | | |
|---|---|---|---|
| JP | 2012-133161 | | 7/2012 |
| JP | 2012-133332 | | 7/2012 |
| JP | 2013-068795 | | 4/2013 |
| JP | 2013-080200 | | 5/2013 |
| JP | 2014-63114 | | 4/2014 |
| RU | 2 367 016 | C2 | 9/2009 |
| WO | WO 2012/011546 | A1 | 1/2012 |
| WO | WO-2013/058407 | A1 * | 4/2013 |

* cited by examiner

TONER, DEVELOPER, IMAGE FORMING APPARATUS, AND PROCESS CARTRIDGE

TECHNICAL FIELD

The present invention relates to a toner, a developer, an image forming apparatus, and a process cartridge.

BACKGROUND ART

Conventionally, in an electrophotographic image forming apparatus and an electrostatic recording apparatus, an electrical or magnetical latent image is visualized with a toner. For example, in electrophotography, a latent electrostatic image (latent image) is formed on a photoconductor, followed by developing the latent image with the toner, to form a toner image. The toner image is typically transferred onto a transfer medium such as paper, followed by fixing onto the transfer medium by heating or the like.

Recently, there are increasing demands from the market for image forming apparatuses of high speed and energy saving, and therefore a toner having excellent low temperature fixability and capable of providing high quality images is desired.

As a method for achieving the low temperature fixability of the toner, there is a method of lowering the softening point of the binder resin contained in the toner. However, according to this method, a so-called offset (also referred to as hot offset hereinafter) occurs, in which part of a toner image is deposited onto a surface of a fixing member during fixing, and then transferred to photocopy paper. In addition to this, the heat resistant storage stability of the toner degrades, and therefore toner particles are fused to each other particularly in high temperature environments, which is so called blocking.

As for the technique for solving the aforementioned problems, it has been known that a crystalline resin is used as a binder resin of the toner. The crystalline resin is capable of decreasing the softening point of the toner to around the melting point thereof by sharply softening at the melting point of the resin, while maintaining the heat resistant storage stability at the temperature equal to or lower than the melting point. Accordingly, use of the crystalline resin in the toner realizes both the low temperature fixability and heat resistant storage stability at high levels.

As for the toner using the crystalline resin, for example, there is proposed a toner in which a crystalline resin obtained by elongating crystalline polyester with diisocyanate is used as a binder resin (see PTL 1 and PTL 2).

There is proposed a toner using a crystalline resin which has a crosslink structure due to an unsaturated bond containing sulfonic acid groups (see PTL 3).

Moreover, there is proposed a technique related to crystalline resin particles having excellent low temperature fixability and heat resistant storage stability, in which a ratio of a softening point to a peak temperature of heat of melting, and viscoelastic properties are specified (see PTL 4).

There is also proposed a toner containing as the binder resin, crystalline polyester, of which endothermic peak, endothermic amount, and half width of the endothermic peak are prescribed (see PTL 5 and PTL 6).

However, because toners using these conventional crystalline resins rapidly soften at the melting point of the resin, toner particles aggregate with each other in the developing device when heat generated when they are stirred in the developing device increases, causing a problem that the generated coarse toner particles cannot be transferred to the transfer medium to generate voids in the image (white voids).

Therefore, currently, there is a demand for a toner that has excellent low temperature fixability and heat resistant storage stability, and can suppress occurrence of aggregation of toner particles in the developing device.

CITATION LIST

Patent Literature

PTL 1 Japanese Patent Application Publication (JP-B) No. 04-024702
PTL 2 JP-B No. 04-024703
PTL 3 Japanese Patent (JP-B) No. 3,910,338
PTL 4 Japanese Patent Application Laid-Open (JP-A) No. 2010-077419
PTL 5 JP-A No. 2012-042939
PTL 6 JP-A No. 2012-042941

SUMMARY OF INVENTION

Technical Problem

The present invention aims at solving the problems described above and achieving the following object. The object of the present invention is to provide a toner that has excellent low temperature fixability and heat resistant storage stability and can suppress occurrence of aggregation of toner particles in the developing device.

Solution to Problem

A means for solving the problems is as follows.

A toner of the present invention is a toner, containing a binder resin, wherein the binder resin contains a crystalline resin, wherein the toner has a maximum endothermic peak temperature (P1) of from 50° C. to 80° C. and a total endothermic amount (Q) of from 35 J/g to 90 J/g at a first temperature elevation of differential scanning calorimetry, and wherein a ratio ($Q_p$/Q) of a total endothermic amount ($Q_p$) of the toner in a temperature range of from 20° C. to the maximum endothermic peak temperature (P1) to the total endothermic amount (Q) of the toner is from 0.65 to 0.83.

Advantageous Effects of Invention

According to the present invention, it is possible to provide a toner that can solve the conventional problems described above, has excellent low temperature fixability and heat resistant storage stability, and can suppress occurrence of aggregation of toner particles in the developing device.

DESCRIPTION OF EMBODIMENTS (Toner)

Figure 1A:
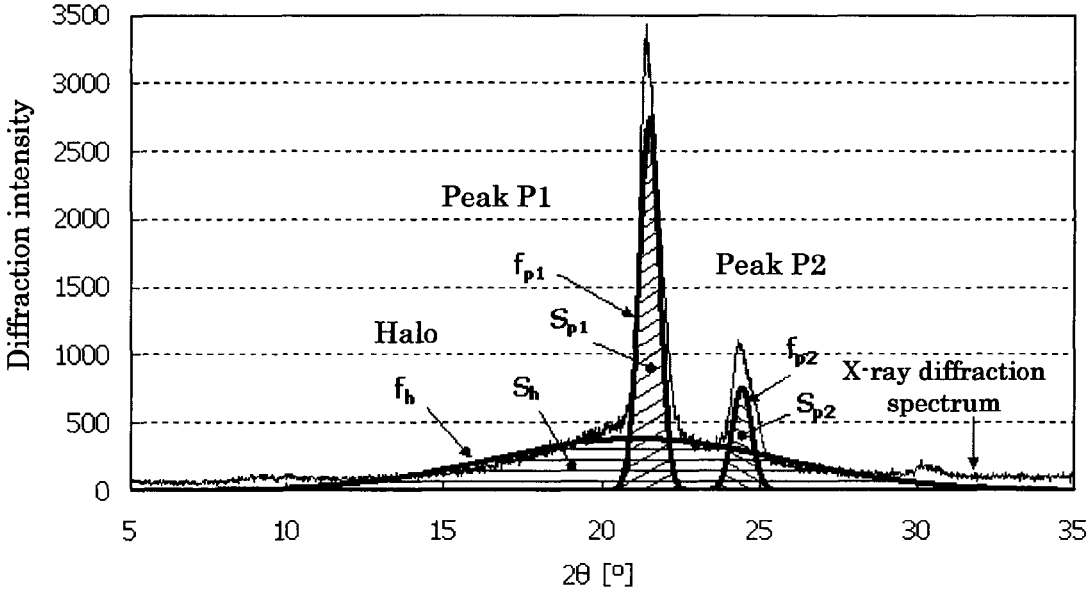
FIG. 1A is a diagram showing an example diffraction spectrum obtained by X-ray diffractometry.

A toner of the present invention contains at least a binder resin, and contains other components, if necessary.

The binder resin contains at least a crystalline resin, and contains other components, if necessary.

The toner has a maximum endothermic peak temperature (P1) of from 50° C. to 80° C. and a total endothermic amount (Q) of from 35 J/g to 90 J/g at a first temperature elevation of differential scanning calorimetry (DSC), and a ratio ($Q_p$/Q) of a total endothermic amount ($Q_p$) of the toner in a temperature range of from 20° C. to the maximum endothermic peak temperature (P1) to the total endothermic amount (Q) of the toner is from 0.65 to 0.83.

As a result of earnest studies for providing a toner having excellent low temperature fixability and heat resistant storage stability and capable of suppressing occurrence of aggregation of toner particles in the developing device, the present inventors have discovered that a toner can have excellent low temperature fixability and heat resistant storage stability and can suppress occurrence of aggregation of toner particles in the developing device, if the toner contains a binder resin, the binder resin contains a crystalline resin, the toner has a maximum endothermic peak temperature (P1) of from 50° C. to 80° C. and a total endothermic amount (Q) of from 35 J/g to 90 J/g at a first temperature elevation of differential scanning calorimetry, and a ratio ($Q_p$/Q) of a total endothermic amount ($Q_p$) of the toner in a temperature range of from 20° C. to the maximum endothermic peak temperature (P1) to the total endothermic amount (Q) of the toner is from 0.65 to 0.83, and have completed the present invention.

When the maximum endothermic peak temperature (P1) is lower than 50° C., the heat resistant storage stability of the toner will be insufficient. When the maximum endothermic peak temperature (P1) is higher than 80° C., the low temperature fixability of the toner will be insufficient.

When the total endothermic amount (Q) is less than 35 J/g, the amount of the crystalline resin or crystallized portions in the toner is scarce, and the toner cannot therefore have sufficient low temperature fixability or heat resistant storage stability. When the total endothermic amount (Q) is greater than 90 J/g, the toner requires an excessively large amount of energy to be fixed onto a fixing medium, resulting in insufficient low temperature fixability.

When the ratio ($Q_p$/Q) is less than 0.65, meaning that the sharp melting property is excessively high, toner particles aggregate in the developing device to generate white voids. When the ratio ($Q_p$/Q) is greater than 0.83, the sharp melting property is insufficiently expressed, making it harder to realize both of sufficient low temperature fixability and sufficient heat resistant storage stability.

A toner of the present invention, which contains a crystalline resin but is appropriately kept from rapid softening upon heat, can prevent aggregation of toner particles in the developing device while maintaining low temperature fixability and heat resistant storage stability at high quality levels.

<Binder Resin>

The binder resin contains at least a crystalline resin, and further contains other components such as a non-crystalline resin, if necessary.

<<Crystalline Resin>>

The crystalline resin is not particularly limited as long as it has crystallinity, and can be selected appropriately according to the purpose. However, it is preferable that the crystalline resin contain at least either a urethane bond or a urea bond, because they would impart toughness to the resin.

The crystalline resin in the present invention means a resin containing a site having a crystalline structure, and has a diffraction peak attributable to the crystalline structure in its diffraction spectrum obtained with an X-ray diffractometer. For example, the crystalline resin has a value of from 0.8 to 1.6, as a ratio of its softening temperature measured with a Kouka-shiki flow tester to a maximum peak temperature of its heat of melting measured with a differential scanning calorimeter (DSC) (softening temperature/maximum peak temperature of heat of melting), indicating that it steeply softens when heated.

The non-crystalline resin in the present invention means a resin free from a crystalline structure, and has no diffraction peak attributable to a crystalline structure in its diffraction spectrum obtained with an X-ray diffractometer. For example, the non-crystalline resin has a value of greater than 1.6, as a ratio of its softening temperature to a maximum peak temperature of its heat of melting (softening temperature/maximum peak temperature of heat of melting), indicating that it moderately softens when heated.

The softening temperature of a resin can be measured with a Kouka-shiki flow tester (e.g., CFT-500 D (manufactured by Shimadzu Corporation)). As a sample, a resin (1 g) is heated at a temperature elevating rate of 3° C./min, and at the same time, a load of 2.94 MPa is applied to the sample with a plunger to extrude the sample from a nozzle having a diameter of 0.5 mm and a length of 1 mm. The amount of descent of the plunger of the flow tester is plotted relative to the temperature, and the temperature at which the sample has flowed out by half is determined as the softening temperature.

A maximum peak temperature of the heat of melting of a resin can be measured with differential scanning calorimeters (DSC) (e.g., TA-60WS and DSC-60 (manufactured by Shimadzu Corporation)). The sample to be used for the measurement of a maximum peak temperature of heat of melting is subjected to pre-treatment in which it is melted at 130° C., then cooled from 130° C. to 70° C. at a rate of 1.0° C./min, and then cooled from 70° C. to 10° C. at a rate of 0.5° C./min. Here, the sample is once warmed by DSC at a temperature elevating rate of 10° C./min in order to measure endothermic and exothermic changes and plot a graph of "endothermic and exothermic amount" vs. "temperature". The temperature of an endothermic peak present in a range of from 20° C. to 100° C. observed in this temperature elevation is defined as "Ta*". When there are a plurality of endothermic peaks, the temperature of a peak at which the endothermic amount is the maximum is defined as Ta*. After this, the sample is stored at (Ta*−10°) C. for 6 hours, and then stored at (Ta*−15°) C. for 6 hours. Then, the sample is cooled to 0° C. at a temperature decreasing rate of 10° C./min and then warmed at a temperature elevating rate of 10° C./min by DSC in order to measure endothermic and exothermic changes and plot a similar graph. The temperature corresponding to a peak at which the endothermic amount is the maximum is determined as the maximum peak temperature of heat of melting.

—Crystalline Resin Containing at Least Either Urethane Bond or Urea Bond—

The crystalline resin containing at least either a urethane bond or a urea bond is not particularly limited and can be selected appropriately according to the purpose. Examples thereof include a crystalline resin, a crystalline polyurethane resin, and a crystalline polyurea resin each of which contains at least either a urethane bond or a urea bond, and a crystalline polyester unit. Among them, a crystalline resin that contains at least either a urethane bond or a urea bond, and a crystalline polyester unit is preferable.

A method for obtaining the crystalline resin that contains at least either a urethane bond or a urea bond and a crystalline polyester unit is not particularly limited and can be appropriately selected according to the purpose. Examples of such methods include: a method (prepolymer method) of previously producing a prepolymer from a polyurethane unit or a polyurea unit, and bonding it with a crystalline polyester unit produced separately and containing a hydroxyl group at the terminal; and a method (one-shot method) of mixing and reacting a crystalline polyester unit containing a hydroxyl group at the terminal, low-molecular-weight polyisocyanate, and low-molecular-weight polyol or polyamine.

Of these, the one-shot method is preferable.

With the one-shot method, polyurethane units or polyurea units to be formed are typically non-uniform without too large units, compared to those formed by a conventional common prepolymer method, and the crystallinity of the crystalline polyester unit is inhibited, making it possible to suppress steepness of thermal melting.

In the toner of the present invention, the total endothermic amount (Q) and the ratio ($Q_p$/Q) indicating the steepness can be easily controlled based on the additive amount of the polyisocyanate, the polyole, or the polyamine relative to the crystalline polyester unit, reaction temperature, and selection of a monomer.

In the prepolymer method, a polyurethane-urea unit in which polyurethane units and polyurea units are present in a mixed state may be used as a prepolymer.

--Crystalline Polyester Unit--

The crystalline polyester unit is not particularly limited and can be appropriately selected according to the purpose. Examples thereof include: a polycondensed polyester unit synthesized from polyol and a polycarboxylic acid; a lactone ring-opening polymerization product; and a polyhydroxy carboxylic acid. Among them, a polycondensed polyester unit of diol and a dicarboxylic acid is preferable, in terms of expression of crystallinity.

---Polyol---

Examples of the polyol include diol and trivalent to octavalent or higher polyol.

The diol is not particularly limited, and can be appropriately selected according to the purpose. Examples thereof include: aliphatic diol such as straight-chain aliphatic diol and branched aliphatic diol; alkylene ether glycol having 4 to 36 carbon atoms; alicyclic diol having 4 to 36 carbon atoms; alkylene oxide (hereinafter, "alkylene oxide" may be abbreviated as "AO") of the alicyclic diol; bisphenol-AO adducts; polylactone diol; polybutadiene diol; diol having a carboxyl group; diol having a sulfonic acid group or a sulfamic acid group; salts thereof; and diol having other functional groups. Among these, aliphatic diol having 2 to 36 carbon atoms in the chain is preferable, and straight-chain aliphatic diol having 2 to 36 carbon atoms in the chain is more preferable. These may be used alone or in combination of two or more.

A content of the straight-chain aliphatic diol relative to the diol as a whole is not particularly limited and can be appropriately selected according to the purpose, but is preferably 80% by mole or greater, and more preferably 90% by mole or greater. The content of 80% by mole or greater is advantageous in terms of improved crystallinity of the resin, compatibility of low temperature fixability and heat resistant storage stability, and improved resin hardness.

The straight-chain aliphatic diol is not particularly limited and may be appropriately selected according to the purpose. Examples thereof include ethylene glycol, 1,3-propanediol, 1,4-butanediol, 1,5-pentanediol, 1,6-hexanediol, 1,7-heptanediol, 1,8-octanediol, 1-9-nonanediol, 1,10-decanediol, 1,11-undecanediol, 1,12-dodecanediol, 1,13-tridecanediol, 1,14-tetradecanediol, 1,18-octadecanediol and 1,20-eicosanediol. Among these, ethylene glycol, 1,3-propanediol, 1,4-butanediol, 1,6-hexanediol, 1,9-nonanediol and 1,10-decanediol are preferable in view of easy availability. Among these, straight-chain aliphatic diol having 2 to 36 carbon atoms in the chain is preferable.

The branched aliphatic diol is not particularly limited and may be appropriately selected according to the purpose, but branched aliphatic diol having 2 to 36 carbon atoms in the chain is preferable. Examples of the branched aliphatic diol include 1,2-propyleneglycol, neopentyl glycol, and 2,2-diethyl-1,3-propanediol.

The alkylene ether glycol having 4 to 36 carbon atoms is not particularly limited and may be appropriately selected according to the purpose. Examples thereof include diethylene glycol, triethylene glycol, dipropylene glycol, polyethylene glycol, polypropylene glycol and polytetramethylene ether glycol.

The alicyclic diol having 4 to 36 carbon atoms is not particularly limited and may be appropriately selected according to the purpose. Examples thereof include 1,4-cyclohexanedimethanol and hydrogenated bisphenol A.

The alkylene oxide of the alicyclic diol is not particularly limited and may be appropriately selected according to the purpose. Examples thereof include adducts with ethylene oxide (hereinafter may be abbreviated as EO), propylene oxide (hereinafter may be abbreviated as PO), and butylene oxide (hereinafter may be abbreviated as BO). The number of moles added as the adducts may be, for example, 1 to 30.

The bisphenol-AO adducts are not particularly limited and may be appropriately selected according to the purpose. Examples thereof include bisphenol A, bisphenol F, or bisphenol S-AO (such as EO, PO and BO) adducts. The number of moles added as the adducts may be, for example, 2 to 30.

The polylactone diol is not particularly limited and may be appropriately selected according to the purpose. Examples thereof include poly-ϵ-caprolactone diol.

The diol having a carboxyl group is not particularly limited and may be appropriately selected according to the purpose. Examples thereof include an dialkylol alkanoic acid. The number of carbon atoms contained in the dialkylol alkanoic acid may be, for example, 6 to 24. Examples of the dialkylol alkanoic acid having 6 to 24 carbon atoms include 2,2-dimethylol propionic acid (DMPA), 2,2-dimethylol butanoic acid, 2,2-dimethylol heptanoic acid and 2,2-dimethylol octanoic acid.

The diol having a sulfonic acid group or a sulfamic acid group is not particularly limited and may be appropriately selected according to the purpose. Examples thereof include:

a sulfamic acid diol; N,N-bis(2-hydroxyalkyl)sulfamic acid (the alkyl group having 1 to 6 carbon atoms)-AO adduct (AO is EO or PO, the number of AO moles added may be 1 to 6 moles); and bis(2-hydroxyethyl)phosphate.

Examples of the sulfamic acid diol include: N,N-bis(2-hydroxyethyl)sulfamic acid; and N,N-bis(2-hydroxyethyl) sulfamic acid-PO 2 mol adduct.

The neutralized salt group of the diol having the neutralized salt group is not particularly limited and may be appropriately selected according to the purpose. Examples thereof include a tertiary amine having 3 to 30 carbon atoms (e.g. triethylamine) and alkali metal (e.g. sodium salt).

Among these diols, aliphatic diol having 2 to 12 carbon atoms, diol having a carboxyl group, bisphenol-AO adducts, and a combination thereof are preferable.

The trivalent to octavalent or higher polyol to be used according to necessity is not particularly limited and may be appropriately selected according to the purpose. Examples thereof include: polyhydric aliphatic alcohol having 3 to 8 valences or more having 3 to 36 carbon atoms; a trisphenol-AO adduct (with addition of 2 to 30 moles); a novolak resin-AO adduct (with addition of 2 to 30 moles); and acrylic polyol such as copolymer of a hydroxyethyl(meth) acrylate and other vinyl monomer.

Examples of the polyhydric aliphatic alcohol having 3 to 8 valences or more having 3 to 36 carbon atoms include glycerin, trimethylol ethane, trimethylol propane, pentaerythritol, sorbitol, sorbitan and polyglycerin.

Among these, the polyhydric aliphatic alcohol having 3 to 8 valences or more and the novolak resin-AO adduct are preferable, and the novolak resin-AO adduct is more preferable.

---Polycarboxylic Acid---

Examples of the polycarboxylic acid include dicarboxylic acid and a polycarboxylic acid having 3 to 6 valences or more.

The dicarboxylic acid is not particularly limited and may be appropriately selected according to the purpose. Examples thereof include an aliphatic dicarboxylic acid and an aromatic dicarboxylic acid. Examples of the aliphatic dicarboxylic acid include straight-chain aliphatic dicarboxylic acid and branched-chain aliphatic dicarboxylic acid. Among these, a straight-chain aliphatic dicarboxylic acid is more preferable.

The aliphatic dicarboxylic acid is not particularly limited and may be appropriately selected according to the purpose. Examples thereof include an alkanedicarboxylic acid, an alkenylsuccinic acid, an alkenedicarboxylic acid, and a cycloaliphatic dicarboxylic acid.

Examples of the alkanedicarboxylic acid include an alkanedicarboxylic acid having 4 to 36 carbon atoms. Examples of the alkanedicarboxylic acid having 4 to 36 carbon atoms include succinic acid, adipic acid, sebacic acid, azelaic acid, dodecanedicarboxylic acid, octadecanedicarboxylic acid and decylsuccinic acid.

Examples of the alkenylsuccinic acid include dodecenylsuccinic acid, pentadecenylsuccinic acid and octadecenylsuccinic acid.

Examples of the alkenedicarboxylic acid include an alkenedicarboxylic acid having 4 to 36 carbon atoms. Examples of the alkenedicarboxylic acid having 4 to 36 carbon atoms include maleic acid, fumaric acid and citraconic acid.

Examples of the cycloaliphatic dicarboxylic acid include a cycloaliphatic dicarboxylic acid having 6 to 40 carbon atoms. Examples of the cycloaliphatic dicarboxylic acid having 6 to 40 carbon atoms include dimer acid (dimeric linoleic acid).

The aromatic dicarboxylic acid is not particularly limited and may be appropriately selected according to the purpose. Examples thereof include an aromatic dicarboxylic acid having 8 to 36 carbon atoms. Examples of the aromatic dicarboxylic acid having 8 to 36 carbon atoms include phthalic acid, isophthalic acid, terephthalic acid, t-butylisophthalic acid, 2,6-naphthalenedicarboxylic acid and 4,4'-biphenyldicarboxylic acid.

Examples of the polycarboxylic acid having 3 to 6 valences or more used according to necessity include an aromatic polycarboxylic acid having 9 to 20 carbon atoms. Examples of the aromatic polycarboxylic acid having 9 to 20 carbon atoms include trimellitic acid and pyromellitic acid.

Here, as the dicarboxylic acid or the polycarboxylic acid having 3 to 6 valences or more, an acid anhydride or an alkyl ester having 1 to 4 carbon atoms of those described above may also be used. Examples of the alkyl ester having 1 to 4 carbon atoms include methyl ester, ethyl ester and isopropyl ester.

Among the dicarboxylic acids, the aliphatic dicarboxylic acid alone is preferable, and adipic acid, sebacic acid, dodecanedicarboxylic acid, terephthalic acid, or isophthalic acid alone is more preferable. Similarly, it is preferable that the aliphatic dicarboxylic acid and the aromatic dicarboxylic acid are copolymerized. Preferable examples of the aromatic dicarboxylic acid to be copolymerized include terephthalic acid, isophthalic acid, t-butylisophthalic acid, and alkyl esters of these aromatic dicarboxylic acids. Examples of the alkyl esters include methyl ester, ethyl ester and isopropyl ester. An amount of copolymerization of the aromatic dicarboxylic acid is preferably 20% by mole or less.

---Lactone Ring-Opening Polymerization Product---

The lactone ring-opening polymerization product is not particularly limited and may be appropriately selected according to the purpose. Examples thereof include: a lactone ring-opening polymerization product obtained by ring-opening polymerization of lactones including a mono-lactone having 3 to 12 carbon atoms (having 1 ester group in the ring) such as β-propiolactone, γ-butyrolactone, δ-valerolactone and ϵ-caprolactone using a catalyst such as metal oxide and organometallic compound; and a lactone ring-opening polymerization product having a hydroxyl group at an end thereof obtained by ring-opening polymerization of the mono-lactones having 3 to 12 carbon atoms using a glycol (e.g. ethylene glycol and diethylene glycol) as an initiator. These may be used alone or in combination of two or more.

The mono-lactone having 3 to 12 carbon atoms is not particularly limited and may be appropriately selected according to the purpose. It is preferably ϵ-caprolactone in view of crystallinity.

Also, a commercially available product may be used as the lactone ring-opening polymerization product. Examples of the commercially available product include a highly crystalline polycaprolactone such as H1P, H4, H5 and H7 of PLACCEL series manufactured by Daicel Co., Ltd.

---Polyhydroxy Carboxylic Acid---

A method for preparing the polyhydroxy carboxylic acid is not particularly limited and may be appropriately selected according to the purpose. Examples thereof include: a method of direct dehydration condensation of hydroxycarboxylic acids such as glycolic acid and lactic acid (e.g. L-form, D-form and racemic form); and a method of ring-opening polymerization of a cyclic ester having 4 to 12 carbon atoms (having 2 to 3 ester groups in the ring) corresponding to a dehydration condensation product between 2 or 3 molecules of hydroxycarboxylic acid such as glycolide and lactide (e.g. L-form, D-form and meso form) using a catalyst such as metal oxide and organometallic compound. Among these, the method of ring-opening polymerization is preferable in view of molecular weight adjustment.

Among the cyclic esters, L-lactide and D-lactide are preferable in view of crystallinity. Also, these polyhydroxy carboxylic acids may be those with their ends modified by a hydroxyl group or a carboxyl group.

---Polyurethane Unit---

Examples of the polyurethane unit include a polyurethane unit synthesized from polyol such as diol and polyol having 3 to 8 valences or more, and polyisocyanate such as diisocyanate and polyisocyanate having 3 valences or more. Among these, a polyurethane unit synthesized from the diol and the diisocyanate is preferable.

Examples of the polyol include the same as those listed as the polyol of the polyester unit.

---Polyisocyanate---

Examples of the polyisocyanate include diisocyanate and polyisocyanate having 3 valences or more.

Polyisocyanate is not particularly limited and may be appropriately selected according to the purpose. Examples thereof include aromatic diisocyanate, aliphatic diisocyanate, cycloaliphatic diisocyanate, and aromatic aliphatic diisocyanate. Among these, aromatic diisocyanate having 6 to 20 carbon atoms, aliphatic diisocyanate having 2 to 18 carbon atoms, cycloaliphatic diisocyanate having 4 to 15 carbon atoms, and aromatic aliphatic diisocyanate having 8 to 15 carbon atoms (the numbers of carbon atoms excluding carbon atoms in a NCO group), modified products of these diisocyanates, and mixtures of two or more of these are preferable.

Examples of the aromatic diisocyanate include 1,3-phenylene diisocyanate, 1,4-phenylene diisocyanate, 2,4-tolylene diisocyanate (TDI), 2,6-tolylene diisocyanate (TDI), crude TDI, 2,4'-diphenylmethane diisocyanate (MDI), 4,4'-diphenylmethane diisocyanate (MDI), crude MDI, 1,5-naphthylene diisocyanate, m-isocyanatophenyl sulfonyl isocyanate, and p-isocyanatophenyl sulfonyl isocyanate.

Examples of the crude MDI include phosgene compound of crude diaminophenylmethane and polyallyl polyisocyanate (PAPI). Examples of the crude diaminophenylmethane include condensation product of formaldehyde and aromatic amine (aniline) or a mixture thereof, and mixture of diaminodiphenylmethane and a small amount (5% by mass to 20% by mass, for example) of a polyamine having three or more functional groups.

Example of the aliphatic diisocyanate include ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanato methylcaproate, bis(2-isocyanatoethyl)fumarate, bis(2-isocyanatoethyl)carbonate and 2-isocyanatoethyl-2,6-diisocyanato hexanoate.

Examples of the cycloaliphatic diisocyanate include isophorone diisocyanate (IPDI), dicyclohexylmethane-4,4'-diisocyanate (hydrogenated MDI), cyclohexylene diisocyanate, methyl cyclohexylene diisocyanate (hydrogenated TDI), bis(2-isocyanatoethyl)-4-cyclohexene-1,2-dicarboxylate, 2,5-norbornane diisocyanate, and 2,6-norbornane diisocyanate.

Examples of the aromatic aliphatic diisocyanate include m-xylylene diisocyanate (XDI), p-xylylene diisocyanate (XDI) and α,α,α',α'-tetramethylxylylene diisocyanate (TMXDI).

Examples of the modified products of the diisocyanate include a modified product including a urethane group, a modified product including a carbodiimide group, a modified product including an allophanate group, a modified product including a urea group, a modified product including a biuret group, a modified product including an uretdione group, a modified product including an uretoimine group, a modified product including an isocyanurate group, and a modified product including an oxazolidone group. Specific examples thereof include: modified diisocyanates such as modified MDI and urethane-modified TDI; and mixtures of two or more of these. Examples of the modified MDI include urethane-modified MDI, carbodiimide-modified MDI, and trihydrocarbyl phosphate-modified MDI. Examples of the mixtures include a mixture of modified MDI and urethane-modified TDI (prepolymer including isocyanate).

Among these diisocyanates, those preferable include an aromatic diisocyanate having 6 to 15 carbon atoms, an aliphatic diisocyanate having 4 to 12 carbon atoms, and a cycloaliphatic diisocyanate having 4 to 15 carbon atoms (the numbers of carbon atoms excluding carbon atoms in a NCO group). Those more preferable include 2,4-tolylenediisocyanate, 2,6-tolylenediisocyanate, 2,4'-diphenylmethane diisocyanate, 4,4'-diphenylmethane diisocyanate, hexamethylene diisocyanate, dicyclohexylmethane-4,4'-diisocyanate, and isophorone diisocyanate.

---Polyurea Unit---

Examples of the polyurea unit include a polyurea unit synthesized from a polyamine such as diamine and polyamine having 3 or more valences and a polyisocyanate such as diisocyanate and polyisocyanate having 3 or more valences.

---Polyamine---

Polyamine is not particularly limited d and may be appropriately selected according to the purpose. Examples thereof include aliphatic diamines and aromatic diamines. Among these, aliphatic diamines having 2 to 18 carbon atoms and aromatic diamines having 6 to 20 carbon atoms are preferable. Also, amines having 3 or more valences may be used according to necessity.

Examples of the aliphatic diamines having 2 to 18 carbon atoms include: an alkylenediamine having 2 to 6 carbon atoms; a substituent of the alkylenediamine by an alkyl group having 1 to 4 carbon atoms or a hydroxyalkyl group having 2 to 4 carbon atoms; an aliphatic diamine including a cyclic aliphatic ring or a hetero ring; and an aliphatic amine including an aromatic ring having 8 to 15 carbon atoms.

Examples of the alkylenediamine having 2 to 6 carbon atoms include ethylenediamine, propylenediamine, trimethylenediamine, tetramethylenediamine and hexamethylenediamine.

Examples of the substituent by an alkyl group having 1 to 4 carbon atoms or a hydroxyalkyl group having 2 to 4 carbon atoms include dialkylaminopropylamine, trimethylhexamethylenediamine, aminoethylethanolamine, 2,5-dimethyl-2,5-hexamethylenediamine and methyliminobispropylamine.

Examples of the aliphatic diamine including a cyclic aliphatic ring or a hetero ring include an alicyclic diamine having 4 to 15 carbon atoms and a heterocyclic diamine having 4 to 15 carbon atoms. Examples of the alicyclic diamine having 4 to 15 carbon atoms include 1,3-diaminocyclohexane, isophorone diamine, menthenediamine and 4,4'-methylenedicylohexanediamine (hydrogenated methylenedianiline). Examples of the heterocyclic diamine having 4 to 15 carbon atoms include piperazine, N-aminoethylpiperazine, 1,4-diaminoethylpiperazine, 1,4-bis(2-amino-2-methylpropyl)piperazine, and 3,9-bis(3-aminopropyl)-2,4,8,10-tetraoxaspiro[5,5]undecane.

Examples of the aliphatic amine including an aromatic ring having 8 to 15 carbon atoms include xylylenediamine and tetrachloro-p-xylylenediamine.

Examples of the aromatic diamines having 6 to 20 carbon atoms include: non-substituted aromatic diamines; aromatic diamines having nuclear-substituted alkyl group having 1 to 4 carbon atoms; mixtures of isomers of the aromatic diamines described above at various ratios; aromatic diamines having nuclear substituted electron-withdrawing group; and aromatic diamines having a secondary amino group.

Examples of the non-substituted aromatic diamines include 1,2-phenylenediamine, 1,3-phenylenediamine, 1,4-phenylenediamine, 2,4'-diphenylmethanediamine, 4,4'-diphenylmethanediamine, crude diphenylmethanediamine (polyphenylpolymethylenepolyamine), diaminodiphenyl sulfone, benzidine, thiodianiline, bis(3,4-di-aminophenyl) sulfone, 2,6-diaminopyridine, m-aminobenzylamine, triphenylmethane-4,4',4"-triamine and naphthylenediamine.

Examples of the aromatic diamines having nuclear-substituted alkyl group having 1 to 4 carbon atoms include 2,4-tolylenediamine, 2,6-tolylenediamine, crude tolylenediamine, diethyltolylenediamine, 4,4'-diamino-3,3'-dimethyldiphenylmethane, dianisidine, diaminoditolyl sulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diamino diphenyl ether and 3,3',5,5'-tetraisopropyl-4,4'-diaminodiphenyl sulfone.

Examples of the nuclear substituted electron-withdrawing group of the aromatic diamines having the nuclear substituted electron-withdrawing group include halogens, alkoxy group, and nitro group. Examples of the halogens include Cl, Br, and F. Examples of the alkoxy group include methoxy and ethoxy. Examples of the aromatic diamines having the nuclear substituted electron-withdrawing group include: methylenebis-o-chloroaniline, 4-chloro-o-phenylenediamine, 2-chloro-1,4-phenylenediamine, 3,-amino-4-chloroaniline, 4-bromo-1,3-phenylenediamine, 2,5-dichloro-1,4-phenylenediamine, 5-nitro-1,3-phenylenediamine, 3-dimethoxy-4-aminoaniline; 4,4'-diamino-3,3'-dimethyl-5,5'-dibromo-diphenylmethane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl)sulfide, bis(4-aminophenyl)telluride, bis(4-aminophenyl)selenide, bis(4-amino-3-methoxyphenyl) disulfide, 4,4'-methylenebis(2-iodoaniline), 4,4'-methylenebis(2-bromoaniline), 4,4'-methylenebis(2-fluoroaniline) and 4-aminophenyl-2-chloroaniline.

Examples of the aromatic diamines having a secondary amino group include products obtained from the non-substituted aromatic diamines, the aromatic diamine having a nuclear-substituted alkyl group having 1 to 4 carbon atoms, mixtures of isomers of these aromatic diamines described above with various mixing ratios, and the aromatic diamines having the nuclear-substituted electron-withdrawing group, of which primary amino groups are partially or completely replaced with lower alkyl groups such as methyl and ethyl to result in products having secondary amino groups.

Examples of the amines having 3 or more valences include polyamide polyamine and polyether polyamine.

Examples of the polyamide polyamine include low-molecular polyamide polyamine obtained by condensation of a dicarboxylic acid with an excess amount of the polyamine (in an amount of 2 moles or more per 1 mole of the acid). Examples of the dicarboxylic acid include dimer acid. Examples of the polyamine include alkylene diamine and polyalkylene polyamine.

Examples of the polyether polyamine include hydroxide of cyanoethylated product of polyether polyol. Examples of the polyether polyol include polyalkylene glycol.

According to Solubility Parameter Values (Polymer handbook, 4th Ed), the cohesive energy of a urea bond is 50,230 [J/mol], which is about double the cohesive energy (26,370 [J/mol]) of a urethane bond. Therefore, effects of improving the toughness of the toner and improving the offset resistance of the toner when it is fixed can be expected from even a small amount of the urea bond.

It is preferable that the crystalline resin that contains: the urethane bond, the urea bond, or both thereof; and the crystalline polyester unit contain a crystalline resin that contains: the polyurethane unit, the polyurea unit, or both thereof; and the crystalline polyester unit. It is more preferable that the crystalline resin contain a crystalline resin that contains the polyurethane unit and the crystalline polyester unit.

It is preferable that a crystalline resin that contains the urethane bond, the urea bond, or both thereof contain a first crystalline resin, and a second crystalline resin of which weight-average molecular weight is greater than the first crystalline resin. In this case, it is preferable that the crystalline resin that contains the urethane bond, the urea bond, or both thereof be a crystalline resin that contains: the polyurethane unit, the polyurea unit, or both thereof; and the crystalline polyester unit.

The weight-average molecular weight of the first crystalline resin is preferably from 10,000 to 40,000, more preferably from 15,000 to 35,000, and particularly preferably from 20,000 to 30,000, in terms of realizing both the low temperature fixability and the heat resistant storage stability. When the weight-average molecular weight is less than 10,000, the heat resistant storage stability of the toner might be degraded. When it is greater than 40,000, the low temperature fixability of the toner might be degraded.

The weight-average molecular weight of the second crystalline resin is preferably from 40,000 to 300,000, and more preferably from 50,000 to 150,000 in terms of realizing both the low temperature fixability and the hot offset resistance. When the weight-average molecular weight is less than 40,000, the hot offset resistance of the toner might be degraded. When it is greater than 300,000, the low temperature fixability of the toner might be degraded, because the toner might not sufficiently melt particularly when it is fixed at a low temperature to make the image more likely to peel off.

The difference (Mw2−Mw1) between the weight-average molecular weight (Mw1) of the first crystalline resin and the weight-average molecular weight (Mw2) of the second crystalline resin is not particularly limited and may be appropriately selected according to the purpose. However, it is preferably 5,000 or more, and more preferably 10,000 or more. When the difference is less than 5,000, the fixable temperature range of the toner might be narrow.

The mass ratio of the first crystalline resin (1) to the second crystalline resin (2) is not particularly limited and may be appropriately selected according to the purpose. However, a preferable ratio (1)/(2) is from 5/95 to 60/40, a more preferable one is from 8/92 to 50/50, a still more preferable one is from 12/88 to 35/65, and a particularly preferable one is from 15/85 to 25/75. When the ratio of (1) is higher than these ranges, the hot offset resistance of the toner might be degraded. When the ratio of (2) is higher than these ranges, the low temperature fixability of the toner might be degraded.

It is preferable that the toner be a toner obtained by elongating a crystalline polyester resin containing an isocyanate group in an aqueous medium, and that the crystalline resin containing at least either the urethane bond or the urea bond and the crystalline polyester unit contain a resin obtained by elongating the crystalline polyester resin containing an isocyanate group. Examples of the elongation method include a method of reacting a compound containing a functional group that can react with an isocyanate group, with the isocyanate group of the crystalline polyester resin containing the isocyanate group at the end. Examples of the compound containing a functional group that can react with an isocyanate group include the polyamines mentioned above. The elongation is performed in an aqueous medium used for manufacturing the toner.

When the crystalline resin containing at least either the urethane bond or the urea bond contains the first crystalline resin and the second crystalline resin of which weight-average molecular weight is greater than the first crystalline resin, it is preferable that the second crystalline resin be a resin obtained by elongating the crystalline polyester resin containing an isocyanate group.

In order to use a crystalline resin of which molecular weight distribution may be controlled during polymerization, a polymerization method such as condensation polymerization, polyaddition, and addition condensation for obtaining such a resin may be, for example, adding in addition to a bifunctional monomer, a small amount of a monomer having a different number of functional groups, which would realize a wider molecular weight distribution. Examples of the monomer having a different number of functional groups include a trifunctional or higher monomer and a mono-functional monomer. However, use of a trifunctional or higher monomer results in generation of a branched structure. Therefore, when a resin having crystallinity is needed, it might be harder to obtain a crystalline structure with this method. When a mono-functional monomer is used, the monofunctional monomer terminates the polymerization reaction to thereby produce a resin having a lower molecular weight of the two or more kinds of resins, and meanwhile other portions continue the polymerization reaction to thereby become a higher molecular weight component.

Examples of the mono-functional monomer include a monool, a monocarboxylic acid and monoamine.

Examples of the monool include methanol, ethanol, propanol, isopropanol, butanol, sec-butanol, t-butanol, pentanol, hexanol, heptanol, octanol, 2-ethylhexanol, nonanol, decanol, undecanol, lauryl alcohol, myristyl alcohol, palmityl alcohol, stearyl alcohol, docosanol, eicosanol, phenol and a substitution product of phenol, 1-naphtol, 2-naphtol, benzyl alcohol and a substitution product of benzyl alcohol, cyclopentanol, cyclohexanol, adamantanol, and cholesterol and a substitution product of cholesterol.

Examples of the monocarboxylic acid include formic acid, acetic acid, butyric acid, valeric acid, isovaleric acid, caproic acid, 2-ethylhexanoic acid, heptanoic acid, caprylic acid, capric acid, lauric acid, myristic acid, palmitic acid, stearic acid, oleic acid, linoleic acid, behenic acid, cerotic acid, montanic acid, triacontanoic acid, benzoic acid and a substitution product of benzoic acid, and benzyl acid and a substitution product of benzyl acid.

Examples of the monoamine include an alkyl amine, an aromatic amine, and an amino acid. Examples of the alkyl amine include methylamine, dimethylamine, ethylamine, diethylamine, propylamine, dipropylamine, butylamine, dibutylamine, hexylamine, octylamine, 2-ethylhexylamine, decylamine, laurylamine, myristyl amine, palmityl amine, stearyl amine and behenyl amine. Examples of the aromatic amine include aniline, benzylamine, o-anisidine, m-anisidine, p-anisidine, o-toluidine, m-toluidine and p-toluidine. Examples of the amino acid include glycine, α-alanine, β-alanine, arginine, asparagine, aspartic acid, cysteine, glutamine, glutamic acid, histidine, isoleucine, leucine, lysine, methionine, phenylalanine, proline, serine, threonine, tryptophan, tyrosine and valine.

The maximum peak temperature of the heat of melting of the crystalline resin is not particularly limited and may be appropriately selected according to the purpose. In terms of realizing both of the low temperature fixability and the heat resistant storage stability, the maximum peak temperature is preferably from 50° to 80° C., more preferably from 55° C. to 70° C., and particularly preferable from 60° C. to 70° C. When the maximum peak temperature is lower than 50° C., the low temperature fixability is good, but the heat resistant storage stability may be degraded. When the maximum peak temperature is higher than 80° C., the heat resistant storage stability is good, but the low temperature fixability may be degraded.

The ratio of the softening temperature of the crystalline resin to the maximum peak temperature of heat of melting thereof (softening temperature/maximum peak temperature of heat of melting) is not particularly limited and may be appropriately selected according to the purpose. It is preferably from 0.8 to 1.6, more preferably from 0.8 to 1.5, still more preferably from 0.8 to 1.4, and particularly preferably from 0.8 to 1.3. When this ratio is within the preferable ranges, the resin will have a characteristic of steeply softening, which is advantageous in terms of realizing both the low temperature fixability and heat resistant storage stability.

The weight-average molecular weight (Mw) of the crystalline resin is not particularly limited and may be appropriately selected according to the purpose. In terms of fixability, it is preferably from 20,000 to 100,000, more preferably from 20,000 to 70,000, still more preferably from 30,000 to 60,000, and particularly preferably from 35,000 to 50,000. When the weight-average molecular weight is less than 20,000, the internal cohesive force of the toner when it is melted becomes too small even if the toner contains a high-molecular-weight component abundantly, which would cause hot offset or paper winding to the fixing member. When the weight-average molecular weight is greater than 100,000, the molecular weight of a binder resin as a whole becomes too high, which would degrade the fixability, reduce glossiness too much, or easily cause falling off of the fixed image upon external stress.

The content of the crystalline resin in the binder resin is not particularly limited and may be appropriately selected according to the purpose. In terms of optimally realize both of excellent low temperature fixability and heat resistant storage stability to be enabled by the crystalline resin, it is preferably 50% by mass or higher, more preferably 65% by mass or higher, still more preferably 80% by mass or higher, and particularly preferably 95% by pass or higher. When the content is lower than 50% by mass, the binder resin cannot express its sharp responsiveness to heat in the viscoelastic characteristic of the toner, to make it harder to realize both the low temperature fixability and the heat resistant storage stability.

<<Non-Crystalline Resin>>

The non-crystalline resin is not particularly limited as long as it is non-crystalline, and may be appropriately selected according to the purpose. Examples thereof include: a homopolymer of styrene and a substitution product thereof such as polystyrene and polyvinyltoluene; a styrene copolymer such as styrene-methyl acrylate copolymer, styrene-methacrylic acid copolymer, styrene-methyl methacrylate copolymer, styrene-butyl methacrylate copolymer, styrene-acrylonitrile copolymer, styrene-vinyl methyl ether copolymer, styrene-vinyl methyl ketone copolymer, styrene-butadiene copolymer and styrene-maleic acid ester copolymer; a polymethyl methacrylate resin, a polybutyl methacrylate resin, a polyvinyl acetate resin, a polyethylene resin, a polyester resin, a polyurethane resin, an epoxy resin, a polyvinyl butyral resin, a polyacrylic resin, a rosin resin, a modified rosin resin, and these resins modified to have a functional group reactive with an active hydrogen group. These may be used alone or in combination of two or more.

The content of the non-crystalline resin in the binder resin is not particularly limited and may be appropriately selected according to the purpose.

<Other Components>

The other components are not particularly limited and may be appropriately selected according to the purpose. Examples thereof include a colorant, a releasing agent, a charge controlling agent, and external additives.

<<Colorant>>

The colorant is not particularly limited and may be appropriately selected according to the purpose. Examples thereof include a black pigment, a yellow pigment, a magenta pigment, and a cyan pigment. It is preferable that the colorant contain any of a yellow pigment, a magenta pigment, and a cyan pigment among these.

For example, the black pigment is used for a black toner. Examples of the black pigment include carbon black, copper oxide, manganese dioxide, aniline black, active charcoal, non-magnetic ferrite, magnetite, a nigrosine dye, and iron black.

For example, the yellow pigment is used for a yellow toner. Examples of the yellow pigment include C.I. pigment yellow 74, 93, 97, 109, 128, 151, 154, 155, 166, 168, 180, and 185, naphthol yellow S, Hansa yellow (10G, 5G, and G), cadmium yellow, yellow iron oxide, yellow ocher, yellow lead, titanium yellow, and polyazo yellow.

For example, the magenta pigment is used for a magenta toner. Examples of the magenta toner include a quinacridone pigment, C.I. pigment red 48:2, 57:1, and 58:2, and monoazo pigments 5, 31, 146, 147, 150, 176, 184, and 269. The quinacridone pigment may be used in the monoazo pigment.

For example, the cyan pigment is used for a cyan toner. Examples of the cyan pigment include a Cu-phthalocyanine pigment, a Zn-phthalocyanine pigment, and an Al-phthalocyanine pigment.

The content of the colorant is not particularly limited and may be appropriately selected according to the purpose. It is preferably from 1 part by mass to 15 parts by mass, and more preferably from 3 parts by mass to 10 parts by mass, relative to 100 parts by mass of the toner. When the content is less than 1 part by mass, the coloring performance of the toner might be degraded. When the content is greater than 15 parts by mass, the pigment might not disperse well in the toner to reduce the coloring performance or reduce the electrical properties of the toner.

The colorant may also be used as a master batch that is combined with a resin. The resin to be manufactured as the master batch or to be kneaded with the master batch is not particularly limited and may be appropriately selected according to the purpose.

It is possible to obtain the master bath by mixing a resin for the master batch with the colorant under a high shearing force. At this time, an organic solvent may be used in order to improve the interaction between the colorant and the resin. Further, the so-called flushing method of mixing and kneading an aqueous paste containing the colorant water with the resin and an organic solvent to transfer the colorant to the resin and then removing the water and the organic solvent component is preferably used, because the method does not require drying because a wet cake of the colorant can be used as it is wet. In the mixing and kneading, a high shearing disperser such as a three-roll mill is preferably used.

<<Releasing Agent>>

The releasing agent is not particularly limited and may be appropriately selected according to the purpose. The examples thereof include a carbonyl group-containing wax, a polyolefin wax, and long-chain hydrocarbon. One of these may be used alone, or two or more of these may be used in combination. Among these, the carbonyl group-containing wax is preferable.

Examples of the carbonyl group-containing wax include polyalkanoic acid esters, polyalkanol esters, polyalkanoic acid amides, polyalkylamides, and dialkyl ketones.

Examples of the polyalkanoic acid esters include carnauba wax, montan wax, trimethylolpropane tribehenate, pentaerythritol tetrabehenate, pentaerythritol diacetatedibehenate, glycerine tribehenate and 1,18-octadecanediol distearate.

Examples of the polyalkanol esters include tristearyl trimellitate and distearyl malleate.

Examples of the polyalkanoic acid amides include dibehenylamide.

Examples of the polyalkylamides include trimellitic acid tristearylamide.

Examples of the dialkyl ketones include distearyl ketone.

Among these carbonyl group-containing waxes, the polyalkanoic acid esters are preferable.

Examples of the polyolefin wax include a polyethylene wax and a polypropylene wax.

Examples of the long-chain hydrocarbon include a paraffin wax and SASOL wax.

The melting point of the releasing agent is not particularly limited and may be appropriately selected according to the purpose. It is preferably from 50° C. to 100° C., and more preferably from 60° C. to 90° C. When the melting point is lower than 50° C., the heat resistant storage stability might be adversely affected. When the melting point is higher than 100° C., a cold offset is likely to occur during fixation at a low temperature.

The melt viscosity of the releasing agent is preferably from 5 mPa·sec to 100 mPa·sec, more preferably from 5 mPa·sec to 50 mPa·sec, and particularly preferably from 5 mPa·sec to 20 mPa·sec, when measured at 100° C. When the melt viscosity is less than 5 mPa·sec, the releasing performance might be degraded. When it is greater than 100 mPa·sec, the hot offset resistance, and the releasing performance at low temperatures might be degraded.

The content of the releasing agent is not particularly limited and may be appropriately selected according to the purpose. It is preferably from 0 parts by mass to 20 parts by mass, more preferably from 3 parts by mass to 15 parts by mass, and particularly preferably from 3 parts by mass to 7 parts by mass, relative to 100 parts by mass of the toner. When the content is greater than 20 parts by mass, the flowability of the toner might be degraded.

<<Charge Controlling Agent>>

The charge controlling agent is not particularly limited and may be appropriately selected according to the purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives. Specific examples include nigrosine dye BONTRON® 03, quaternary ammonium salt BONTRON® P-51, metal-containing azo dye BONTRON® S-34, oxynaphthoic acid-based metal complex E-82, salicylic acid-based metal complex E-84 and phenol condensate E-89 (these products are of Orient Chemical Industries Co., Ltd.), quaternary ammonium salt molybdenum complex TP-302 and TP-415 (these products are of Hodogaya Chemical Co., Ltd.), and LRA-901 and boron complex LR-147 (these products are of Japan Carlit Co., Ltd.). One of these may be used alone, or two or more of these may be used in combination.

The content of the charge controlling agent is not particularly limited and may be appropriately selected according to the purpose. It is preferably from 0.01 parts by mass to 5 parts by mass, and more preferably from 0.02 parts by mass to 2 parts by mass. When the content is less than 0.01 parts by mass, the charge rising property and the amount of charge to be built up will be insufficient, to degrade the toner image. When the content is greater than 5 parts by mass, the toner's capacity to be charged will be excessively large, to increase the electrostatic attractive force with a developing roller to incur degradation of flowability of the developer or degradation of the image density.

<<External Additives>>

The external additives are not particularly limited and may be appropriately selected according to the purpose. Examples thereof include silica, fatty acid metal salt, metal oxide, hydrophobized titanium oxide, and fluoropolymer.

Examples of the fatty acid metal salt include zinc stearate, and aluminum stearate.

Examples of the metal oxide include titanium oxide, aluminum oxide, tin oxide, and antimony oxide.

Examples of commercially-available products of the silica include R972, R974, RX200, RY200, R202, R805, and R812 (all manufactured by Nippon Aerosil Co., Ltd.).

Examples of commercially-available products of the titanium oxide include P-25 (manufactured by Nippon Aerosil Co., Ltd.), STT-30 and STT-65C-S (both manufactured by Titan Kogyo, Ltd.), TAF-140 (manufactured by Fuji Titanium Industry Co., Ltd.), and MT-150 W, MT-500B, MT-600B, and MT-150A (all manufactured by Tayca Corporation).

Examples of commercially-available products of the hydrophobized titanium oxide include T-805 (manufactured by Nippon Aerosil Co., Ltd.), STT-30A and STT-65S-S (both manufactured by Titan Kogyo, Ltd.), TAF-500 T and TAF-1500 T (both manufactured by Fuji. Titanium Industry Co., Ltd.), MT-100S and MT-100T (both manufactured by Tayca Corporation, and IT-S (manufactured by Ishihara Sangyo Kaisha).

The hydrophobizing method may be treating hydrophilic fine particles with a silane coupling agent such as methyl trimethoxy silane, methyl triethoxy silane, and octyl trimethoxy silane.

The content of the external additives is not particularly limited and may be appropriately selected according to the purpose. It is preferably from 0.1 parts by mass to 5 parts by mass, and more preferably from 0.3 parts by mass to 3 parts by mass, relative to 100 parts by mass of the toner.

The average particle diameter of the primary particles of the external additives is not particularly limited and may be appropriately selected according to the purpose. It is preferably from 1 nm to 100 nm, and more preferably from 3 nm to 70 nm. When the average particle diameter is less than 1 nm, the external additives might be buried in the toner and may not be able to effectively exert their functions. When the average particle diameter is greater than 100 nm, the external additives might damage the surface of the photoconductor non-uniformly.

<Maximum Endothermic Peak Temperature (P1)>

The maximum endothermic peak temperature (P1) is from 50° C. to 80° C., preferably from 55° C. to 75° C., and more preferably from 60° C. to 70° C. When the maximum endothermic peak temperature (P1) is lower than 50° C., the heat resistant storage stability of the toner will be insufficient. When the maximum endothermic peak temperature (P1) is higher than 80° C., the low temperature fixability will be insufficient.

<Total Endothermic Amount (Q)>

The total endothermic amount (Q) is from 35 J/g to 90 J/g, preferably from 45 J/g to 90 J/g, and more preferably from 55 J/g to 70 J/g. When the total endothermic amount (Q) is less than 35 J/g, the amount of the crystalline resin or crystallized portions in the toner is scarce, and hence the toner cannot have sufficient low temperature fixability or heat resistant storage stability. When the total endothermic amount (Q) is greater than 90 J/g, the toner requires an excessively large amount of energy to be fixed onto a fixing medium, resulting in insufficient low temperature fixability.

<Ratio ($Q_p$/Q)>

The ratio ($Q_p$/Q) is from 0.65 to 0.83, preferably from 0.65 to 0.80, and more preferably from 0.70 to 0.80. When the ratio ($Q_p$/Q) is less than 0.65, the sharp melting property is excessively high, and toner particles aggregate in the developing device to generate white voids. When the ratio ($Q_p$/Q) is greater than 0.83, the sharp melting property is insufficiently expressed, making it harder to realize both of sufficient low temperature fixability and sufficient heat resistant storage stability.

<Ratio ($Q_5$/Q)>

The ratio ($Q_5$/Q) is a ratio of a total endothermic amount ($Q_5$) of the toner in a temperature range of from 20° C. to a temperature [the maximum endothermic peak temperature (P1)−5° C.] at the first temperature elevation in differential scanning calorimetry to the total endothermic amount (Q). The ratio ($Q_5$/Q) is not particularly limited and may be appropriately selected according to the purpose. It is preferably from 0.25 to 0.50, more preferably from 0.30 to 0.50, and particularly preferably from 0.40 to 0.45. The low temperature fixability of the toner is greatly affected by the melting point of the toner. When the ratio ($Q_5/Q$) is within the preferable ranges, the low temperature fixability and the heat resistant storage stability will become more favorable. Moreover, when the ratio ($Q_5/Q$) is within the preferable ranges, the toner can express sufficient fixability even if the melting point of the toner is raised, making it easier to realize both suppression of aggregation of toner particles and the other requirements.

<Ratio ($Q_{10}/Q$)>

The ratio ($Q_{10}/Q$) is a ratio of a total endothermic amount ($Q_{10}$) of the toner in a temperature range of from 20° C. to a temperature [the maximum endothermic peak temperature (P1)−10° C.] at the first temperature elevation in differential scanning calorimetry to the total endothermic amount (Q). The ratio ($Q_{10}/Q$) is not particularly limited and may be appropriately selected according to the purpose. It is preferably 0.10 or less, and more preferably from 0.03 to 0.10. When the ratio ($Q_{10}/Q$) is greater than 0.10, an endothermic amount at temperatures lower than the melting point is excessively large, and hence the heat resistant storage stability may be degraded. When the ratio ($Q_{10}/Q$) is 0.10 or less, a sufficient heat resistant storage stability can be expressed.

It is preferable that the maximum endothermic peak temperature (P1) at the first temperature elevation in the differential scanning calorimetry of the toner and a maximum exothermic peak temperature (P2) at a temperature decrease satisfy the following formulae (1) and (2).

$$P1-P2 \leq 30° \text{ C.} \quad \text{formula (1)}$$

$$P2 \geq 35° \text{ C.} \quad \text{formula (2)}$$

A toner using a crystalline resin melts on a recording medium during a fixing process, and the crystalline resin in the toner crystallizes while the recording medium is conveyed. If the crystalline resin recrystallizes at a low temperature, it does not crystallize rapidly, and hence the fixed image is conveyed in its soft state. Therefore, the fixed image is easily damaged from sliding friction with the conveying member. Therefore, a temperature difference (P1−P2) between the maximum endothermic peak temperature (P1) and the maximum exothermic peak temperature (P2) in a DSC curve at the temperature decrease, which is an indicator of the recrystallization temperature of the crystalline resin is preferably 30° C. or lower, and more preferably 25° C. or lower.

The maximum exothermic peak temperature (P2) is preferably 35° C. or higher, more preferably from 35° C. to 55° C., and particularly preferably from 40° C. to 55° C. When the maximum exothermic peak temperature (P2) is lower than 35° C., the speed at which the fixed image is cooled and solidified will become low, to cause blocking of the fixed image or conveying damages on the fixed image. It is preferable that the maximum exothermic peak temperature (P2) be as high as possible. However, since the maximum exothermic peak temperature (P2) is the crystallization temperature, it cannot be hither than the maximum endothermic peak temperature (P1), which is the melting point.

The endothermic profile of a DSC curve of the toner of the present invention is dependent on the structures of the compositions of mainly the crystalline resin, and is generated based on close mutual influences between the monomer compositions and the molecular weight of the resin, the disposition of the site having crystallinity, the compounding ratio of other resins to be used in combination, and the like.

The maximum endothermic peak temperature (P1), the total endothermic amount (Q), the total endothermic amount ($Q_5$), the total endothermic amount ($Q_{10}$), and the maximum exothermic peak temperature (P2) can be measured with differential scanning calorimeters (DSC) (e.g., TA-60WS and DSC-60 manufactured by Shimadzu Corporation).

Specifically, the measurement is performed by placing a sample (5 mg) in an aluminum sample pan and setting the pan in the instrument. Alumina (10 g) is used as the reference, and used by being placed in an aluminum sample pan like the sample. They are warmed from 20° C. to 150° C. at a temperature elevating rate of 10° C./min (this elevation is the first temperature elevation), then cooled to 0° C. at a temperature decreasing rate of 10° C./min (this is the temperature decrease), and again warmed at a temperature elevating rate of 10° C./min (this is the second temperature elevation). Their endothermic and exothermic changes are measured and plotted as a graph of temperature vs. endothermic and exothermic amount, to thereby obtain a DSC curve. The measurement results are analyzed with a data analyzing software program (TA-60, version 1.52) manufactured by Shimadzu Corporation, to thereby obtain the values P1, P2, Q, $Q_p$, $Q_5$, and $Q_{10}$.

A method for controlling the values P1, P2, Q, $Q_p$, $Q_5$, and $Q_{10}$ is not particularly limited and may be appropriately selected according to the purpose. For example, it is possible to obtain desired values of P1, P2, Q, $Q_p$, $Q_5$, and $Q_{10}$ by appropriately controlling the melting point, the molecular weight, the molecular weight distribution, and the monomer compositions of the crystalline resin.

<Weight-Average Molecular Weight>

The weight-average molecular weight of a tetrahydrofuran (THF) soluble content of the toner is not particularly limited and may be appropriately selected according to the purpose. It is preferably from 20,000 to 70,000, more preferably from 20,000 to 50,000, and particularly preferably from 20,000 to 35,000. When the weight-average molecular weight is less than 20,000, the internal cohesive force of the toner when it is melted becomes too small even if the toner contains a high-molecular-weight component abundantly, which would cause hot, offset or paper winding to the fixing member. When the weight-average molecular weight is greater than 70,000, the molecular weight of the binder resin as a whole is too high, which would degrade the fixability, reduce the glossiness, or easily cause falling off of the fixed image upon external stress.

It is possible to obtain the tetrahydrofuran (THF) soluble content of the toner by adding the toner (30 mg) to tetrahydrofuran (THF) (containing a stabilizer, manufactured by Wako Pure Chemical Industries, Ltd.) (20 mL), stirring them for 1 hour, and then filtering the resultant through a 0.2 μm filter.

<Amount of High-Molecular-Weight Component>

The THF soluble content of the toner contains a component having a molecular weight of 100,000 or greater in a molecular weight distribution obtained by gel permeation chromatography, in a quantity of preferably 1.0% or greater, and more preferably 2.0% or greater as peak area. The upper limit value thereof is not particularly limited and may be appropriately selected according to the purpose. However, it is preferably 25.0% or less. When the peak area is less than 1.0%, conveying damages may occur in the fixed image.

It is preferable that the THF soluble content of the toner contain a component having a molecular weight of 250,000 or greater in the molecular weight distribution obtained by gel permeation chromatography, in a quantity of 0.5% or greater as peak area, because the effect of suppressing generation of conveying damages will be improved.

The ratio of the component having the molecular weight of 100,000 or greater can be confirmed from the intersection of an integrated molecular weight distribution curve with the point of the molecular weight of 100,000.

The ratio of the component having the molecular weight of 250,000 or greater can be confirmed from the intersection of the integrated molecular weight distribution curve with the point of the molecular weight of 250,000.

The weight-average molecular weight and the molecular weight distribution can be measured with, for example, a gel permeation chromatography (GPC) measuring instrument (e.g., HLC-8220GPC manufactured by Tosoh Corporation). Three 15 cm columns (TSKGEL SUPER HZM-H®) are used in connection. The sample to be measured is prepared as a 0.15% by mass tetrahydrofuran (THF) solution of (THF containing a stabilizer, and manufactured by Wako Pure Chemical Industries, Ltd.), and filtered through a 0.2 μm filter. The resulting filtrate is used as the sample. The sample (100 μL) is poured into the measuring instrument, and measured at a flow rate of 0.35 mL/minute at a temperature of 40° C.

The molecular weight is obtained by performing calculation using a calibration curve generated based on a monodisperse polystyrene standard sample. As the monodisperse polystyrene standard sample, SHOWDEX STANDARD® series manufactured by Showa Denko K.K. and toluene are used. THF solutions of the following three kinds of monodisperse polystyrene standard samples are prepared and measured under the conditions described above, and the calibration curve is generated by regarding the retention times of the peak tops as the molecular weight of the monodisperse polystyrene standard samples by light scattering.

Solution A: S-7450 (2.5 mg), S-678 (2.5 mg), S-46.5 (2.5 mg), S-2.90 (2.5 mg), THF (50 mL)

Solution B: S-3730 (2.5 mg), S-257 (2.5 mg), S-19.8 (2.5 mg), S-0.580 (2.5 mg), THF (50 mL)

Solution C: S-1470 (2.5 mg), S-112 (2.5 mg), S-6.93 (2.5 mg), toluene (2.5 mg), THF (50 mL)

A RI (refraction index) detector is used as the detector.

<Content of N Element>

A content of N element in a CHN analysis of the THF soluble content of the toner is not particularly restricted and may be appropriately selected according to the purpose. It is preferably 0.3% by mass to 2.0% by mass, more preferably 0.3% by mass to 1.8% by mass, and particularly preferably 0.7% by mass to 1.6% by mass. When the content of N element is less than 0.3% by mass, aggregation and pollution of members in an image forming apparatus due to decreased toughness of the toner or high-temperature offset due to decreased viscoelasticity of the toner in a molten state may occur. When the content of N element exceeds 2.0% by mass, the toner in a molten state has an excessively high viscoelasticity. As a result, it is possible that fixing property, glossiness and charging property may degrade. The content of N element in the particularly preferable range is advantageous in terms of damages to the image when it is conveyed.

The content of N element is an amount of N element attributed to the urethane bond and the urea bond in the resin.

The content of N element may be obtained as an average value of two measurement values of CHN simultaneous measurement under conditions of a combustion furnace of 950° C., a reduction furnace of 550° C., a helium flow rate of 200 mL/min and an oxygen flow rate of from 25 mL/min to 30 mL/min using VARIO MICRO CUBE® (manufactured by Elementar Analytical). Here, when the content of N element obtained by this measurement method is less than 0.5% by mass, a further measurement is conducted using a trace nitrogen analyzer ND-100 (manufactured by Mitsubishi Chemical Corporation). An electric furnace (horizontal reactor) has temperatures in a thermal decomposition part of 800° C. and in a catalytic part of 900° C., and with measurement conditions of the main $O_2$ flow rate of 300 mL/min, $O_2$ flow rate of 300 mL/min, Ar flow rate of 400 mL/min, and the sensitivity of Low, quantification is performed using a calibration curve created with pyridine standard solutions.

<Amount of Crystalline Structure [C/(A+C)]>

In a diffraction spectrum of the toner obtained by x-ray diffractometry, a ratio [C/(A+C)] of spectrum integrated intensity (C) derived from a crystalline structure of the binder resin to a sum of the spectrum integrated intensity (C) and spectrum integrated intensity (A) derived from a non-crystalline structure is not particularly restricted and may be appropriately selected according to the purpose. It is preferably 0.15 or greater, and more preferably 0.20 or greater. The upper limit thereof is not particularly restricted and may be appropriately selected according to the purpose. It is preferably 0.50 or less, and more preferably 0.30 or less. When the ratio [C/(A+C)] is less than 0.15, crystallization of the crystalline resin is insufficient, and the heat resistant storage stability of the toner and the blocking resistance of a fixed toner image may be degraded. The ratio [C/(A+C)] within the more preferable range is advantageous in obtaining both low temperature fixability and heat resistant storage stability.

The ratio [C/(A+C)] is an index indicating an amount of a crystallization site in a binder resin, and it is an area ratio of a main diffraction peak attributed to the crystalline structure of the binder resin to a halo attributed to the non-crystalline structure in a diffraction spectrum obtained by an x-ray diffraction measurement.

The x-ray diffraction measurement may be performed using an x-ray diffractometer equipped with a 2-dimensional detector (D8 DISCOVER® with GADDS®, manufactured by Bruker).

As a capillary for the measurement, a mark tube (Lindemann glass) having a diameter of 0.70 mm is used. A sample is filled to an upper portion of this capillary tube for measurement. Also, tapping is performed when the sample is filled, where the number of tapping is 100.

Detailed measurement conditions are described below.

Tube current: 40 mA

Tube voltage: 40 kV

Goniometer 2θ axis: 20.0000°

Goniometer Ω axis: 0.0000°

Goniometer ϕ axis: 0.0000°

Detector distance: 15 cm (wide angle measurement)

Measuring range: 3.2≤2θ (°)≤37.2

Measurement time: 600 sec

A collimator having a pinhole with a diameter of 1 mm is used for an incident optical system. Obtained 2-dimensional data is integrated with supplied software (at 3.2° to 37.2° in the x-axis) and converted to 1-dimensional data of a diffraction intensity and 2θ.

Figure 1B:
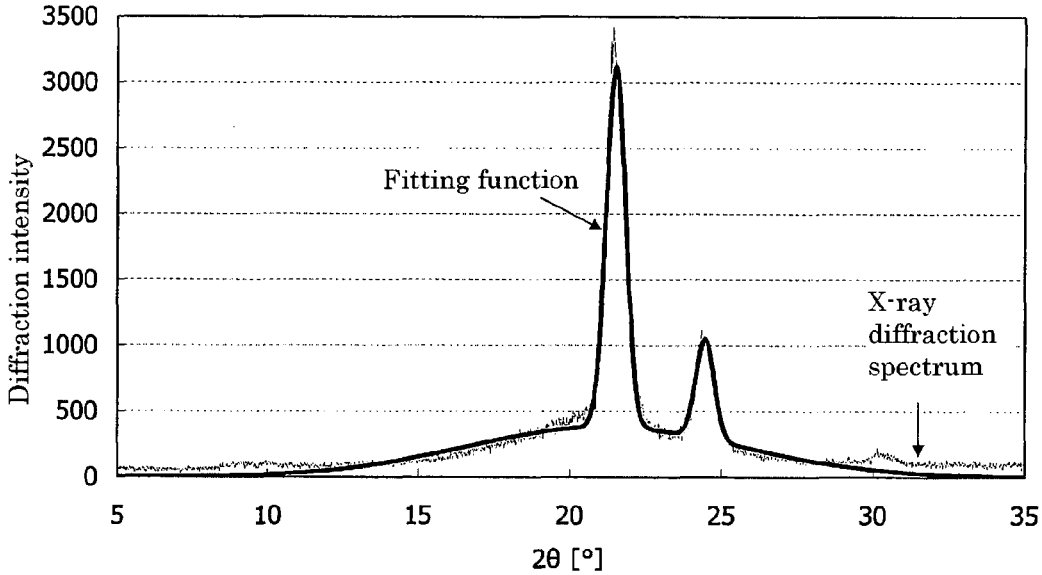
FIG. 1B is a diagram showing an example diffraction spectrum obtained by X-ray diffractometry.

A method for calculating the ratio [C/(A+C)] based on the obtained x-ray diffraction measurement results is explained below. An example of a diffraction spectrum obtained by an x-ray diffraction measurement is illustrated in FIG. 1A and FIG. 1B. The horizontal axis represents 2θ, the vertical axis represents the x-ray diffraction intensity, and the both are linear axes. In the x-ray diffraction spectrum in FIG. 1A, there are main peaks at 2θ=21.3° (P1) and 24.2° (P2), halos (h) are observed in a wide range including these two peaks. Here, the main peaks are attributed to a crystalline structure while the halos are attributed to a non-crystalline structure.

These two main peaks and halos are expressed by Gaussian functions ($f_{p1}(2\theta)$, $f_{p2}(2\theta)$, and $f_h(2\theta)$ denote main peak P1, main peak P2 and halos, respectively):

$$f_{p1}(2\theta)=a_{p1}\exp[-(2\theta-b_{p1})^2/(2c_{p1}^2)] \quad \text{(Formula A(1))}$$

$$f_{p2}(2\theta)=a_{p2}\exp[-(2\theta-b_{p2})^2/(2c_{p2}^2)] \quad \text{(Formula A(2))}$$

$$f_h(2\theta)=a_h\exp[-(2\theta-b_h)^2/(2c_h^2)] \quad \text{(Formula A(3))}$$

A sum of these functions:

$$f(2\theta)=f_{p1}(2\theta)+f_{p2}(2\theta)+f_h(2\theta) \quad \text{(Formula A(4))}$$

is regarded as a fitting function of the overall x-ray diffraction spectrum (illustrated in FIG. 1B), with which fitting by a least square method is carried out.

There are 9 fitting variables, namely $a_{p1}$, $b_{p1}$, $c_{p1}$, $a_{p2}$, $b_{p2}$, $c_{p2}$, $a_h$, $b_h$ and $c_h$. As initial values of these variables for fitting, peak locations of the x-ray diffraction are set for $b_{p1}$, $b_{p2}$ and $b_h$ (in the example of FIG. 1A, $b_{p1}$=21.3, $b_{p2}$=24.2, and $b_h$=22.5), and appropriate values are input for the other variables so that the two main peaks and halos coincide as much as possible with the x-ray diffraction spectrum. The fitting may be carried out using the solver of Excel 2003, manufactured by Microsoft Corporation.

From the integrated areas ($S_{p1}$, $S_{p2}$, $S_h$) of the respective Gaussian functions $f_{p1}(2\theta)$, $f_{p2}(2\theta)$ corresponding to the two main peaks (P1, P2) and Gaussian function $f_h(2\theta)$ corresponding to the halos after fitting, the ratio [C/(A+C)] as an index indicating the amount of the crystallization site may be calculated, assuming ($S_{p1}+S_{p2}$) is (C) and ($S_h$) is (A).

When the toner contains a wax, a diffraction peak specific to the wax often appears at the location of 2θ=23.5° to 24°. However, when the content of the wax relative to the toner whole mass is less than 15% by mass, it is unnecessary to take the diffraction peak specific to the wax into account, because its contribution is small. When the content of the wax is 15% by mass or greater, the value obtained by subtracting the spectrum integrated intensity derived from the crystalline structure of the wax from the spectrum integrated intensity derived from the crystalline structure is the "spectrum integrated intensity (C) derived from the crystalline structure of the binder resin" mentioned above.

<Mixed Solvent Insoluble Content>

An insoluble content of the toner insoluble in a mixed solution of tetrahydrofuran and ethyl acetate [tetrahydrofuran/ethyl acetate=50/50 (mass ratio)] is not particularly restricted and may be appropriately selected according to the purpose. It is preferably 5.0% by mass or greater, more preferably 8.0% by mass or greater, and particularly preferably 10.0% by mass or greater.

The insoluble content may be obtained by: adding 0.4 g of toner to 40 g of a mixed solution of tetrahydrofuran (THF) and ethyl acetate (with a mixing ratio of 50:50 as a mass basis), shaking it for 20 minutes, precipitating an insoluble content by centrifuge, removing a supernatant, and vacuum drying the remaining.

The mixed solution of tetrahydrofuran and ethyl acetate [tetrahydrofuran/ethyl acetate=50/50 (mass ratio)] hardly dissolves a high-molecular-weight-component in the toner (having a molecular weight of about 20,000 or greater) and easily dissolves a low-molecular weight component having a molecular weight less than that. Thus, it is possible to prepare a sample with increased concentration of high-molecular weight resin component by treating the toner using the above mixed solution.

<Ratio of ($Q_h$/Q)>

A ratio ($Q_h$/Q) of a total endothermic amount ($Q_h$) of the insoluble content of the toner in the mixed solution of tetrahydrofuran and ethyl acetate [tetrahydrofuran/ethyl acetate=50/50 (mass ratio)] at the second temperature elevation in the differential scanning calorimetry to the total endothermic amount (Q) is not particularly restricted and may be appropriately selected according to the purpose. It is preferably from 0.20 to 1.25, and more preferably from 0.30 to 1.00.

The total endothermic amount ($Q_h$) may be measured in the same manner as measuring the total endothermic amount (Q) with a differential scanning calorimeter (DSC).

The high-molecular-weight-component of the toner preferably has a resin structure close to the entire binder resin, and if the binder resin has crystallinity, it is preferable that the high-molecular-weight-component similarly has crystallinity. On the other hand, when the high-molecular-weight-component has a structure largely different from the other resin components, the high-molecular-weight-component easily undergoes layer separation to be in a sea-island state, and contribution to improvements of viscoelasticity and cohesive force to the entire toner may not be expected.

Whether the high-molecular-weight component has a resin structure close to the entire binder resin or not may be determined based on the ratio ($Q_h$/Q).

<Urea Bond>

It is preferable that a urea bond exist in the THF soluble content of the toner since effects of improved toughness of the toner and offset resistance during fixing may be expected even with a small amount of the urea bond.

The presence of the urea bond in the THF soluble content of the toner may be confirmed using $^{13}$C-NMR. Specifically, the analysis is conducted as follows. After 2 g of a sample to be analyzed is soaked in 200 mL of a methanol solution of potassium hydroxide having a concentration of 0.1 mol/L and left at 50° C. for 24 hours, the solution is removed, the residue is further washed with ion-exchange water until a pH thereof becomes neutral, and the remaining solid is dried. The sample after drying is added with a mixed solvent of dimethylacetamide (DMAc) and deuterated dimethyl sulfoxide (DMSO-$d_6$) (having a volume ratio of 9:1) with a concentration of 100 mg/0.5 mL. The sample is dissolved therein first at 70° C. for 12 hours to 24 hours and then to 50° C., and $^{13}$C-NMR measurement is conducted. Here, a measurement frequency is 125.77 MHz, 1H_60° pulse is 5.5 μs, and a reference substance is 0.0 ppm of tetramethylsilane (TMS).

Figure 2:
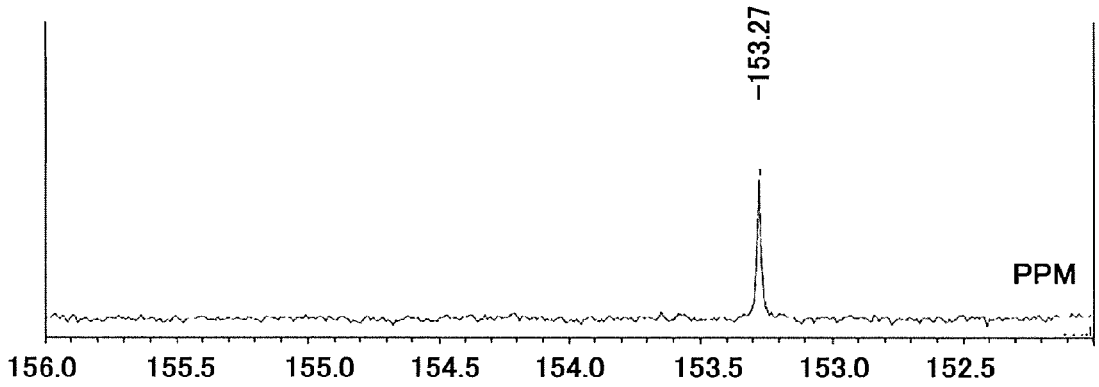
FIG. 2 shows an example $^{13}$C NMR spectrum that verifies presence of a urea bond.

The presence of a urea bond in the sample is confirmed by whether or not a signal is observed in a chemical shift of a signal attributed to the carbonyl carbon of the urea bond site of polyurea as a preparation. The chemical shift of the carbonyl carbon is generally observed at 150 ppm to 160 ppm. A $^{13}$C-NMR spectrum near a carbonyl carbon of a polyurea as a reaction product of 4,4'-diphenylmethane diisocyanate (MDI) and water, which is one example of polyurea, is illustrated in FIG. 2. A signal attributed to the carbonyl carbon is observed at 153.27 ppm.

<Urethane Bond>

The THF soluble content of the toner preferably contains a urethane bond. The urethane bond may be confirmed by using $^{13}$C-NMR similarly to the confirmation method for the urea bond.

It is preferable that the toner satisfy the following conditions (1) to (6), and it is more preferable that the toner satisfy the conditions (1) to (5) and (7), because the toner will be excellent in low temperature fixability, heat resistant storage stability, and suppression of occurrence of aggregation of toner particles in the developing device, and in addition, in terms of damages to a fixed image when it is conveyed.

(1): the maximum endothermic peak temperature (P1) of from 60° to 70° C.

(2): the total endothermic amount (Q) of from 45 J/g to 90 J/g (3): the ratio ($Q_p$/Q) of from 0.70 to 0.80

(4): the ratio ($Q_{10}$/Q) of from 0.30 to 0.10

(5): the tetrahydrofuran soluble content of the toner contains a component having a molecular weight of 100,000 or greater in a value of 1.0% or greater as peak area in the molecular weight distribution measured by gel permeation chromatography, and the weight-average molecular weight of the tetrahydrofuran soluble content of the toner measured by the gel permeation chromatography is from 20,000 to 70,000.

(6): the content of N element of from 0.3% by mass to 1.8% by mass (7): The content of N element of from 0.7% by mass to 1.6% by mass The weight-average particle diameter (Dv) of the toner is not particularly limited and may be appropriately selected according to the purpose. It is preferably from 0.3 μm to 10 μm, and more preferably from 4.0 μm to 7.0 μm. When the weight-average particle diameter is less than 3.0 μm, image sharpness and thin line reproducibility will be excellent, but the flowability and transferability of the toner may be degraded.

The ratio (Dv/Dn) of the weight-average particle diameter (Dv) to a number-average particle diameter (Dn) is not particularly limited and may be appropriately selected according to the purpose. It is preferably 1.20 or less, and more preferably 1.15 or less, in terms of sharpness and thin line reproducibility.

The weight-average particle diameter (Dv) and the number-average particle diameter (Dn) of the toner may be measured as follows, for example.

Measuring instrument: COULTER MULTISIZER® 111 (manufactured by Beckman Coulter Co., Ltd.)

Aperture diameter: 100 μm

Analyzing software: BECKMAN COULTER MULTISIZER® 3 version 3.51 (manufactured by Beckman Coulter Co., Ltd.)

Electrolyte: ISOTON®III (manufactured by Beckman Coulter Co., Ltd.) Dispersion liquid: 10% by mass surfactant (alkyl benzene sulfonate, NEOGEN SC-A®, manufactured by Dai-Ichi Kogyo Seiyaku Co., Ltd.)

Electrolyte: ISOTON III (manufactured by Beckman Coulter Co., Ltd.)

Dispersion liquid: 10% by mass surfactant (alkyl benzene sulfonate, NEOGEN SC-A, manufactured by Dai-Ichi Kogyo Seiyaku Co., Ltd.)

Dispersion conditions: The sample to be measured (10 mg) is added to the dispersion liquid (5 mL), and subjected to dispersion with an ultrasonic disperser for 1 minute. After this, the electrolyte (25 mL) is added thereto, and the resultant is subjected to dispersion with the ultrasonic disperser for another 1 minute.

Measurement conditions: The electrolyte (100 mL) and the dispersion liquid are added to a beaker to obtain a concentration at which the particle diameter of 30,000 particles can be measured in 20 seconds. Then, 30,000 particles are measured, and from their particle size distribution, the weight-average particle diameter and the number-average particle diameter are calculated.

<Toner Manufacturing Method>

A method for manufacturing the toner is not particularly restricted and may be appropriately selected according to the purpose. Examples thereof include kneading and pulverization method and a method to granulate toner particles in an aqueous medium (chemical method). Among these, the chemical method that does not involve kneading of a binder resin is preferable, because the molecules will not be disconnected, and because kneading of a high-molecular-weight resin and a low-molecular-weight resin, which are difficult to knead uniformly, can be avoided.

The toner can also be manufactured by a particle manufacturing method disclosed in JP-B No. 4,531,076, i.e., a method of dissolving the constituent materials of the toner in liquid or supercritical carbon dioxide, and after this, removing the liquid or supercritical carbon dioxide to thereby obtain toner particles.

Examples of the chemical method include: a suspension polymerization method, an emulsion polymerization method, a seed polymerization method, and a dispersion polymerization method in which a monomer is a starting material for manufacturing; a dissolution suspension method in which a resin or a resin precursor is dissolved in an organic solvent, which is dispersed or emulsified in an aqueous medium; another version of the dissolution suspension method in which an oil phase composition that contains a resin precursor (a reactive group-containing prepolymer) containing a functional group reactive with an active hydrogen group is emulsified or dispersed in an aqueous medium, and an active hydrogen group-containing compound and the reactive group-containing prepolymer are reacted in the aqueous medium; a phase inversion emulsification method to invert phases by adding water to a solution including a resin, a resin precursor and a suitable emulsifier; and an agglomeration method in which the resin particles obtained by these methods are agglomerated by heat-melting, etc. in a state that they are dispersed in an aqueous medium to granulate them to particles of a desired size. Among these, a toner obtained by the dissolution suspension method, the manufacturing method (I), and the agglomeration method is more preferable in view of granulation property by the crystalline resin (easiness of controlling a particle size distribution, controlling a particles shape), and a toner obtained by the manufacturing method (I) is more preferable.

These methods will be explained in detail below.

<<Kneading and Pulverization Method>>

The kneading and pulverization method is a method for manufacturing base particles of the toner by, for example, pulverizing and classifying melt-kneaded toner materials including at least a binder resin.

In the melt-kneading, the toner materials are mixed, and the mixture is charged in a melt-kneader for melt-kneading. Examples of a melt-kneader include a uniaxial or biaxial continuous kneader and a batch kneader with a roll mill. Specific examples thereof include: a KTK-model twin-screw extruder manufactured by Kobe Steel, Ltd.; a TEM-model extruder manufactured by Toshiba Machine Co., Ltd.; a twin-screw extruder manufactured by KCK Co., Ltd.; a PCM-model twin-screw extruder manufactured by Ikegai Corporation; and a co-kneader manufactured by Buss. It is preferable to carry out this melt-kneading under appropriate conditions so as not to cut off the molecular chains of the binder resin. Specifically, a melt-kneading temperature is set by reference to a softening point of the binder resin. When it is too high compared to the softening point, the resin is severely cut off. When it is too low, dispersion may not proceed.

The pulverization is a step of pulverizing the kneaded matter obtained by the melt-kneading. In this pulverization, it is preferable that the kneaded matter be coarsely pulverized and then finely pulverized. In this case, a method of pulverizing the kneaded matter by making it collide with a collision plate in a jet stream, or a method of pulverizing the kneaded matter in a narrow gap between a mechanically rotating rotor and a stator is preferably used.

The classification is a step of adjusting the pulverized matter obtained in the pulverization to particles having a predetermined particle diameter. The classification may be carried out by removing fine particles using a cyclone, a decanter, or a centrifuge.

<<Chemical Method>>

The chemical method is not particularly restricted and may be appropriately selected according to the purpose. A preferable method is to disperse or emulsify a toner material liquid containing at least the binder resin in an aqueous medium to granulate base particles of the toner.

Another preferable chemical method is to granulate base particles of the toner by dispersing or emulsifying in an aqueous medium, an oil phase (toner material liquid) that is obtained by dissolving or dispersing in an organic solvent, toner materials containing at least either the binder resin or the binder resin precursor. In this case, the binder resin precursor (resin precursor containing a functional group reactive with an active hydrogen group) reacts with an active hydrogen group-containing compound in the aqueous medium.

Examples of the active hydrogen group-containing compound include water and polyamines. Examples of the polyamines include amine compounds blocked with ketones (ketimine compounds). Examples of the polyamines include the aforementioned ones listed in the description of the polyurea unit.

Examples of the binder resin precursor include a crystalline polyester resin containing an isocyanate group at the terminal.

A crystalline resin can be easily granulated with the dissolution suspension method or an ester elongation method.

—Organic Solvent—

An organic solvent used for dissolving or dispersing the binder resin or the binder resin precursor preferably has a boiling point of lower than 100° C. and is volatile, because such an organic solvent can be easily removed later.

Examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. One of these may be used alone, or two or more of them may be used in combination. Among these, ester-based solvent such as methyl acetate and ethyl acetate, aromatic solvent such as toluene and xylene, and halogenated hydrocarbon such as methylene chloride 1,2-dichloroethane, chloroform, and carbon tetrachloride are preferable.

The solid content concentration of the toner material liquid containing the binder resin or the binder resin precursor is preferably from 40% by mass to 80% by mass. When the solid content concentration is less than 40% by mass, the amount of toner to be manufactured will be small. When it is greater than 80% by mass, it becomes difficult to dissolve or disperse the binder resin or the binder resin precursor, and the materials may be highly viscous and difficult to process.

The toner materials other than the resin such as the colorant and the releasing agent, and the master batch containing these may be separately and individually dissolved or dispersed in the organic solvent and mixed with the toner material liquid.

—Aqueous Medium—

As the aqueous medium, water may be used alone, but a solvent miscible with water may be used in combination. Examples of solvents miscible with water include alcohol (e.g., methanol, isopropanol, and ethylene glycol), dimethyl formamide, tetrahydrofuran, cellosolves (e.g., methyl cellosolve), and lower ketones (e.g., acetone and methyl ethyl ketone).

The content of the aqueous medium relative to 100 parts by mass of the toner material liquid is not particularly limited and may be appropriately selected according to the purpose. It is preferably from 50 parts by mass to 2,000 parts by mass, and more preferably from 100 parts by mass to 1,000 parts by mass. When the content is less than 50 parts by mass, the toner material liquid will not be dispersed well, and toner particles with a predetermined particle diameter may not be obtained. The content of greater than 2,000 may not be economical.

It is preferable to disperse an inorganic dispersing agent or organic resin particles in the aqueous medium in advance, because the particle size distribution of the toner to be obtained will be sharp, and in terms of dispersion stability.

Examples of the inorganic dispersing agent includes tricalcium phosphate, calcium carbonate, titanium oxide, colloidal silica and hydroxyapatite.

As a resin to form the organic resin particles, any resin can be used as long as it can form an aqueous dispersion, and such a resin may be a thermoplastic resin or may be a thermosetting resin. Examples thereof include a vinyl resin, a polyurethane resin, an epoxy resin, a polyester resin, a polyamide resin, a polyimide resin, a silicon-based resin, a phenol resin, a melamine resin, a urea resin, an aniline resin, an ionomer resin and a polycarbonate resin. These resins may be used alone or in combination of two or more. Among these, the vinyl resin, the polyurethane resin, the epoxy resin, the polyester resin and a combination thereof are preferable since an aqueous dispersion of fine spherical resin particles may be easily obtained.

A method for emulsifying or dispersing the toner material liquid in the aqueous medium is not particularly restricted, and a heretofore known equipment such as low-speed shearing equipment, high-speed shearing equipment, friction equipment, high-pressure jet equipment and ultrasonic waves may be used. Among these, the high-speed shearing equipment is preferable in view of obtaining reduced particle diameter. When the high-speed sharing dispersion equipment is used, the rotational speed is not particularly restricted. Nonetheless, it is typically 1,000 rpm to 30,000 rpm, and preferably 5,000 rpm to 20,000 rpm. A temperature during dispersion is typically 0° C. to 150° C. (under pressurization), and preferably 20° C. to 80° C.

When the toner material liquid contains the binder resin precursor, the active hydrogen group-containing compound, etc. required by the binder resin precursor for elongation or crosslinking reaction may be mixed in advance in the toner material liquid prior to dispersing the toner material liquid in the aqueous medium, or it may be mixed in the aqueous medium.

In order to remove the organic solvent from the obtained emulsification dispersion, a heretofore known method may be used. For example, a whole system is gradually heated under a normal pressure or a reduced pressure, and the organic solvent in liquid droplets is completely removed by evaporation. Thereby, base particles of the toner can be obtained.

A heretofore known technology is used for washing and drying the toner base particles dispersed in the aqueous medium. That is, a solid-liquid separation is carried out with a centrifuge or a filter press, etc., then an obtained toner cake is re-dispersed in deionized water of from about a normal temperature to about 40° C., which is subject to pH control with an acid or alkali according to necessity, and a solid-liquid separation is carried out again. These steps are repeated to remove impurities or the surfactant. This is followed by drying with a flash dryer, a circulation dryer, a vacuum drier or a vibration fluidized dryer, etc. to obtain toner powder. Here, a fine particle component of the toner may be removed by centrifuge, or the toner after drying may be subjected to classification using a heretofore known classifier according to necessity for a desired particle diameter distribution.

(Developer)

The developer of the present invention contains at least the toner of the present invention and a carrier, and further contains other components according to necessity.

<Carrier>

The carrier is not particularly limited and may be appropriately selected according to the purpose. A preferable carrier contains a core material, and a resin layer to cover the core material.

<<Core Material>>

The core material is not particularly limited as long as it is particles having a magnetic property, and may be appropriately selected according to the purpose. Preferable core materials are ferrite, magnetite, iron, and nickel. When adaptability to environmental concerns that have grown remarkably in the recent years is considered, preferable as the ferrite is not the conventional copper-zinc-based ferrite, but are manganese ferrite, manganese-magnesium ferrite, manganese-strontium ferrite, manganese-magnesium-strontium ferrite, and lithium-based ferrite.

<<Resin Layer>>

The material for the resin layer is not particularly limited and may be appropriately selected according to the purpose. Examples thereof include an amino-based resin, a polyvinyl-based resin, a polystyrene-based resin, a halogenated olefin resin, a polyester-based resin, a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride and an acrylic monomer, a copolymer of vinylidene fluoride and vinyl fluoride, a fluoroterpolymer such as a terpolymer of tetrafluoroethylene, vinylidene fluoride, and a non-fluoride monomer, and a silicone resin. One of these may be used alone, or two or more of these may be used in combination.

The silicone resin is not particularly limited and may be appropriately selected according to the purpose. Examples thereof include a straight silicone resin formed of only organosiloxane bonding; and modified silicone reins modified with an alkyd resin, a polyester resin, an epoxy rein, an acrylic resin, and a urethane resin.

A commercially-available product may be used as the silicone resin.

Examples of the straight silicone resin include: KR271, KR255, and KR152 manufactured by Shin-Etsu Chemical Co., Ltd.; and SR2400, SR2406, and SR2410 manufactured by Dow Corning Toray Silicone Co., Ltd.

Examples of the modified silicone resins include: KR206 (alkyd-modified silicone resin), KR5208 (acrylic-modified silicone resin), ES1001N (epoxy-modified silicone resin), and KR305 (urethane-modified silicone resin) manufactured by Shin-Etsu Chemical Co., Ltd.; and SR2115 (epoxy-modified silicone resin) and SR2110 (alkyd-modified silicone resin) manufactured by Dow Corning Toray Silicone Co., Ltd.

The silicone resin may be used alone, but may also be used in combination with a component to undergo a cross-linking reaction and a component for controlling the amount of charge.

The content of the component forming the resin layer in the carrier is preferably from 0.01% by mass to 5.0% by mass. When the content is less than 0.01% by mass, a uniform resin layer may not be formed on the surface of the core material. When the content is greater than 5.0% by mass, the resin layer may be excessively thick to cause granulation inside the carrier itself, and uniform carrier particles may not be obtained.

The content of the toner in the developer is not particularly limited and may be appropriately selected according to the purpose. It is preferably from 2.0 parts by mass to 12.0 parts by mass and more preferably from 2.5 parts by mass to 10.0 parts by mass relative to 100 parts by mass of the carrier.

(Image Forming Apparatus and Image Forming Method)

An image forming apparatus of the present invention includes at least an electrostatic latent image bearing member (hereinafter may be referred to as "photoconductor"), an electrostatic latent image forming unit, and a developing unit, and further includes other units according to necessity.

An image forming method of the present invention includes at least an electrostatic latent image forming step and a developing step, and further includes other steps according to necessity.

The image forming method may be preferably performed by the image forming apparatus. The electrostatic latent image forming step may be preferably performed by the electrostatic latent image forming unit. The developing step may be preferably performed by the developing unit. The other steps may be preferably performed by the other units.

<Electrostatic Latent Image Bearing Member>

The material, structure, and size of the electrostatic latent image bearing member are not particularly limited and may be appropriately selected from conventional ones. In terms of material, the bearing member may be an inorganic photoconductor made of, for example, amorphous silicon or selenium, or may be an organic photoconductor made of, for example, polysilane or phthalopolymethine. Among these, amorphous silicon is preferable because it provides a long life.

As the amorphous silicon photoconductor, a photoconductor formed by heating a substrate to 50° C. to 400° C. to form a photoconductive layer made of a-Si on the substrate by deposition method such as vacuum vapor deposition, sputtering, ion plating, thermal CVD (Chemical Vapor Deposition), optical CVD, and plasma CVD may be used. Among these methods, plasma CVD, i.e., a method of decomposing a material gas by a direct current, high-frequency radiation, or a microwave glow discharge to form an a-Si deposition film on the substrate is preferable.

The shape of the electrostatic latent image bearing member is not particularly limited and may be appropriately selected according to the purpose. It is preferably a cylindrical shape. The outer diameter of the electrostatic latent image bearing member having the cylindrical shape is not particularly limited and may be appropriately selected according to the purpose. It is preferable from 3 mm to 100 mm, more preferably from 5 mm to 50 mm, and particularly preferably from 10 mm to 30 mm.

<Electrostatic Latent Image Forming Unit and Electrostatic Latent Image Forming Step>

The electrostatic latent image forming unit is not particularly limited as long as it is a unit configured to form an electrostatic latent image on the electrostatic latent image bearing member, and may be appropriately selected according to the purpose. Examples thereof include one that includes at least: a charging member configured to electrically charge the surface of the electrostatic latent image bearing member; and an exposing member configured to expose the surface of the electrostatic latent image bearing member to light imagewise.

The electrostatic latent image forming step is not particularly limited as long as it is a step of forming an electrostatic latent image on the electrostatic latent image bearing member, and may be appropriately selected according to the purpose. For example, the step may be performed by electrically charging the surface of the electrostatic latent image bearing member, and after this, exposing the surface to light imagewise. The step may be performed by the electrostatic latent image forming unit.

<<Charging Member and Charging>>

The charging member is not particularly limited and may be appropriately selected according to the purpose. Examples thereof include conventionally known contact-type chargers including a roller, a brush, a film, or a rubber blade that is electroconductive or semi-electroconductive; and contactless chargers such as a corotron and a scorotron utilizing a corona discharge.

The charging can be performed by applying a voltage to the surface of the electrostatic latent image bearing member with the charging member.

The shape of the charging member may be any form such as a roller, and other than this, a magnetic brush, a fur brush, etc., and may be selected according to the specifications and form of the image forming apparatus.

When the magnetic brush is used as the charging member, the magnetic brush includes: a charging materials made of particles of any kind such as Zn—Cu ferrite; a non-magnetic electroconductive sleeve configured to support the charging member; and a magnet roll embraced by the sleeve.

When the fur brush is used as the charging member, the material of the fur brush may be a fur treated with, for example, carbon, copper sulfide, metal, or metal oxide to have electroconductivity, and such a fur brush may be wound around or bonded to a cored bar that is treated with metal or any other material to have electroconductivity, to thereby make the charging member.

The charging member is not limited to the contact-type charging member. However, it is preferable to use a contact-type charging member because the image forming apparatus would emit less ozone from the charging member.

<<Exposing Member and Exposure>>

The exposing member is not particularly limited as long as it can expose the surface of the electrostatic latent image bearing member charged by the charging member to light imagewise as the image to be formed, and may be appropriately selected according to the purpose. Examples thereof include exposing members of various types such as a copier optical system, a rod lens array system, a laser optical system, and a liquid crystal shutter optical system.

The light source used for the exposing member is not particularly limited and may be appropriately selected according to the purpose. Examples thereof include a fluorescent lamp, a tungsten lamp, a halogen lamp, a mercury lamp, a sodium lamp, a light emitting diode (LED), a laser diode (LD), electroluminescence (EL), and such general light emitting devices.

Various types of filters such as sharp cut filter, a band pass filter, a near-infrared cut filter, a dichroic filter, an interference filter, and a color temperature conversion filter may be used to emit light of only a desired wavelength range.

The exposure can be performed by exposing the surface of the electrostatic latent image bearing member to light imagewise with the exposing member.

In the present invention, a backside irradiation system may be employed to apply exposure to the electrostatic latent image bearing member from the back side.

<Developing Unit and Developing Step>

The developing unit is not particularly limited as long as it is a developing unit containing a toner and configured to develop the electrostatic latent image formed on the electrostatic latent image bearing member to form a visible image, and may be appropriately selected according to the purpose.

The developing step is not particularly limited as long as it is a step of developing the electrostatic latent image formed on the electrostatic latent image bearing member with a toner to form a visible image, and may be appropriately selected according to the purpose. The developing step may be performed by, for example, the developing unit.

The developing unit may be of a dry developing system, or of a wet developing system. The developing unit may also be a single-color developing unit or a multi-color developing unit.

Preferable as the developing unit is a developing device including: a stirrer configured to frictionally stir the toner to thereby electrically charge the toner; a magnetic field generating unit fixed inside; and a developer bearing member that is rotatable while bearing on its surface a developer containing the toner.

In the developing unit, for example, the toner and the carrier are mixed and stirred, and the toner is charged by the resulting friction and retained on the surface of a rotating magnet roller in a chain-like form to thereby form a magnetic brush. Since the magnet roller is arranged near the electrostatic latent image bearing member, the toner forming the magnetic brush formed on the surface of the magnet roller is partially transferred to the surface of the electrostatic latent image bearing member by an electrical attractive force. As a result, the electrostatic latent image is developed with the toner, and an image visualized with the toner is formed on the surface of the electrostatic latent image bearing member.

<Other Units and Other Steps>

Examples of the other units include a transferring unit, a fixing unit, a cleaning unit, a diselectrifying unit, a recycling unit, and a control unit.

Examples of the other steps include a transferring step, a fixing step, a cleaning step, a diselectrifying step, a recycling step, and a control step.

<<Transferring Unit and Transferring Step>>

The transferring unit is not particularly limited as long as it is a unit configured to transfer a visible image to a recording medium, and may be appropriately selected according to the purpose. In a preferable aspect, the transferring unit includes a first transferring unit configured to transfer a visible image to an intermediate transfer member to form a combined transfer image, and a second transferring unit configured to transfer the combined transfer image to a recording medium.

The transferring step is not particularly limited as long as it is a step of transferring a visible image to a recording medium, and may be appropriately selected according to the purpose. In a preferable aspect, the transferring step includes using an intermediate transfer member to perform first transfer of a visible image to the intermediate transfer member, and then performing second transfer of the visible image to the recording medium.

The transferring step can be performed by electrically charging the photoconductor with, for example, a transferring charger to transfer the visible image, and may be performed by the transferring unit.

When the image to be subjected to the second transfer to the recording medium is a color image made of toners of plural colors, the transferring unit may overlay the toners of the respective colors on the intermediate transfer member sequentially to form an image on the intermediate transfer member, such that the intermediate transfer member can perform second transfer of the image on the intermediate transfer member to the recording medium simultaneously.

The intermediate transfer member is not particularly limited and may be appropriately selected from conventional transfer members according to the purpose. Preferable examples thereof include a transfer belt.

It is preferable that the transferring unit (the first transferring unit and the second transferring unit) include at least a transferring device configured to electrically charge the visible image so as to be separated to the recording medium. Examples of the transferring device include a corona transferring device utilizing a corona discharge, a transfer belt, a transfer roller, a pressure transfer roller, and an adhesive transferring device.

The recording medium, is typically regular paper. However, it is not particularly limited as long as it can receive transfer of a developed un-fixed image, and may be appropriately selected according to the purpose. A PET base for OHP may also be used as the recording medium.

<<Fixing Unit and Fixing Step>>

The fixing unit is not particularly limited as long as it is a unit configured to fix a transferred image transferred to the recording medium, and may be appropriately selected according to the purpose. A preferable example thereof is a conventional heating and pressurizing member. Examples of the heating and pressurizing member includes a combination of a heating roller and a pressurizing roller, and a combination of a heating roller, a pressurizing roller, and an endless belt.

The fixing step is not particularly limited as long as it is a step of fixing the visible image transferred to the recording medium thereon, and may be appropriately selected according to the purpose. For example, the fixing step may be performed separately for the toner of each color when it is transferred to the recording medium, or may be performed at the same time for the toners of all colors that are overlaid together.

The fixing step can be performed by the fixing unit.

The heating by the heating and pressurizing member is typically preferably to 80° C. to 200° C.

In the present invention, a conventional optical fixing device may be used together with or instead of the fixing unit, according to the purpose.

The surface pressure during the fixing step is not particularly limited and may be appropriately selected according to the purpose. It is preferably from 10 $N/cm^2$ to 80 $N/cm^2$.

<<Cleaning Unit and Cleaning Step>>

The cleaning unit is not particularly limited as long as it is a unit capable of removing the toner remained on the photoconductor, and may be appropriately selected according to the purpose. Examples thereof include a magnetic brush cleaner, an electrostatic brush cleaner, a magnetic roller cleaner, a blade cleaner, a brush cleaner, and a web cleaner.

The cleaning step is not particularly limited as long as it is a step capable of removing the toner remained on the photoconductor, and may be appropriately selected according to the purpose. The cleaning step can be performed by the cleaning unit.

<<Diselectrifying Unit and Diselectrifying Step>>

The diselectrifying unit is not particularly limited as long as it is a unit configured to diselectrifying the photoconductor by applying an electrifying bias thereto and may be appropriately selected according to the purpose. Examples thereof include a charge eliminating lamp.

The diselectrifying step is not particularly limited as long as it is a step of diselectrifying the photoconductor by applying a diselectrifying bias thereto, and may be appropriately selected according to the purpose. The diselectrifying step can be performed by the diselectrifying unit.

<<Recycling Unit and Recycling Step>>

The recycling unit is not particularly limited as long as it is a unit configured to recycle the toner removed in the cleaning step to the developing device, and may be appropriately selected according to the purpose. Examples thereof include a conventional conveying unit.

The recycling step is not particularly limited as long as it is a step of recycling the toner removed in the cleaning step to the developing device, and may be appropriately selected according to the purpose. The recycling step can be performed by the recycling unit.

<<Control Unit and Control Step>>

The control unit is not particularly limited as long as it is a unit capable of controlling the operations of each unit and may be appropriately selected according to the purpose. Examples thereof include devices such as a sequencer and a computer.

The control step is not particularly limited as long as it is a step capable of controlling the operations of each step and may be appropriately selected according to the purpose. The control step can be performed by the control unit.

(Process Cartridge)

A process cartridge of the present invention includes at least an electrostatic latent image bearing member and a developing unit, and further includes other members according to necessity.

The process cartridge is detachably mountable on the image forming apparatus body.

The developing unit contains a toner to develop an electrostatic latent image formed on the electrostatic latent image bearing member to form a visible image.

The toner is the toner of the present invention.

The electrostatic latent image bearing member and the developing unit may be, for example, the electrostatic latent image bearing member and the developing unit explained as examples in the description of the image forming apparatus of the present invention.

One example of the developing unit will be explained with reference to the drawings.

Figure 3:
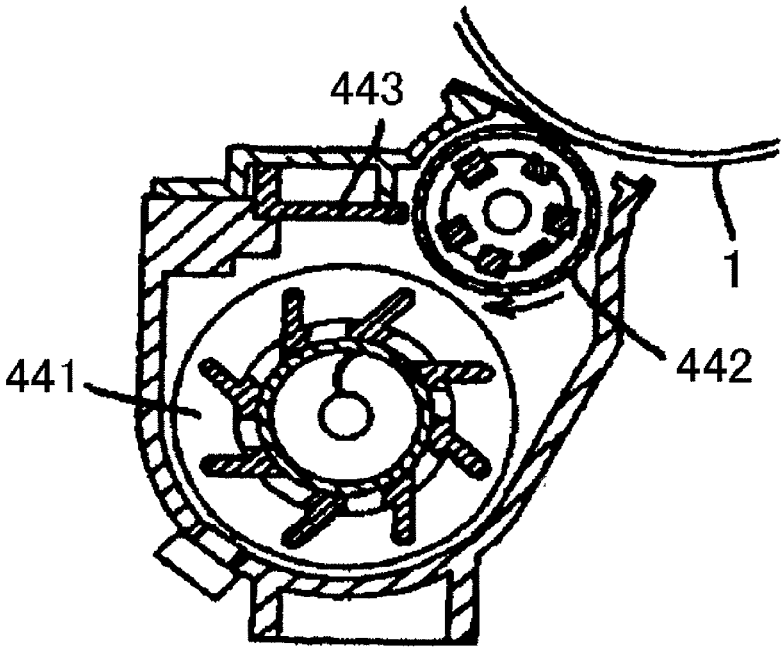
FIG. 3 is a schematic structure diagram showing an example developing unit of the present invention.

The developing unit shown in FIG. 3 is a developing unit to be used when a tow-component developer containing a toner and a magnetic carrier is used as a developer. In the developing unit shown in FIG. 3, the two-component developer is stirred and transferred by a screw 441, and supplied to the developing sleeve 442 serving as a developer bearing member. The two-component developer supplied to the developing sleeve 442 is regulated by a doctor blade 443 serving as a layer thickness regulating member, such that the amount of the developer supplied is controlled by a doctor gap, which is a gap between the doctor blade 443 and the developing sleeve 442. When the doctor gap is excessively small, the amount of the developer supplied is excessively small to degrade the image density. On the other hand, when the doctor gap is excessively large, the amount of the developer supplied is excessively large to have the carrier adhere to a photoconductor drum 1 serving as the electrostatic latent image bearing member. Hence, the developing sleeve 442 internally includes a magnet serving as a magnetic field generating unit that forms a magnetic field to retain the developer on the circumferential surface of the developing sleeve in a chain-like form. The developer is retained on the developing sleeve 442 in the chain-like form along normal magnetic lines radiated by the magnet, to thereby form a magnetic brush.

The developing sleeve 442 and the photoconductor drum 1 are disposed in proximity with a fixed gap (a developing gap) provided therebetween, to have a developing region in the area where they face each other. The developing sleeve 442 is a cylinder made of a non-magnetic material such as aluminum, brass, stainless steel, and an electroconductive resin, and can be rotated by a rotary driving mechanism (not shown). The magnetic brush is conveyed to the developing region by the rotation of the developing sleeve 442. The developing sleeve 442 receives a developing voltage applied by a developing power source (not shown), has the toner in the magnetic brush separated from the carrier by a developing electric field formed between the developing sleeve 442 and the photoconductor drum 1, and develops the electrostatic latent image formed on the photoconductor drum 1. An AC voltage may be superposed on the developing voltage.

The developing gap is preferably from 5 times to 30 times as large as the particle diameter of the developer. When the particle diameter of the developer is 50 μm, the developing gap is preferably set to 0.25 mm to 1.5 mm. When the developing gap is larger than this range, a desired image density may not be obtained.

The doctor gap is preferably as large as the developing gap or slightly larger than the developing gap. The drum diameter and the drum linear velocity of the photoconductor drum 1, and the sleeve diameter and the sleeve linear velocity of the developing sleeve 442 are determined by constraints such as the copying speed, the size of the apparatus, etc. The ratio of the sleeve linear velocity to the drum linear velocity is preferably 1.1 or greater, in order to obtain a necessary image density. A sensor may be provided at a position behind where the development is completed, to detect an amount of toner adhered from an optical reflectivity and control the process conditions.

An example of the image forming apparatus of the present invention will be explained with reference to the drawings.

Figure 4:
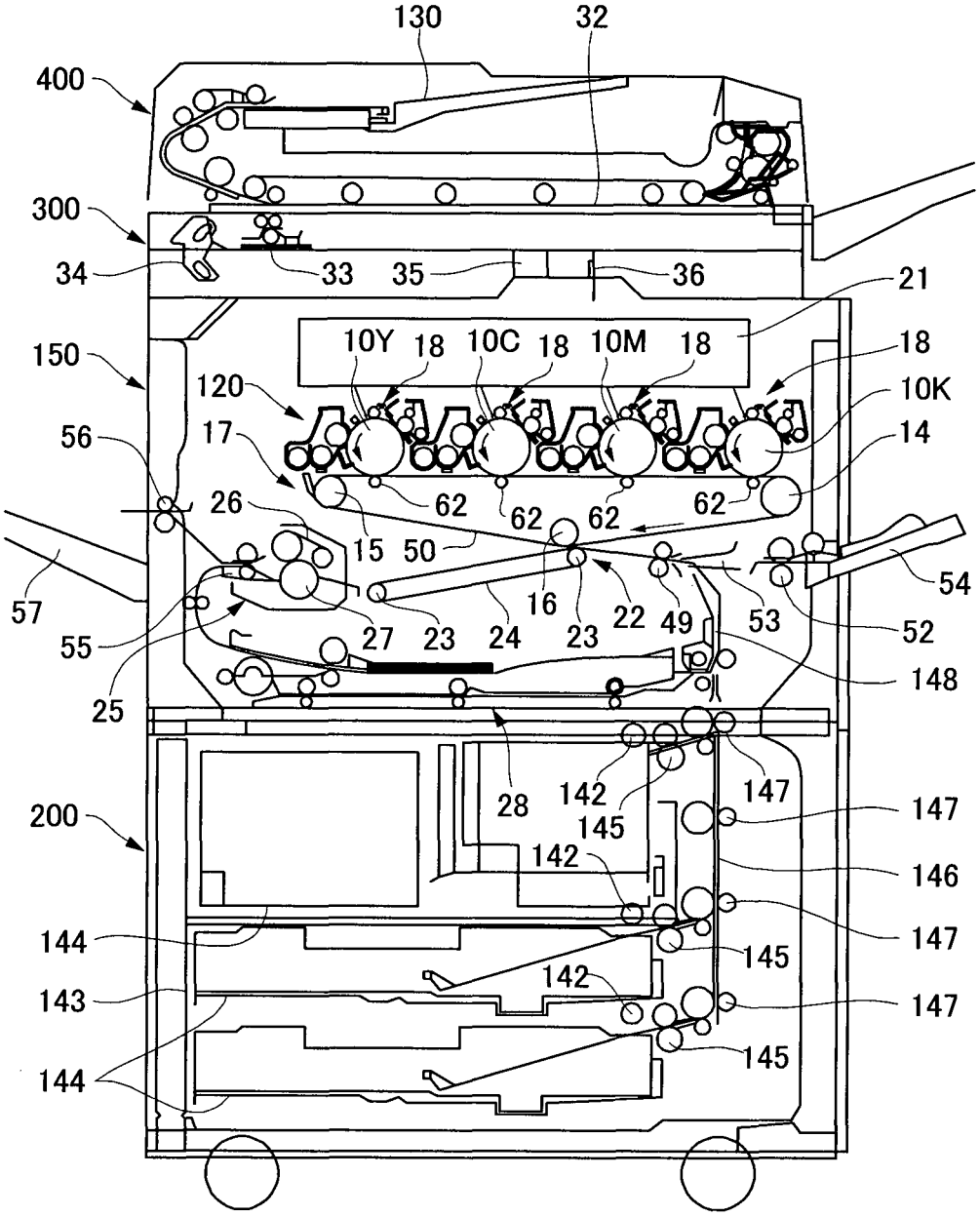
FIG. 4 is a schematic structure diagram showing an example image forming apparatus of the present invention.

The image forming apparatus shown in FIG. 4 includes a copier body 150, a sheet feeding table 200, a scanner 300, and an automatic document feeder (ADF) 400.

The copier body 150 includes an endless-belt-like intermediate transfer member 50 in the center thereof. The intermediate transfer member 50 is hung over support rollers 14, 15, and 16 so as to be rotatable in the clockwise direction of the drawing. An intermediate transfer member cleaning device 17 for removing any residual toner to remain on the intermediate transfer member 50 is provided near the support roller 15. In a manner to face the intermediate transfer member 50 tensed between the support roller 14 and the support roller 15, four image forming units 18 for yellow, cyan, magenta, and black are arranged side by side in the direction in which the intermediate transfer member is conveyed, to thereby constitute a tandem developing device 120. An exposure device 21 serving as the exposing member is provided near the tandem developing device 120. A second transfer device 22 is provided on a side of the intermediate transfer member 50 opposite to the side thereof where the tandem developing device 120 is provided. The second transfer device 22 is constituted by a second transfer belt 24, which is an endless belt hung between a pair of rollers 23, and a transfer sheet conveyed on the second transfer belt 24 and the intermediate transfer member 50 can contact each other. A fixing device 25 serving as the fixing member is provided near the second transfer device 22. The fixing device 25 includes a fixing belt 26, which is an endless belt, and a pressurizing roller 27 arranged so as to be pressed by the fixing belt.

In the tandem image forming apparatus, a sheet overturning device 28 is provided near the second transfer device 22 and the fixing device 25 in order to overturn the transfer sheet so as to apply image formation to both sides of the transfer sheet.

Next, formation of a full-color image (color copying) with the tandem developing device 120 will be explained. First, a document is set on a document table 130 of the automatic document feeder 400, or the automatic document feeder 400 is opened to set the document on a contact glass 32 of a scanner 300 and then the automatic document feeder 400 is closed.

Upon a push of a start switch not shown, after the document is conveyed and moved onto the contact glass 32 when the document is set on the automatic document feeder 400, whereas immediately after the push of the start switch when the document is set on the contact glass 32, the scanner 300 is started, and a first traveling member 33 and a second traveling member 34 are started to run. The first traveling member 33 emits light from a light source, and light reflected from the document surface is reflected by a mirror of the second traveling member 34 and received by a reading sensor 36 through an image forming lens 35. Thereby, the color document (color image) is read and used as image information of black, yellow, magenta, and cyan.

Figure 5:
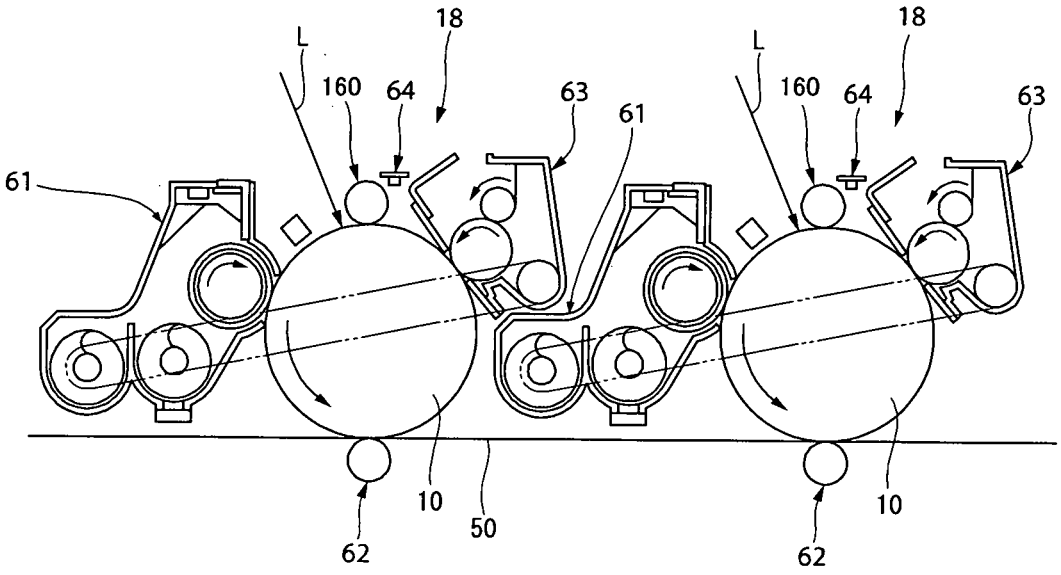
FIG. 5 is a diagram showing an expanded view of a portion of FIG. 4.

The image information of black, yellow, magenta and cyan is transmitted to each image forming unit 18 (a black image forming unit, a yellow image forming unit, a magenta image forming unit, and a cyan image forming unit), and toner images of black, yellow, magenta, and cyan are formed. Specifically, as shown in FIG. 5, the image forming units 18 of the tandem developing device 120 (the black image forming unit, the yellow image forming unit, the magenta image forming unit, and the cyan image forming unit) each include: an electrostatic latent image bearing member 10 (a black electrostatic latent image bearing member 10K, a yellow electrostatic latent image bearing member 10Y, a magenta electrostatic latent image bearing member 10M, and a cyan electrostatic latent image bearing member 10C); a charging device 160 serving as the charging member configured to uniformly charge the electrostatic latent image bearing member 10; an exposing device configured to expose the electrostatic latent image bearing member to light (L in FIG. 5) imagewise as the image of the corresponding color based on the image information of the corresponding color, to form an electrostatic latent image corresponding to the image of the corresponding color on the electrostatic latent image bearing member; a developing device 61 serving as the developing unit configured to develop the electrostatic latent image with a toner of the corresponding color (a black toner, a yellow toner, a magenta toner, and a cyan toner) to form a toner image of the toner of the corresponding color; a transferring device 62 configured to transfer the toner image to the intermediate transfer member 50; a cleaning device 63; and a diselectrifying device 64, and are capable of forming a single-color image of the corresponding color (a black image, a yellow image, a magenta image, and a cyan image) based on the image information of the corresponding color. The black image, the yellow image, the magenta image, and the cyan image formed on the black electrostatic latent image bearing member 10K, the yellow electrostatic latent image bearing member 10Y, the magenta electrostatic latent image bearing member 10M, and the cyan electrostatic latent image bearing member 10C in this way are sequentially transferred to the intermediate transfer member 50 rotated by the support rollers 14, 15, and 16 (first transfer). Then, the black image, the yellow image, the magenta image, and the cyan image are overlaid on the intermediate transfer member 50 to form a combined color image (a color transfer image).

In the sheet feeding table 200, one of sheet feeding rollers 142 is selectively rotated to bring sheets (recording sheets) forward from one of sheet feeding cassettes 144 set over multi-stages in a paper bank 143, and to feed them sheet by sheet separately by a separating roller 145 into a sheet feeding path 146. The sheet is conveyed by a conveying roller 147 to be guided to a sheet feeding path 148 provided in the copier body 150, and then stopped when it hits on a registration roller 49. Alternatively, a sheet feeding roller 142 is rotated to bring forward the sheets (recording sheets) on a manual feeding tray 54 and to feed them sheet by sheet separately by a separating roller 52 into a manual sheet feeding path 53. Likewise, the sheet is stopped when it hits on the registration roller 49. Generally, the registration roller 49 is used in an earthed state. However, it may be used in a biased stated in order to remove sheet scrapes of the sheet. Then, the registration roller 49 is rotated synchronously with the timing of the combined color image (color transfer image) combined on the intermediate transfer member 50 to deliver the sheet (recording sheet) to between the intermediate transfer member 50 and a second transferring device 22. The second transferring device 22 transfers the combined color image (color transfer image) to the sheet (recording sheet) (second transfer), and thereby the color image is transferred and formed on the sheet (recording sheet). The residual toner on the intermediate transfer member 50 having transferred the image is cleaned by the intermediate transfer member cleaning device 17.

The sheet (recording sheet) on which the color image is transferred and formed is conveyed by the second transferring device 22 to be brought forward to the fixing device 25, and at the fixing device 25, the combined color image (color transfer image) is fixed on the sheet (recording sheet) by heat and pressure. After this, the sheet (recording sheet) is switched by a switching claw 55 to be discharged by a discharging roller 56 and stacked on a sheet discharging tray 57, or is switched by the switching claw 55 to be overturned by the sheet overturning device 28 to be guided again to the transfer position, and with an image recorded also on the back side thereof, is discharged by the discharging roller 56 and stacked on the sheet discharging tray 57.

An example of a process cartridge of the present invention will be explained with reference to the drawings.

Figure 6:
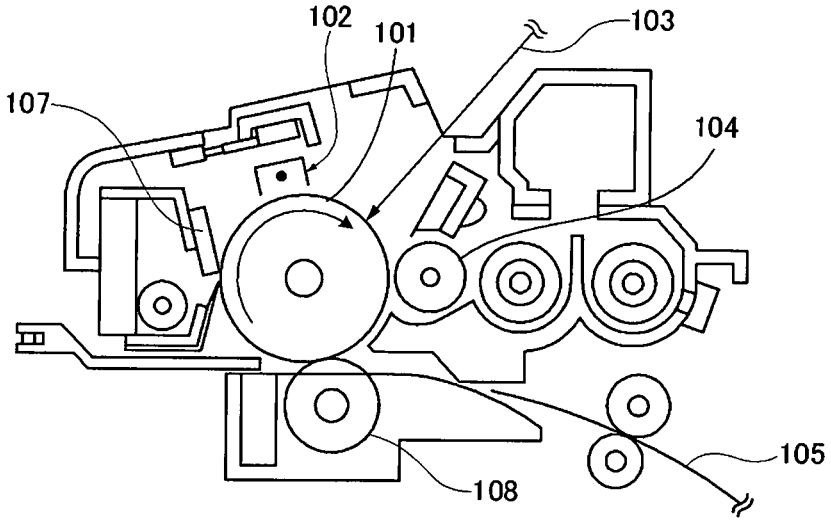
FIG. 6 is a schematic structure diagram showing an example process cartridge of the present invention.

The process cartridge shown in FIG. 6 includes an electrostatic latent image bearing member 101, a charging member 102, a developing unit 104, a transferring unit 108, and a cleaning unit 107, and further includes other units according to necessity. In FIG. 6, a reference sign 103 represents exposure by an exposing member, and a reference sign 105 represents a recording medium.

Next, an image forming process by the process cartridge shown in FIG. 6 will be described. The electrostatic latent image bearing member 101 rotates in the direction of the arrow to be charged by the charging member 102 and subjected to exposure 103 by the exposing member (not shown), to thereby have an electrostatic latent image corresponding to the image of the exposing light on the surface thereof. The electrostatic latent image is developed with a toner in the developing unit 104, and the developed toner image is transferred to a recording medium 105 by a transferring unit 108 and printed out. Then, the surface of the electrostatic latent image bearing member 101 having transferred the image is cleaned by the cleaning unit 107, diselectrified by a diselectrifying unit (not shown), and repeats this operation again.

EXAMPLES

Though Examples of the present invention will be explained below, the present invention is not limited to these Examples in any way. "Parts" indicates "parts by mass", unless otherwise expressly indicated. "%" indicates "% by mass" unless otherwise expressly indicated.

(Various Measurements)

Methods for various measurements in the Examples will be described below.

<Glass Transition Point>

The glass transition point of the resin was measured with differential scanning calorimeters (DSC) (TA-60WS and DSC-60 (manufactured by Shimadzu Corporation)).

<Softening Temperature of Resin>

The softening temperature of the resin was measured with a Kouka-shiki flow tester (CFT-500 D (manufactured by Shimadzu Corporation)). As a sample, a resin (1 g) was heated at a temperature elevating rate of 3° C./min, and extruded from a nozzle having a diameter of 0.5 mm and a length of 1 mm, under a load of 2.94 MPa applied by a plunger. The amount of descent of the plunger of the flow tester was plotted relative to the temperature. The temperature at which the sample had flowed out by half was regarded as the softening temperature.

<Maximum Peak Temperature (Melting Point) of Heat of Melting of Resin>

The maximum peak temperature (melting point) of heat of melting of the resin was measured with differential scanning calorimeters (DSC) (TA-60WS and DSC-60 (manufactured by Shimadzu Corporation)). The sample used for measurement of a maximum peak temperature of heat of melting was subjected to a pre-treatment in which it was melted at 130° C., then cooled from 130° C. to 70° C. at a rate of 1.0° C./min, and then cooled from 70° C. to 10° C. at a rate of 0.5° C./min. Then, the sample was once warmed at a temperature elevating rate of 10° C./min to measure endothermic and exothermic changes with the DSC and plot a graph of "endothermic and exothermic amount" vs. "temperature". An endothermic peak temperature observed in this case in a range of from 20° C. to 100° C. was determined as "Ta*". Where there were a plurality of endothermic peaks, the temperature of a peak at which the endothermic amount was the maximum was detected as Ta*. Then, the sample was stored at (Ta*−10°) C. for 6 hours, and then stored at (Ta*−15°) C. for 6 hours. Then, the sample was cooled to 0° C. at a temperature decreasing rate of 10° C./min and warmed at a temperature elevating rate of 10° C./min, to measure endothermic and exothermic changes with the DSC and plot similar graph. The temperature corresponding to the peak at which the endothermic amount was the maximum was determined as the maximum peak temperature of heat of melting.

<P1, P2, Q, $Q_p$, $Q_5$, $Q_{10}$, and $Q_h$>

The maximum endothermic peak temperature (P1), the total endothermic amount (Q), the total endothermic amount ($Q_5$), the total endothermic amount ($Q_{10}$), the total endothermic amount ($Q_h$), and the maximum exothermic peak temperature (P2) were measured with differential scanning calorimeters (DSC) (TA-60WS and DSC-60 (manufactured by Shimadzu Corporation)).

Specifically, a sample (5 mg) was placed in a sample pan made of aluminum, set in the instrument, and measured. As a reference, alumina (10 mg) was used, and likewise placed in a sample pan made of aluminum like the sample. The sample was warmed from 20° C. to 150° C. at a temperature elevating rate of 10° C./min (this was the first temperature elevation), then cooled to 0° C. at a temperature decreasing rate of 10° C./min (this was the temperature decrease), and again warmed at a temperature elevating rate of 10° C./min (this was the second temperature elevation), to thereby measure endothermic and exothermic changes, plot a graph of temperature vs. endothermic and exothermic amount, and obtain a DSC curve. The measurement results were analyzed with a data analyzing software program (TA-60, version 1.52) manufactured by Shimadzu Corporation, to obtain P1, P2, Q, $Q_p$, $Q_5$, $Q_{10}$, and $Q_h$.

<Preparation of Tetrahydrofuran (THF) Soluble Content>

The tetrahydrofuran (THF) soluble content of the toner was obtained by adding the toner (30 mg) to tetrahydrofuran (THF) (containing a stabilizer, manufactured by Wako Pure Chemical Industries, Ltd.) (20 mL), stirring them for 1 hour, and filtering the resultant through a 0.2 μm filter.

<Molecular Weight and Molecular Weight Distribution>

The weight-average molecular weight and the molecular weight distribution were measured with a gel permeation chromatography (GPC) measuring instrument (HLC-8220GPC (manufactured by Tosoh Corporation)). Three 15 cm columns (TSKGEL SUPER HZM-H®) were used in connection. The sample to be measured was prepared as a 0.15% by mass solution of tetrahydrofuran (THF) (containing a stabilizer, manufactured by Wako Pure Chemical Industries, Ltd.), and filtered through a 0.2 μm filter. The resulting filtrate was used as the sample. The sample (100 μL) was poured into the measuring instrument, and measured at a flow rate of 0.35 mL/minute at a temperature of 40° C.

The molecular weight was obtained by performing calculation using a calibration curve generated based on a monodisperse polystyrene standard sample. As the monodisperse polystyrene standard sample, SHOWDEX STANDARD® series manufactured by Showa Denko K.K. and toluene were used. THF solutions of the following three kinds of monodisperse polystyrene standard samples were prepared and measured under the conditions described above, and a calibration curve was generated by regarding the retention times of the peak tops as the molecular weight of the monodisperse polystyrene standard samples by light scattering.

Solution A: S-7450 (2.5 mg), S-678 (2.5 mg), S-46.5 (2.5 mg), S-2.90 (2.5 mg), THF (50 mL)

Solution B: S-3730 (2.5 mg), S-257 (2.5 mg), S-19.8 (2.5 mg), S-0.580 (2.5 mg), THF (50 mL)

Solution C: S-1470 (2.5 mg), S-112 (2.5 mg), S-6.93 (2.5 mg), toluene (2.5 mg), THF (50 mL)

A RI (refraction index) detector was used as the detector.

The ratio of a component having a molecular weight of 100,000 or greater was confirmed from the intersection of an integrated molecular weight distribution curve with a point of a molecular weight of 100,000.

The ratio of a component having a molecular weight of 250,000 or greater was confirmed from the intersection of the integrated molecular weight distribution curve with a point of a molecular weight of 250,000.

Figure 7:
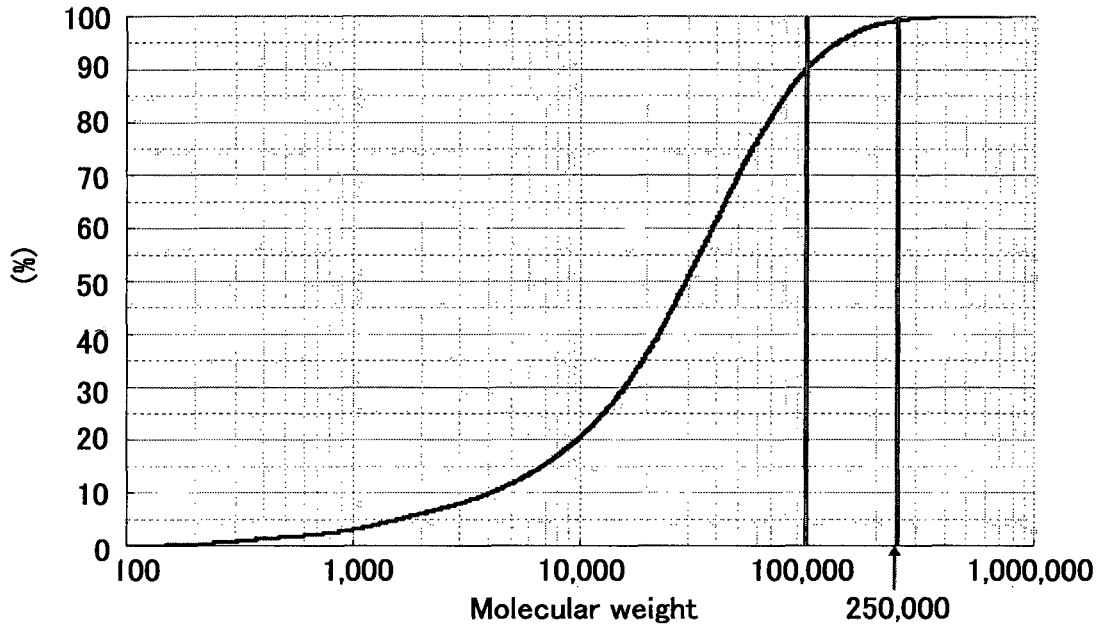
FIG. 7 shows an example integrated molecular weight distribution curve in a GPC measurement of a toner.

An example of an integrated molecular weight distribution curve of a toner is shown in FIG. 7 for reference.

<Content of N Element>

A content of N element was obtained in the following method.

The THF soluble content of the toner obtained in the preparation method described above was used as the sample to be measured.

The content of N element was obtained as an average value of two measurement values of CHN simultaneous measurement under conditions of a combustion furnace of 950° C., a reduction furnace of 550° C., a helium flow rate of 200 mL/min and an oxygen flow rate of from 25 mL/min to 30 mL/min using VARIO MICRO CUBE® (manufactured by Elementar Analytical). When it was the case that the content of N element obtained by this measurement method was less than 0.5% by mass, a further measurement was conducted using a trace nitrogen analyzer ND-100 (manufactured by Mitsubishi Chemical Corporation). An electric furnace (horizontal reactor) had temperatures in a thermal decomposition part of 800° C. and in a catalytic part of 900° C., and with measurement conditions of the main $O_2$ flow rate of 300 mL/min, $O_2$ flow rate of 300 mL/min, Ar flow rate of 400 mL/min, and the sensitivity of Low, quantification was performed using a calibration curve created with pyridine standard solutions.

<Amount of Crystalline Structure [C/(A+C)]>

The amount of crystalline structure [C/(A+C)] was measured by x-ray diffraction measurement. The measurement method is described below.

A toner was used as the sample to be measured.

The x-ray diffraction measurement was performed using an x-ray diffractometer equipped with a 2-dimensional detector (D8 DISCOVER® with GADDS®, manufactured by Bruker).

As a capillary for the measurement, a mark tube (Lindemann glass) having a diameter of 0.70 mm was used. The sample was filled to an upper portion of this capillary tube for measurement. Also, tapping was performed when the sample was filled, where the number of tapping was 100. Detailed measurement conditions are described below.

Tube current: 40 mA

Tube voltage: 40 kV

Goniometer 2θ axis: 20.0000°

Goniometer Ω axis: 0.0000°

Goniometer ϕ axis: 0.0000°

Detector distance: 15 cm (wide angle measurement)

Measuring range: 3.2≤2θ (°)≤37.2

Measurement time: 600 sec

A collimator having a pinhole with a diameter of 1 mm was used for an incident optical system. Obtained 2-dimensional data was integrated with supplied software (at 3.2° to 37.2° in the x-axis) and converted to 1-dimensional data of a diffraction intensity and 2θ.

A method for calculating the ratio [C/(A+C)] based on the obtained x-ray diffraction measurement results is explained below. An example of a diffraction spectrum obtained by an x-ray diffraction measurement is illustrated in FIG. 1A and FIG. 1B. The horizontal axis represents 2θ, the vertical axis represents the x-ray diffraction intensity, and the both are linear axes. In the x-ray diffraction spectrum in FIG. 1A, there were main peaks at 2θ=21.3° (P1) and 24.2° (P2), halos (h) were observed in a wide range including these two peaks. Here, the main peaks were attributed to a crystalline structure while the halos were attributed to a non-crystalline structure.

These two main peaks and halos were expressed by Gaussian functions ($f_{p1}(2\theta)$, $f_{p2}(2\theta)$, and $f_h(2\theta)$ denote main peak P1, main peak P2 and halos, respectively):

$$f_{p1}(2\theta)=a_{p1}\exp[-(2\theta-b_{p1})^2/(2c_{p1}^2)] \quad \text{(Formula A(1))}$$

$$f_{p2}(2\theta)=a_{p2}\exp[-(2\theta-b_{p2})^2/(2c_{p2}^2)] \quad \text{(Formula A(2))}$$

$$f_h(2\theta)=a_h\exp[-(2\theta-b_h)^2/(2c_h^2)] \quad \text{(Formula A(3))}$$

A sum of these functions:

$$f(2\theta)=f_{p1}(2\theta)+f_{p2}(2\theta)+f_h(2\theta) \quad \text{(Formula A(4))}$$

was regarded as a fitting function of the overall x-ray diffraction spectrum (illustrated in FIG. 1B), with which fitting by a least square method was carried out.

There were 9 fitting variables, namely $a_{p1}$, $b_{p1}$, $c_{p1}$, $a_{p2}$, $b_{p2}$, $c_{p2}$, $a_h$, $b_h$ and $c_h$. As initial values of these variables for fitting, peak locations of the x-ray diffraction were set for $b_{p1}$, $b_{p2}$ and $b_h$ (in the example of FIG. 1A, $b_{p1}$=21.3, $b_{p2}$=24.2, and $b_h$=22.5), and appropriate values were input for the other variables so that the two main peaks and halos coincide as much as possible with the x-ray diffraction spectrum. The fitting was carried out using the solver of Excel 2003, manufactured by Microsoft Corporation.

From the integrated areas ($S_{p1}$, $S_{p2}$, $S_h$) of the respective Gaussian functions $f_{p1}(2\theta)$, $f_{p2}(2\theta)$ corresponding to the two main peaks (P1, P2) and Gaussian function $f_h(2\theta)$ corresponding to the halos after fitting, the ratio [C/+C)] as an index indicating the amount of the crystallization site was calculated, assuming ($S_{p1}$+$S_{p2}$) was (C) and ($S_h$) was (A).

<Mixed Solution Insoluble Content>

The insoluble content of the toner insoluble in a mixed solution of tetrahydrofuran and ethyl acetate [tetrahydrofuran/ethyl acetate=50/50 (mass ratio)] was obtained by: adding 0.4 g of toner to 40 g of a mixed solution of tetrahydrofuran (THF) and ethyl acetate (with a mixing ratio of 50:50 as a mass basis), shaking it for 20 minutes, precipitating an insoluble content by centrifuge, removing a supernatant, and vacuum drying the remaining.

<Weight-Average Particle Diameter (Dv) and Number-Average Particle Diameter (Dn) of Toner>

The weight-average particle diameter (Dv) and the number-average particle diameter (Dn) of the toner were measured as follows.

Measuring instrument: COULTER MULTISIZER® III (manufactured by Beckman Coulter Co., Ltd.)

Aperture diameter: 100 μm

Analyzing software: BECKMAN COULTER MULTISIZER® 3 version 3.51 (manufactured by Beckman Coulter Co., Ltd.)

Electrolyte: ISOTON® III (manufactured by Beckman Coulter Co., Ltd.)

Dispersion liquid: 10% by mass surfactant (alkyl benzene sulfonate, NEOGEN SC-A®, manufactured by Dai-Ichi Kogyo Seiyaku Co., Ltd.)

Dispersion conditions: The sample to be measured (10 mg) was added to the dispersion liquid (5 mL), and subjected to dispersion with an ultrasonic disperser for 1 minute. After this, the electrolyte (25 mL) was added thereto, and the resultant was subjected to dispersion with the ultrasonic disperser for another 1 minute.

Measurement conditions: The electrolyte (100 mL) and the dispersion liquid were added to a beaker to obtain a concentration at which the particle diameter of 30,000 particles could be measured in 20 seconds. Then, 30,000 particles were measured, and from their particle size distribution, the weight-average particle diameter and the number-average particle diameter were calculated.

Manufacture Example 1-1

Manufacture of Crystalline Resin A1

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 6,800, to thereby obtain a crystalline resin.

Next, the obtained crystalline resin was added to ethyl acetate (550 parts) and dissolved therein. After this, a bisphenol A propylene oxide 2 mol adduct (33 parts), a bisphenol A ethylene oxide 2 mol adduct (20 parts), and 1,2-propanediol (8 parts) were added thereto and dissolved therein. Then, 4,4'-diphenylmethane diisocyanate (MDI) (111 parts) was further added thereto, and the resultant was reacted under a nitrogen stream at 80° C. for 5 hours. Then, the ethyl acetate was distilled away under a reduced pressure, to thereby obtain [Crystalline Resin A1]. The characteristic values of the obtained resin are shown in Table 1.

Manufacture Example 1-2

Manufacture of Crystalline Resin A2

A reaction tank equipped with a cooling pipe, a stirrer, and a nitrogen introducing pipe was charged with a sebacic acid (243 parts), adipic acid (44 parts), 1,4-butanediol (176 parts), and titanium dihydroxy bis(triethanol aminate) (0.8 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,4-butanediol distilled away. They were further reacted with pressure reduction of from 5 mmHg to 20 mmHg until the weight-average molecular weight reached 7,200, to thereby obtain a crystalline resin.

Next, the obtained crystalline resin was added to ethyl acetate (470 parts) and dissolved therein. After this, a bisphenol A propylene oxide 2 mol adduct (28 parts), and a bisphenol A ethylene oxide 2 mol adduct (17 parts) were added thereto and dissolved therein. Then, 4,4'-diphenylmethane diisocyanate (MDI) (64 parts) was further added thereto, and the resultant was reacted under a nitrogen stream at 80° C. for 5 hours. Then, the ethyl acetate was distilled away under a reduced pressure, to thereby obtain [Crystalline Resin A2]. The characteristic values of the obtained resin are shown in Table 1.

Manufacture Example 1-3

Manufacture of Crystalline Resin A3

A reaction tank equipped with a cooling pipe, a stirrer, and a nitrogen introducing pipe was charged with a sebacic acid (243 parts), 2-ethylhexanoic acid (43 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 8,000, to thereby obtain a crystalline resin.

Next, the obtained crystalline resin was added to ethyl acetate (550 parts) and dissolved therein. After this, 1,6-hexane diisocyanate (HDI) (18 parts) was added thereto, and the resultant was reacted under a nitrogen stream at 80° C. for 5 hours. Then, the ethyl acetate was distilled away under a reduced pressure, to thereby obtain [Crystalline Resin A3]. The characteristic values of the obtained resin are shown in Table 1.

Manufacture Example 1-4

Manufacture of Crystalline Resin A4

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 7,400, to thereby obtain a crystalline resin.

Next, the obtained crystalline resin was added to ethyl acetate (550 parts) and dissolved therein. After this, 1,6-hexane diisocyanate (HDI) (21 parts) was added thereto, and the resultant was reacted under a nitrogen stream at 80° C. for 5 hours. Then, the ethyl acetate was distilled away under a reduced pressure, to thereby obtain [Crystalline Resin A4]. The characteristic values of the obtained resin are shown in Table 1.

Manufacture Example 1-5

Manufacture of Crystalline Resin A5

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 6,800, to thereby obtain a crystalline resin.

Next, the obtained crystalline resin was added to ethyl acetate (550 parts) and dissolved therein. After this, a bisphenol A propylene oxide 2 mol adduct (11 parts), a bisphenol A ethylene oxide 2 mol adduct (7 parts), and 1,2-propanediol (3 parts) were added thereto and dissolved therein. Then, 4,4'-diphenylmethane diisocyanate (MDI) (56 parts) was further added thereto, and the resultant was reacted under a nitrogen stream at 80° C. for 5 hours. Then, the ethyl acetate was distilled away under a reduced pressure, to thereby obtain [Crystalline Resin A5]. The characteristic values of the obtained resin are shown in Table 1.

Manufacture Example 1-6

Manufacture of Crystalline Resin A6

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 6,800, to thereby obtain a crystalline resin.

Next, the obtained crystalline resin was added to ethyl acetate (550 parts) and dissolved therein. After this, a bisphenol A propylene oxide 2 mol adduct (66 parts), a bisphenol A ethylene oxide 2 mol adduct (41 parts), and 1,2-propanediol (16 parts) were added thereto and dissolved therein. Then, 4,4'-diphenylmethane diisocyanate (MDI) (195 parts) was further added thereto, and the resultant was reacted under a nitrogen stream at 80° C. for 5 hours. Then, the ethyl acetate was distilled away under a reduced pressure, to thereby obtain [Crystalline Resin A6]. The characteristic values of the obtained resin are shown in Table 1.

Manufacture Example 1-7

Manufacture of Crystalline Resin A7

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 6,800, to thereby obtain a crystalline resin.

Next, the obtained crystalline resin was added to ethyl acetate (550 parts) and dissolved therein. After this, a bisphenol A propylene oxide 2 mol adduct (66 parts) and a bisphenol A ethylene oxide 2 mol adduct (41 parts) were added thereto and dissolved therein. Further, 1,6-hexane diisocyanate (HDI) (90 parts) was added thereto, and the resultant was reacted under a nitrogen stream at 80° C. for 5 hours. Then, the ethyl acetate was distilled away under a reduced pressure, to thereby obtain [Crystalline Resin A7]. The characteristic values of the obtained resin are shown in Table 1.

Manufacture Example 1-8

Manufacture of Crystalline Resin A8

A reaction tank equipped with a cooling pipe, a stirrer, and a nitrogen introducing pipe was charged with a sebacic acid (303 parts), ethylene glycol (121 parts), and titanium dihydroxy bis(triethanol aminate) (0.6 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and ethylene glycol distilled away. They were further reacted with pressure reduction of from 5 mmHg to 20 mmHg until the weight-average molecular weight reached 6,400, to thereby obtain a crystalline resin.

Next, the obtained crystalline resin was added to ethyl acetate (450 parts) and dissolved therein. After this, a bisphenol A propylene oxide 2 mol adduct (53 parts) and a bisphenol A ethylene oxide 2 mol adduct (32 parts) were added thereto and dissolved therein. Further, 4,4'-diphenylmethane diisocyanate (MDI) (106 parts) was added thereto, and the resultant was reacted under a nitrogen stream at 80° C. for 5 hours. Then, the ethyl acetate was distilled away under a reduced pressure, to thereby obtain [Crystalline Resin A8]. The characteristic values of the obtained resin are shown in Table 1.

Manufacture Example 1-9

Manufacture of Crystalline Resin A9

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 7,400, to thereby obtain a crystalline resin.

Next, the obtained crystalline resin was added to ethyl acetate (550 parts) and dissolved therein. After this, 1,2-propanediol (31 parts) was added thereto and dissolved therein. Further, isophorone diisocyanate (IPDI) (136 parts) was added thereto, and the resultant was reacted under a nitrogen stream at 80° C. for 5 hours. Then, the ethyl acetate was distilled away under a reduced pressure, to thereby obtain [Crystalline Resin A9]. The characteristic values of the obtained resin are shown in Table 1.

Manufacture Example 1-10

Manufacture of Crystalline Resin A10

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 5,600, to thereby obtain a crystalline resin.

Next, the obtained crystalline resin was added to ethyl acetate (550 parts) and dissolved therein. After this, a bisphenol A propylene oxide 2 mol adduct (26 parts), a bisphenol A ethylene oxide 2 mol adduct (16 parts), and 1,2-propanediol (6 parts) were added thereto and dissolved therein. Further, 4,4'-diphenylmethane diisocyanate (MDI) (99 parts) was added thereto, and the resultant was reacted under a nitrogen stream at 80° C. for 5 hours. Then, the ethyl acetate was distilled away under a reduced pressure, to thereby obtain [Crystalline Resin A10]. The characteristic values of the obtained resin are shown in Table 1.

Manufacture Example 1-11

Manufacture of Crystalline Resin A11

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 8,500, to thereby obtain a crystalline resin.

Next, the obtained crystalline resin was added to ethyl acetate (550 parts) and dissolved therein. After this, a bisphenol A propylene oxide 2 mol adduct (42 parts), a bisphenol A ethylene oxide 2 mol adduct (26 parts), and 1,2-propanediol (10 parts) were added thereto and dissolved therein. Further, 4,4'-diphenylmethane diisocyanate (MDI) (127 parts) was added thereto, and the resultant was reacted under a nitrogen stream at 80° C. for 5 hours. Then, the ethyl acetate was distilled away under a reduced pressure, to thereby obtain [Crystalline Resin A11]. The characteristic values of the obtained resin are shown in Table 1.

Manufacture Example 1-12

Manufacture of Crystalline Resin A12

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 6 hours, with produced water and 1,6-hexanediol distilled away. They were further reacted with pressure reduction of from 5 mmHg to 20 mmHg until the weight-average molecular weight reached 21,000, to thereby obtain [Crystalline Resin A12]. The characteristic values of the obtained resin are shown in Table 1.

Manufacture Example 1-13

Manufacture of Crystalline Resin A13

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 6,800, to thereby obtain a crystalline resin.

Next, the obtained crystalline resin was added to ethyl acetate (550 parts) and dissolved therein. After this, a bisphenol A propylene oxide 2 mol adduct (155 parts), a bisphenol A ethylene oxide 2 mol adduct (95 parts), and 1,2-propanediol (38 parts) were added thereto and dissolved therein. Further, 4,4'-diphenylmethane diisocyanate (MDI) (418 parts) was added thereto, and the resultant was reacted under a nitrogen stream at 80° C. for 5 hours. Then, the ethyl acetate was distilled away under a reduced pressure, to thereby obtain [Crystalline Resin A13]. The characteristic values of the obtained resin are shown in Table 1.

Manufacture Example 1-14

Manufacture of Crystalline Resin A14

A reaction tank equipped with a cooling pipe, a stirrer, and a nitrogen introducing pipe was charged with a sebacic acid (279 parts), an adipic acid (18 parts), 1,4-butanediol (176 parts), and titanium dihydroxy bis(triethanol aminate) (0.8 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,4-butanediol distilled away. They were further reacted with pressure reduction of from 5 mmHg to 20 mmHg until the weight-average molecular weight reached 11,000, to thereby obtain a crystalline resin.

Next, the obtained crystalline resin was added to ethyl acetate (500 parts) and dissolved therein. After this, cyclohexanedimethanol (22 parts) was added thereto and dissolved therein. Further, tolylene diisocyanate (TDI) (44 parts) was added thereto, and the resultant was reacted under a nitrogen stream at 80° C. for 5 hours. Then, the ethyl acetate was distilled away under a reduced pressure, to thereby obtain [Crystalline Resin A14]. The characteristic values of the obtained resin are shown in Table 1.

Manufacture Example 1-15

Manufacture of Crystalline Resin A15

A reaction tank equipped with a cooling pipe, a stirrer, and a nitrogen introducing pipe was charged with a sebacic acid (303 parts), 1,4-butanediol (176 parts), and titanium dihydroxy bis(triethanol aminate) (0.8 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,4-butanediol distilled away. They were further reacted with pressure reduction of from 5 mmHg to 20 mmHg until the weight-average molecular weight reached 11,500, to thereby obtain a crystalline resin.

Next, the obtained crystalline resin was added to ethyl acetate (500 parts) and dissolved therein. After this, cyclohexanedimethanol (66 parts) was added thereto and dissolved therein. Further, xylene diisocyanate (XDI) (120 parts) was added thereto, and the resultant was reacted under a nitrogen stream at 80° C. for 5 hours. Then, the ethyl acetate was distilled away under a reduced pressure, to thereby obtain [Crystalline Resin A151]. The characteristic values of the obtained resin are shown in Table 1.

Manufacture Example 1-16

Manufacture of Crystalline Resin A16

A reaction tank equipped with a cooling pipe, a stirrer, and a nitrogen introducing pipe was charged with a sebacic acid (255 parts), an adipic acid (35 parts), 1,4-butanediol (176 parts), and titanium dihydroxy bis(triethanol aminate) (0.8 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,4-butanediol distilled away. They were further reacted with pressure reduction of from 5 mmHg to 20 mmHg until the weight-average molecular weight reached 12,000, to thereby obtain a crystalline resin.

Next, the obtained crystalline resin was added to ethyl acetate (500 parts) and dissolved therein. After this, cyclohexanedimethanol (63 parts) was added thereto and dissolved therein. Further, xylene diisocyanate (XDI) (115 parts) was added thereto, and the resultant was reacted under a nitrogen stream at 80° C. for 5 hours. Then, the ethyl acetate was distilled away under a reduced pressure, to thereby obtain [Crystalline Resin A16]. The characteristic values of the obtained resin are shown in Table 1.

Manufacture Example 1-17

Manufacture of Crystalline Resin A17

A reaction tank equipped with a cooling pipe, a stirrer, and a nitrogen introducing pipe was charged with a sebacic acid (121 parts), an adipic acid (132 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 6,800, to thereby obtain a crystalline resin.

Next, the obtained crystalline resin was added to ethyl acetate (500 parts) and dissolved therein. After this, 1,2-propanediol (13 parts) was added thereto and dissolved therein. Further, 4,4'-diphenylmethane diisocyanate (MDI) (81 parts) was added thereto, and the resultant was reacted under a nitrogen stream at 80° C. for 5 hours. Then, the ethyl acetate was distilled away under a reduced pressure, to thereby obtain [Crystalline Resin A17]. The characteristic values of the obtained resin are shown in Table 1.

Manufacture Example 1-18

Manufacture of Crystalline Resin A18

A reaction tank equipped with a cooling pipe, a stirrer, and a nitrogen introducing pipe was charged with an adipic acid (132 parts), terephthalic acid (100 parts), 1,4-butanediol (176 parts), and titanium dihydroxy bis(triethanol aminate) (0.8 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,4-butanediol distilled away. They were further reacted with pressure reduction of from 5 mmHg to 20 mmHg until the weight-average molecular weight reached 6,500, to thereby obtain a crystalline resin.

Next, the obtained crystalline resin was added to ethyl acetate (450 parts) and dissolved therein. After this, bisphenol A propylene oxide 2 mol adduct (29 parts) and bisphenol A ethylene oxide 2 mol adduct (18 parts) were added thereto and dissolved therein. Further, 4,4'-diphenylmethane diisocyanate (MDI) (66 parts) was added thereto, and the resultant was reacted under a nitrogen stream at 80° C. for 5 hours. Then, the ethyl acetate was distilled away under a reduced pressure, to thereby obtain [Crystalline Resin A18]. The characteristic values of the obtained resin are shown in Table 1.

Manufacture Example 1-19

Manufacture of Crystalline Resin A19

A reaction tank equipped with a cooling pipe, a stirrer, and a nitrogen introducing pipe was charged with a sebacic acid (138 parts), 1,4-butanediol (62 parts), and dibutyltin oxide (0.1 parts) as a condensation catalyst, and they were reacted under a nitrogen stream at 180° C. for 6 hours, with produced water distilled away. Then, while being gradually warmed to 230° C., they were reacted under a nitrogen stream for 2 hours, with produced water and 1,4-butanediol distilled away. They were further reacted with pressure reduction of from 5 mmHg to 20 mmHg until the weight-average molecular weight reached 59,000, to thereby obtain [Crystalline Resin 19]. The characteristic values of the obtained resin are shown in Table 1.

Manufacture Example 2-1

Manufacture of Crystalline Resin B1

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 6,800, to thereby obtain a crystalline resin.

Next, the obtained crystalline resin was added to ethyl acetate (550 parts) and dissolved therein. After this, 4,4'-diphenylmethane diisocyanate (MDI) (28 parts) was added thereto, and the resultant was reacted under a nitrogen stream at 80° C. for 5 hours. The characteristic values of the resin in this stage are shown in Table 1.

Further, 4,4'-diphenylmethane diisocyanate (MDI) (29 parts) were additionally added thereto, and the resultant was reacted under a nitrogen stream at 80° C. for 5 hours. Ethyl acetate was added thereto to adjust the solid content concentration, to thereby obtain a 50% ethyl acetate solution of [Crystalline Resin B1] containing an isocyanate group at the terminal.

Manufacture Example 2-2

Manufacture of Crystalline Resin B2

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 6 hours, with produced water and 1,6-hexanediol distilled away. They were further reacted with pressure reduction of from 5 mmHg to 20 mmHg until the weight-average molecular weight reached 21,000, to thereby obtain a crystalline resin. The characteristic values of the resin in this stage are shown in Table 1.

Next, the obtained crystalline resin was added to ethyl acetate (550 parts) and dissolved therein. After this, 4,4'-diphenylmethane diisocyanate (MDI) (50 parts) was added thereto, and the resultant was reacted under a nitrogen stream at 80° C. for 5 hours. Ethyl acetate was added thereto to adjust the solid content concentration, to thereby obtain a 50% ethyl acetate solution of [Crystalline Resin B2] containing an isocyanate group at the terminal.

Manufacture Example 2-3

Manufacture of Crystalline Resin B3

A reaction tank equipped with a cooling pipe, a stirrer, and a nitrogen introducing pipe was charged with a sebacic acid (303 parts), 1,6-hexanediol (230 parts), and titanium dihydroxy bis(triethanol aminate) (1.1 parts) as a condensation catalyst, and they were reacted under a nitrogen stream at 180° C. for 8 hours, with produced water distilled away. Then, while being gradually warmed to 220° C., they were reacted under a nitrogen stream for 4 hours, with produced water and 1,6-hexanediol distilled away. They were further reacted with pressure reduction of from 5 mmHg to 20 mmHg until the weight-average molecular weight reached 6,800, to thereby obtain a crystalline resin.

Next, the obtained crystalline resin was added to ethyl acetate (550 parts) and dissolved therein. After this, a bisphenol A propylene oxide 2 mol adduct (55 parts) and a bisphenol A ethylene oxide 2 mol adduct (34 parts) were added thereto and dissolved therein. Further, 4,4'-diphenylmethane diisocyanate (MDI) (111 parts) was added thereto, and the resultant was reacted under a nitrogen stream at 80° C. for 5 hours. The characteristic values of the resin in this stage are shown in Table 1.

Further, 4,4'-diphenylmethane diisocyanate (MDI) (28 parts) were additionally added thereto, and the resultant was reacted under a nitrogen stream at 80° C. for 5 hours. Ethyl acetate was added thereto to adjust the solid content concentration, to thereby obtain a 50% ethyl acetate solution of [Crystalline Resin B3] containing an isocyanate group at the terminal.

Manufacture Example 3-1

Manufacture of Non-Crystalline Resin C1

A reaction tank equipped with a cooling pipe, a stirrer, and a nitrogen introducing pipe was charged with 1,2-propanediol (148 parts), a terephthalic acid (237 parts), and tetrabutoxy titanate (0.7 parts) as a condensation catalyst, and they were reacted under a nitrogen stream at 180° C. for 8 hours, with produced water distilled away. Then, while being gradually warmed to 230° C., they were reacted under a nitrogen stream for 4 hours, with produced water and 1,2-propanediol distilled away. They were further reacted with pressure reduction of from 5 mmHg to 20 mmHg for 1 hour, and then cooled to 180° C. After this, a trimellitic anhydride (14 parts) and tetrabutoxy titanate (0.5 parts) were added thereto, and the resultant was reacted for 1 hour. After this, the resultant was reacted with further pressure reduction of from 5 mmHg to 20 mmHg until the molecular weight reached a desired level, to thereby obtain [Non-Crystalline Resin C1]. The characteristic values of the obtained resin are shown in Table 1.

Manufacture Example 3-2

Manufacture of Non-Crystalline Resin C2

A reaction tank equipped with a cooling pipe, a stirrer, and a nitrogen introducing pipe was charged with cyclohexanedimethanol (83 parts), xylene diisocyanate (117 parts), and acetone (200 parts), and they were dissolved and reacted under a nitrogen stream at 50° C. for 15 hours. Then, t-butyl alcohol (3 parts) was added thereto, and the resultant was reacted under a nitrogen stream for 6 hours. After this, acetone was distilled away, to thereby obtain [Non-Crystalline Resin C2]. The characteristic values of the obtained resin are shown in Table 1.

TABLE 1

| Binder resin | Glass transition point Tg (° C.) | Melting point Ta (° C.) | Softening temperature Tb (° C.) | Tb/Ta | Weight-avg. molecular weight (Mw) |
|---|---|---|---|---|---|
| Crystalline resin A1 | — | 61.2 | 76.6 | 1.25 | 23,800 |
| Crystalline resin A2 | — | 53.1 | 68.5 | 1.29 | 24,400 |
| Crystalline resin A3 | — | 70.2 | 87.9 | 1.25 | 40,700 |
| Crystalline resin A4 | — | 68.1 | 74.4 | 1.09 | 37,700 |
| Crystalline resin A5 | — | 64.0 | 80.7 | 1.26 | 21,900 |
| Crystalline resin A6 | — | 58.6 | 73.8 | 1.26 | 26,700 |
| Crystalline resin A7 | — | 64.7 | 73.6 | 1.14 | 40,700 |
| Crystalline resin A8 | — | 61.8 | 81.4 | 1.32 | 31,600 |
| Crystalline resin A9 | — | 60.8 | 82.2 | 1.35 | 23,000 |
| Crystalline resin A10 | — | 59.8 | 72.1 | 1.21 | 19,200 |
| Crystalline resin A11 | — | 64.1 | 83.1 | 1.30 | 75,400 |
| Crystalline resin A12 | — | 69.3 | 70.7 | 1.02 | 21,000 |
| Crystalline resin A13 | — | 56.3 | 82.3 | 1.46 | 34,400 |
| Crystalline resin A14 | — | 56.4 | 66.3 | 1.18 | 34,400 |
| Crystalline resin A15 | — | 64.5 | 73.3 | 1.14 | 40,900 |
| Crystalline resin A16 | — | 58.6 | 69.9 | 1.19 | 42,400 |
| Crystalline resin A17 | — | 46.1 | 58.8 | 1.28 | 22,200 |
| Crystalline resin A18 | — | 82.7 | 102.1 | 1.23 | 22,300 |
| Crystalline resin A19 | — | 66.7 | 75.5 | 1.13 | 59,000 |
| Crystalline resin B1 | — | 66.3 | 76.3 | 1.15 | 20,900 |
| Crystalline resin B2 | — | 68.3 | 69.0 | 1.01 | 21,000 |
| Crystalline resin B3 | — | 64.2 | 78.8 | 1.23 | 24,400 |

TABLE 1-continued

| Binder resin | Glass transition point Tg (° C.) | Melting point Ta (° C.) | Softening temperature Tb (° C.) | Tb/Ta | Weight-avg. molecular weight (Mw) |
|---|---|---|---|---|---|
| Non-crystalline resin C1 | 53.0 | — | 105.2 | — | 23,000 |
| Non-crystalline resin C2 | 152.0 | — | — | — | 20,700 |

Manufacture Example 4-1

Manufacture of Colorant Master Batch P1

[Crystalline Resin A1] (100 parts), a cyan pigment (C.I. Pigment blue 15:3) (100 parts), and ion-exchanged water (30 parts) were mixed well, and kneaded with an open roll kneader (KNEADEX® manufactured by Nippon Coke & Engineering Co., Ltd.). The kneading was started from a kneading temperature of 90° C., and after this, the temperature was gradually lowered to 50° C., to thereby manufacture [Colorant Master Batch P1] in which the ratio between the resin and the colorant was 1:1 (on a mass basis).

Manufacture Examples 4-2 to 4-19

Manufacture of Colorant Master Batches P2 to P19

[Colorant Master Batch P2] to [Colorant Master Batch P19] were manufactured in the same manner as Manufacture Example 4-1, except that [Crystalline Resin A1] of Manufacture Example 4-1 was changed to [Crystalline Resin A2] to [Crystalline Resin A19] respectively, as shown in Table 2 below.

TABLE 2

| Colorant Master Batch | Crystalline Resin |
|---|---|
| P2 | A2 |
| P3 | A3 |
| P4 | A4 |
| P5 | A5 |
| P6 | A6 |
| P7 | A7 |
| P8 | A8 |
| P9 | A9 |
| P10 | A10 |
| P11 | A11 |
| P12 | A12 |
| P13 | A13 |
| P14 | A14 |
| P15 | A15 |
| P16 | A16 |
| P17 | A17 |
| P18 | A18 |
| P19 | A19 |

Manufacture Example 5

Manufacture of Wax Dispersion Liquid

A reaction vessel equipped with a cooling pipe, a thermometer, and a stirrer was charged with a paraffin wax (HNP-9, with a melting point of 75° C., manufactured by Nippon Seiro Co., Ltd.) (20 parts) and ethyl acetate (80 parts), and they were heated to 78° C. to be dissolved sufficiently, and then cooled to 30° C. in 1 hour while being stirred. After this, the resultant was subjected to wet pulverization with ULTRA VISCOMILL® (manufactured by Aimex Co., Ltd.) under the conditions of a liquid feeding rate of 1.0 kg/hr, a disk circumferential velocity of 10 m/sec, zirconia beads with a diameter of 0.5 mm being packed to 80% by volume, and 6 passes. Ethyl acetate was added to the resultant to adjust the solid content concentration, to thereby manufacture [Wax Dispersion Liquid] with a solid content concentration of 20%.

Example 1

Manufacture of Toner 1

—Preparation of Oil Phase—

A vessel equipped with a thermometer and a stirrer was charged with [Crystalline Resin A1] (94 parts) and ethyl acetate (81 parts), and they were heated to the melting point of the resin or higher to be dissolved sufficiently. Further, [Wax Dispersion Liquid] (25 parts) and [Colorant Master Batch P1] (12 parts) were added thereto, and the resultant was stirred at 50° C. with TK HOMOMIXER® (manufactured by Primix Corporation) at a rotation speed of 10,000 rpm to be dissolved and dispersed uniformly, to thereby obtain [Oil Phase 1]. The temperature of [Oil Phase 1] was maintained at 50° C. in the vessel.

—Preparation of Emulsified Slurry—

Next, in another vessel equipped with a stirrer and a thermometer, ion-exchanged water (75 parts), a 25% dispersion liquid of organic resin particles for dispersion stabilization (copolymer of styrene-methacrylic acid-butyl acrylate-sodium salt of methacrylic acid ethylene oxide adduct sulfate) (manufactured by Sanyo Chemical Industries, Ltd.) (3 parts), carboxymethyl cellulose sodium (1 part), a 48.5% aqueous solution of dodecyldiphenyl ether disulfonic acid sodium (ELEMINOL MON-7® manufactured by Sanyo Chemical Industries, Ltd.) (16 parts), and ethyl acetate (5 parts) were mixed and stirred at 40° C. to thereby manufacture [Aqueous Phase Solution]. [Oil Phase 1] (50 parts) maintained at 50° C. was added to the manufactured [Aqueous Phase Solution], and they were mixed at 45° C. to 48° C. with TK HOMOMIXER® (manufactured by Primix Corporation) at a rotation speed of 12,000 rpm for 1 minute, to thereby obtain [Emulsified Slurry 1].

[Emulsified Slurry 1] was poured in a vessel equipped with a stirrer and a thermometer, and desolventized at 50° C. for 2 hours, to thereby obtain [Slurry 1].

The obtained [Slurry 1] (100 parts) was filtered under a reduced pressure, and then washed as follows:

(1) ion-exchanged water (100 parts) was added to the filtration cake, followed by mixing with TK HOMOMIXER® (at a rotation speed of 6,000 rpm for 5 minutes) and then filtration;

(2) a 10% aqueous sodium hydroxide solution (100 parts) was added to the filtration cake obtained in (1), followed by mixing with TK HOMOMIXER® (at a rotation speed of 6,000 rpm for 10 minutes) and then filtration under reduced pressure;

(3) 10% hydrochloric acid (100 parts) was added to the filtration cake obtained in (2), followed by mixing with TK HOMOMIXER® (at a rotation speed of 6,000 rpm for 5 minutes) and then filtration; and (4) ion-exchanged water (300 parts) was added to the filtration cake obtained in (3), followed by mixing with TK HOMOMIXER® (at a rotation speed of 6,000 rpm for 5 minutes) and then filtration. This process was repeated twice, to thereby obtain [Filtration Cake 1].

The obtained [Filtration Cake 1] was dried with an air-circulating drier at 45° C. for 48 hours, and then was caused to pass through a sieve with a mesh size of 75 μm, to thereby prepare [Toner Base Particles 1].

Next, the obtained [Toner Base Particles 1] (100 parts), hydrophobized silica (HDK-2000, manufactured by Wacker Chemie) (1.0 part), and titanium oxide (MT-150AI, manufactured by Tayca Corporation) (0.3 parts) were mixed with a HENSCHEL MIXER®, to thereby obtain [Toner 1]. The characteristic values of the obtained toner were evaluated. The results are shown in Table 4 and Table 5.

<Manufacture of Carrier 1>

Mn ferrite particles (with a weight-average diameter of 35 μm) (5,000 parts) were used as a core material. A coating liquid was prepared by dispersing for 10 minutes with a stirrer, toluene (300 parts), butyl cellosolve (300 parts), an acrylic resin solution (with a composition ratio (mass basis) of methacylic acid:methyl methacrylate 2-hydroxyethyl acrylate=5:9:3, a toluene solution with a solid content concentration of 50%, with Tg of 38° C.) (60 parts), an N-tetramethoxymethyl benzoguanamine resin solution (with a degree of polymerization of 1.5, a toluene solution with a solid content concentration of 77%) (15 parts), and alumina particles (with an average primary particle diameter of 0.30 μm) (15 parts), and used as a coating material. The core material and the coating liquid were set in a coating machine that was provided with a rotary bottom-plate disk and a stirring blade in a fluidized bed for performing coating by forming a circulating flow, to thereby coat the core material with the coating liquid. The obtained coated product was burned in an electric furnace at 220° C. for 2 hours, to thereby obtain [Carrier 1].

<Manufacture of Developer 1>

[Toner 1] (7 parts) manufactured as above was mixed with [Carrier 1] (100 parts) uniformly at 48 rpm for 5 minutes with TURBULA MIXER® (manufactured by Willy A. Bachofen (WAB)) configured to perform stirring with a rolling motion of the container, to thereby obtain [Developer 1], which was a two-component developer.

<Evaluation>

The developer manufactured as above was packed in a developing unit of an indirect-transfer-type tandem image forming apparatus (i.e, the image forming apparatus shown in FIG. 4) employing a contact-type charging scheme, a two-component developing scheme, a two-time transfer scheme, a blade cleaning scheme, and an external heating roller fixing scheme, to perform image formation and evaluate the performance of the toner and the developer.

In the image forming apparatus 100, damages to an image when it is conveyed, which may be caused due to recrystallization immediately after thermal fixation, would be caused when the recording medium passes through the discharging roller 56 or a conveying roller provided in the overturning device 28.

The method for evaluating the quality of the toner and the developer will be explained in detail below.

<<White Voids>>

The developer was set in the image forming apparatus shown in FIG. 4 from which the electrostatic latent image bearing member (photoconductor) was removed, and the developing device was operated to perform idle stirring for 1 hour at a process linear velocity of 260 mm/s without toner replenishment. Then, the photoconductor was attached, and a fully one-tone image with a toner deposition amount of 0.85±0.1 mg/cm$^2$ was output in a single-color mode on 20 transfer sheets (A4 MY RECYCLE PAPER® manufactured by NBS Ricoh Co., Ltd.) serially, at a cycle of 5 sheets per job in the horizontally-long direction of the A4 sheets, without toner replenishment. The number of white voids occurred on the obtained fixed images was counted, the number of white voids per A4 sheet was calculated, and evaluation was performed based on the following evaluation criteria. The results are shown in Table 6.

[Evaluation Criteria]

A: The average number of white voids per A4 sheet is less than 1.

B: The average number of white voids per A4 sheet is 1 or more but less than 3.

C: The average number of white voids per A4 sheet is 3 or more but less than 5.

D: The average number of white voids per A4 sheet is 5 or more but less than 20.

E: The average number of white voids per A4 sheet is 20 or more.

<<Low Temperature Fixability>>

The developer was set in the image forming apparatus shown in FIG. 4, and a one-tone image (having an image size of 3 cm×8 cm) with a toner deposition amount after transfer of 0.85±0.1 mg/cm$^2$ was formed in a single color on transfer sheets (copy/print sheets <70> manufactured by Ricoh Business Expert Co., Ltd.) and fixed thereon with the temperature of the fixing belt varied. With a drawing tester AD-401 (manufactured by Ueshima Seisakusho Co., Ltd.), a picture was drawn on the surface of the obtained fixed image with a ruby needle (having a tip radius of 260 μmR to 320 μmR and a tip angle of 60°) under a load of 50 g. The picture-drawn surface was strongly scraped 5 times with fabric (HANIKOTTO® #440 manufactured by Haneron Corporation Ltd.), and the temperature of the fixing belt at which almost no scraping scraps of the image would occur was determined as the lowest fixing temperature, which was evaluated based on the evaluation criteria below. The one-tone image was formed on the transfer sheet at a position of 3.0 cm from an end of the sheet from which the sheet was passed through the apparatus. The speed at which the sheet was passed through the nip portion of the fixing device was 280 mm/s. The lower the lowest fixing temperature, the better the low temperature fixability. The results are shown in Table 6.

[Evaluation Criteria]

A: The lowest fixing temperature is 99° C. or lower.

B: The lowest fixing temperature is from 100° C. to 110° C.

C: The lowest fixing temperature is from 111° C. to 120° C.

D: The lowest fixing temperature is from 121° C. to 140° C.

E: The lowest fixing temperature is 141° C. or higher.

<<Hot Offset Resistance>>

With the image forming apparatus shown in FIG. 4, a one-tone image (having an image size of 3 cm×8 cm) with a toner deposition amount after transfer of 0.85±0.1 mg/cm$^2$ was formed on transfer sheets (Type 6200 manufactured by Ricoh Company Ltd.) and fixed thereon with the temperature of the fixing belt varied. Presence or absence of hot offset was visually checked, and a highest temperature at which no hot offset occurred was determined as the highest fixing temperature, which was evaluated based on the evaluation criteria below. The one-tone image was formed on the transfer sheet at a position of 3 mm from an end of the sheet from which the sheet was passed through the apparatus. The speed at which the sheet was passed through the nip portion of the fixing device was 280 mm/s. The higher the highest fixing temperature, the better the hot offset resistance. The results are shown in Table 6.

[Evaluation Criteria]

A: The highest fixing temperature is 220° C. or higher.

B: The highest fixing temperature is 190° C. or higher but lower than 220° C.

C: The highest fixing temperature is 160° C. or higher but lower than 190° C.

D: The highest fixing temperature is 140° C. or higher but lower than 160° C.

E: The highest fixing temperature is lower than 140° C.

<<Heat Resistant Storage Stability>>

The toner was placed in a 50 mL glass container, left for 24 hours in a thermostat bath with a temperature of 50° C., cooled to 24° C., and then subjected to penetration test (JIS K2235-1991) to measure the penetration degree (mm), based on which the heat resistant storage stability was evaluated based on the evaluation criteria below. The greater the penetration degree, the better the heat resistant storage stability. A toner with a penetration degree of less than 10 mm would highly probably cause troubles when used. The results are shown in Table 6.

[Evaluation Criteria]

A: The penetration degree is more than 25 mm.

B: The penetration degree is 20 mm or more but less than 25 mm.

C: The penetration degree is 15 mm or more but less than 20 mm.

D: The penetration degree is 10 mm or more but less than 15 mm.

E: The penetration degree is less than 10 mm.

<<Conveying Damages to Image>>

With the image forming apparatus shown in FIG. 4, a fully one-tone image with a toner deposition amount after transfer of 0.85±0.1 mg/cm$^2$ was formed on transfer sheets (type 6200 manufactured by Ricoh Company Ltd.), and output on 20 sheets serially at a cycle of 5 sheets per job in the horizontally-long direction of the A4 sheet, with the temperature of the fixing belt set to a temperature higher by 10° C. than the lowest fixing temperature of the toner. The degree of conveying damages to the image which were generated on the surface of the obtained fixed image by the discharging roller (i.e., the discharging roller 56 in FIG. 4) was evaluated based on comparison with a grading sample. The evaluation result was the average of all of the 20 sheets outputted. The speed at which the sheet was passed through the nip portion of the fixing device was 280 mm/s, and the sheet was passed through the apparatus in the horizontally-long direction of the A4 sheet. The results are shown in Table 6.

[Evaluation Criteria]

A (Grade 5): No conveying damage.

B (Grade 4): Very few conveying damages were recognized depending on the angles of viewing, but were acceptable.

C (Grade 3): A few conveying damages were recognized but acceptable.

D (Grade 2): Conveying damages were clearly recognized and unacceptable.

E (Grade 1): Apparent conveying damages were generated and completely unacceptable.

Example 2

[Toner 2] and [Developer 2] were manufactured in the same manner as Example 1, except that in Example 1, [Crystalline Resin A1] is was changed to [Crystalline Resin A2] and [Colorant Master Batch P1] was changed to [Colorant Master Batch P2].

The quality of the obtained toner and developer was evaluated. The results are shown in Table 4 to Table 6.

Example 3

[Toner 3] and [Developer 3] were manufactured in the same manner as Example 1, except that in Example 1, [Crystalline Resin A1] was changed to [Crystalline Resin A3] and [Colorant Master Batch P1] was changed to [Colorant Master Batch P3].

The quality of the obtained toner and developer was evaluated. The results are shown in Table 4 to Table 6.

Example 4

[Toner 4] and [Developer 4] were manufactured in the same manner as Example 1, except that in the preparation of oil phase in Example 1, [Crystalline Resin A1] (94 parts) was changed to [Crystalline Resin A1] (44 parts) and [Non-Crystalline Resin C1] (50 parts).

The quality of the obtained toner and developer was evaluated. The results are shown in Table 4 to Table 6.

Example 5

[Toner 5] and [Developer 5] were manufactured in the same manner as Example 1, except that in the preparation of oil phase in Example 1, [Crystalline Resin A1] (94 parts) was changed to [Crystalline Resin A1] (34 parts) and [Non-Crystalline Resin C1] (60 parts).

The quality of the obtained toner and developer was evaluated. The results are shown in Table 4 to Table 6.

Example 6

[Toner 6] and [Developer 6] were manufactured in the same manner as Example 1, except that in the preparation of oil phase in Example 1, [Crystalline Resin A1] (94 parts) was changed to [Crystalline Resin A2] (10 parts) and [Crystalline Resin A4] (84 parts), and [Colorant Master Batch P1] was changed to [Colorant Master Batch P4].

The quality of the obtained toner and developer was evaluated. The results are shown in Table 4 to Table 6.

Examples 7 to 13

Manufacture of Toners 7 to 13 and Developers 7 to 13

[Toner 7] to [Toner 13] and [Developer 7] to [Developer 13] were manufactured in the same manner as Example 1, except that [Crystalline Resin A1] of Example 1 was changed to [Crystalline Resin A5] to [Crystalline Resin A11]

respectively as shown in Table 3, and [Colorant Master Batch P1] was changed to [Colorant Master Batch P5] to [Colorant Master Bath P11] respectively as shown in Table 3.

The quality of the obtained toner and developer was evaluated. The results are shown in Table 4 to Table 6.

TABLE 3

| | | Crystalline resin | Colorant master batch |
|---|---|---|---|
| Developer 7 | Toner 7 | A5 | P5 |
| Developer 8 | Toner 8 | A6 | P6 |
| Developer 9 | Toner 9 | A7 | P7 |
| Developer 10 | Toner 10 | A8 | P8 |
| Developer 11 | Toner 11 | A9 | P9 |
| Developer 12 | Toner 12 | A10 | P10 |
| Developer 13 | Toner 13 | A11 | P11 |

Example 14

A vessel equipped with a thermometer and a stirrer was charged with [Crystalline Resin A1] (74 parts) and ethyl acetate (61 parts), and they were heated to the melting point of the resin or higher to be dissolved well. [Wax Dispersion Liquid] (25 parts) and [Colorant Master Batch P1] (12 parts) were added thereto, and the resultant was stirred at 50° C. with TK HOMOMIXER® (manufactured by Primix Corporation) at a rotation speed of 10,000 rpm to be uniformly dissolved and dispersed, to thereby obtain [Oil Phase 14]. The temperature of [Oil Phase 14] was maintained at 50° C. in the vessel.

Next, in another vessel equipped with a stirrer and a thermometer, ion-exchanged water (75 parts), a 25% dispersion liquid of organic resin particles for dispersion stabilization (copolymer of styrene-methacrylic acid-butyl acrylate-sodium salt of methacrylic acid ethylene oxide adduct sulfate) (manufactured by Sanyo Chemical Industries, Ltd.) (3 parts), carboxymethyl cellulose sodium (1 part), a 48.5% aqueous solution of dodecyldiphenyl ether disulfonic acid sodium (ELEMINOL MON-7® manufactured by Sanyo Chemical Industries, Ltd.) (16 parts), and ethyl acetate (5 parts) were mixed and stirred at 40° C. to thereby manufacture [Aqueous Phase Solution]. [Oil Phase 14] (50 parts) maintained at 50° C. was added to the manufactured [Aqueous Phase Solution], a 50% ethyl acetate solution of [Crystalline Resin B1] (40 parts) was further added thereto, and immediately the resultant was mixed at 45° C. to 48° C. with TK HOMOMIXER® (manufactured by Primix Corporation) at a rotation speed of 12,000 rpm for 1 minute, to thereby obtain [Emulsified Slurry 14]. Thereafter, the same as Example 1 was performed to thereby manufacture [Toner 14] and [Developer 14].

The quality of the obtained toner and developer was evaluated. The results are shown in Table 4 to Table 6.

Example 15

[Toner 15] and [Developer 15] were manufactured in the same manner as Example 14, except that in Example 14, [Crystalline Resin A1] was changed to [Crystalline Resin A5], [Colorant Master Batch P1] was changed to [Colorant Master Batch P5], and the 50% ethyl acetate solution of [Crystalline Resin B1] was changed to a 50% ethyl acetate solution of [Crystalline Resin B2].

The quality of the obtained toner and developer was evaluated. The results are shown in Table 4 to Table 6.

Example 16

[Toner 16] and [Developer 16] were manufactured in the same manner as Example 14, except that in Example 14, [Crystalline Resin A1] was changed to [Crystalline Resin A6], [Colorant Master Batch P1] was changed to [Colorant Master Batch P6], and the 50% ethyl acetate solution of [Crystalline Resin B1] was changed to a 50% ethyl acetate solution of [Crystalline Resin B3].

The quality of the obtained toner and developer was evaluated. The results are shown in Table 4 to Table 6.

Example 17

The quality of the toner and developer was evaluated in the same manner as Example 14, except that instead of the image forming apparatus shown in FIG. 4 in Example 14, an image forming apparatus modified to be detachably mountable with, integrally as a process cartridge, the electrostatic latent image bearing member, the charging device, the developing unit, and the cleaning device of the image forming apparatus shown in FIG. 4 was used. The results are shown in Table 6.

Comparative Example 1

[Toner 17] and [Developer 17] were manufactured in the same manner as Example 1, except that in Example 1, [Crystalline Resin A1] was changed to [Crystalline Resin A12], and [Colorant Master Batch P1] was changed to [Colorant Master Batch P12].

The quality of the obtained toner and developer was evaluated. The results are shown in Table 4 to Table 6.

Comparative Example 2

[Toner 18] and [Developer 18] were manufactured in the same manner as Example 1, except that in Example 1, [Crystalline Resin A1] was changed to [Crystalline Resin A13], and [Colorant Master Batch P1] was changed to [Colorant Master Batch P13].

The quality of the obtained toner and developer was evaluated. The results are shown in Table 4 to Table 6.

Comparative Example 3

[Toner 19] and [Developer 19] were manufactured in the same manner as Example 1, except that in preparation of oil phase in Example 1, [Crystalline Resin A1] (94 parts) was changed to [Crystalline Resin A1] (29 parts) and [Non-Crystalline Resin C1] (65 parts).

The quality of the obtained toner and developer was evaluated. The results are shown in Table 4 to Table 6.

Comparative Example 4

[Toner 20] and [Developer 20] were manufactured in the same manner as Example 1, except that in Example 1, [Crystalline Resin A1] was changed to [Crystalline Resin A14], and [Colorant Master Batch P1] was changed to [Colorant Master Batch P14].

The quality of the obtained toner and developer was evaluated. The results are shown in Table 4 to Table 6.

Comparative Example 5

[Toner 21] and [Developer 21] were manufactured in the same manner as Example 1, except that in Example 1, [Crystalline Resin A1] was changed to [Crystalline Resin A15], and [Colorant Master Batch P1] was changed to [Colorant Master Batch P15].

The quality of the obtained toner and developer was evaluated. The results are shown in Table 4 to Table 6.

Comparative Example 6

[Toner 22] and [Developer 22] were manufactured in the same manner as Example 1, except that in Example 1, [Crystalline Resin A1] was changed to [Crystalline Resin A16], and [Colorant Master Batch P1] was changed to [Colorant Master Batch P16].

The quality of the obtained toner and developer was evaluated. The results are shown in Table 4 to Table 6.

Comparative Example 7

[Toner 23] and [Developer 23] were manufactured in the same manner as Example 1, except that in Example 1, [Crystalline Resin A1] was changed to [Crystalline Resin A17], and [Colorant Master Batch P1] was changed to [Colorant Master Batch P17].

The quality of the obtained toner and developer was evaluated. The results are shown in Table 4 to Table 6.

Comparative Example 8

[Toner 24] and [Developer 24] were manufactured in the same manner as Example 1, except that in Example 1, [Crystalline Resin A1] was changed to [Crystalline Resin A18], and [Colorant Master Batch P1] was changed to [Colorant Master Batch P18].

The quality of the obtained toner and developer was evaluated. The results are shown in Table 4 to Table 6.

Comparative Example 9

[Toner 25] and [Developer 25] were manufactured in the same manner as Example 1, except that in Example 1, [Crystalline Resin A1] was changed to [Crystalline Resin A4], [Colorant Master Batch P1] was changed to [Colorant Master Batch P4], and a slurry was obtained by desolventizing the emulsified slurry at 50° C. for 2 hours, and after this, subjecting the resultant to heating treatment (annealing) at a temperature elevating rate of 1° C./hour up to 63° C.

The quality of the obtained toner and developer was evaluated. The results are shown in Table 4 to Table 6.

Example 10

[Toner 26] and [Developer 26] were manufactured in the same manner as [Example 1], except that in preparation of oil phase in Example 1, [Crystalline Resin A1] (94 parts) was changed to [Crystalline Resin A19] (74 parts) and [Non-Crystalline Resin C2] (20 parts), and [Colorant Master Batch P1] was changed to [Colorant Master Batch P19].

The quality of the obtained toner and developer was evaluated. The results are shown in Table 4 to Table 6.

TABLE 4

| | | Resin in binder resin and content ratio | | | | | DSC | | | | | | | |
|---|---|---|---|---|---|---|---|---|---|---|---|---|---|---|
| | toner | Resin 1 | Content ratio (% by mass) | Resin 2 | Content ratio (% by mass) | Particle size distribution Dv (μm) | Particle size distribution Dv/Dn | Max. endothermic peak temp. (P1) (° C.) | Total endothermic amount (Q) (Jg) | Qp/Q | Q5/Q | Q10/Q | Qh/Q | Max. exothermic peak temp. (P2) (° C.) | Difference (P1 − P2) (° C.) |
| Ex. 1 | 1 | A1 | 100 | | | 5.4 | 1.15 | 63 | 66 | 0.75 | 0.28 | 0.08 | 0.81 | 38 | 25 |
| Ex. 2 | 2 | A2 | 100 | | | 5.2 | 1.15 | 54 | 65 | 0.73 | 0.26 | 0.04 | 0.94 | 30 | 24 |
| Ex. 3 | 3 | A3 | 100 | | | 5.4 | 1.14 | 71 | 83 | 0.70 | 0.32 | 0.06 | 0.84 | 45 | 26 |
| Ex. 4 | 4 | A1 | 50 | C1 | 50 | 5.4 | 1.15 | 61 | 40 | 0.78 | 0.41 | 0.08 | 0.31 | 36 | 25 |
| Ex. 5 | 5 | A1 | 40 | C1 | 60 | 5.2 | 1.14 | 61 | 35 | 0.80 | 0.42 | 0.08 | 0.18 | 36 | 25 |
| Ex. 6 | 6 | A4 | 90 | A2 | 10 | 5.3 | 1.15 | 68 | 85 | 0.77 | 0.26 | 0.07 | 0.85 | 47 | 21 |
| Ex. 7 | 7 | A5 | 100 | | | 5.4 | 1.13 | 64 | 71 | 0.65 | 0.25 | 0.02 | 0.84 | 40 | 24 |
| Ex. 8 | 8 | A6 | 100 | | | 5.6 | 1.13 | 59 | 60 | 0.80 | 0.46 | 0.09 | 0.84 | 35 | 24 |
| Ex. 9 | 9 | A7 | 100 | | | 5.2 | 1.14 | 65 | 79 | 0.68 | 0.24 | 0.04 | 0.91 | 40 | 25 |
| Ex. 10 | 10 | A8 | 100 | | | 5.2 | 1.14 | 63 | 68 | 0.77 | 0.44 | 0.12 | 0.85 | 34 | 29 |
| Ex. 11 | 11 | A9 | 100 | | | 5.2 | 1.15 | 62 | 59 | 0.78 | 0.25 | 0.07 | 0.79 | 27 | 35 |
| Ex. 12 | 12 | A10 | 100 | | | 5.2 | 1.15 | 60 | 66 | 0.74 | 0.27 | 0.06 | 0.88 | 35 | 25 |
| Ex. 13 | 13 | A11 | 100 | | | 5.2 | 1.14 | 64 | 67 | 0.80 | 0.32 | 0.08 | 1.26 | 37 | 27 |
| Ex. 14 | 14 | A1 | 80 | B1 | 20 | 5.4 | 1.12 | 63 | 66 | 0.75 | 0.28 | 0.08 | 0.85 | 38 | 24 |
| Ex. 15 | 15 | A5 | 80 | B2 | 20 | 5.4 | 1.13 | 63 | 66 | 0.75 | 0.28 | 0.08 | 0.90 | 42 | 20 |
| Ex. 16 | 16 | A6 | 80 | B3 | 20 | 5.4 | 1.12 | 63 | 66 | 0.75 | 0.28 | 0.08 | 0.88 | 39 | 24 |
| Comp. Ex. 1 | 17 | A12 | 100 | | | 5.3 | 1.15 | 69 | 89 | 0.40 | 0.06 | 0.00 | 0.88 | 52 | 18 |
| Comp. Ex. 2 | 18 | A13 | 100 | | | 5.3 | 1.14 | 57 | 58 | 0.84 | 0.34 | 0.08 | 0.86 | 32 | 25 |
| Comp. Ex. 3 | 19 | A1 | 35 | C1 | 65 | 5.4 | 1.16 | 61 | 32 | 0.79 | 0.41 | 0.05 | 0.16 | 35 | 26 |
| Comp Ex. 4 | 20 | A14 | 100 | | | 5.2 | 1.15 | 57 | 61 | 0.54 | 0.17 | 0.11 | 0.87 | 38 | 19 |
| Comp. Ex. 5 | 21 | A15 | 100 | | | 5.3 | 1.14 | 65 | 61 | 0.45 | 0.20 | 0.06 | 0.91 | 44 | 20 |

TABLE 4-continued

| | | Resin in binder resin and content ratio | | | | | DSC | | | | | | | |
|---|---|---|---|---|---|---|---|---|---|---|---|---|---|---|
| | toner | Resin 1 | Content ratio (% by mass) | Resin 2 | Content ratio (% by mass) | Particle size distribution Dv (μm) | Particle size distribution Dv/Dn | Max. endo-thermic peak temp. (P1) (° C.) | Total endo-thermic amount (Q) (Jg) | Qp/Q | Q5/Q | Q10/Q | Qh/Q | Max. exothermic peak temp. (P2) (° C.) | Difference (P1 − P2) (° C.) |
| Comp. Ex. 6 | 22 | A16 | 100 | | | 5.4 | 1.14 | 59 | 63 | 0.40 | 0.21 | 0.06 | 0.90 | 39 | 21 |
| Comp. Ex. 7 | 23 | A17 | 100 | | | 5.2 | 1.13 | 47 | 78 | 0.73 | 0.27 | 0.05 | 0.85 | 31 | 15 |
| Comp. Ex. 8 | 24 | A18 | 100 | | | 5.2 | 1.14 | 82 | 78 | 0.75 | 0.29 | 0.07 | 0.97 | 65 | 17 |
| Comp. Ex. 9 | 25 | A4 | 100 | | | 5.1 | 1.13 | 69 | 94 | 0.66 | 0.25 | 0.03 | 0.87 | 48 | 22 |
| Comp. Ex. 10 | 26 | A19 | 80 | C2 | 20 | 5.6 | 1.19 | 66 | 76 | 0.42 | 0.16 | 0.01 | 0.81 | 46 | 20 |

TABLE 5

| | | Resin in binder and content ratio | | | | | GPC | | | | CHN |
|---|---|---|---|---|---|---|---|---|---|---|---|
| | Toner | Resin 1 | Content ratio (% by mass) | Resin 2 | Content ratio (% by mass) | X-ray diffractometry Crystallization index C/(A + C) | Weight-avg. molecular weight of THF soluble content (Mw) | Ratio of molecular weight of ≥1000,000 (%) | Ratio of molecular weight of ≥250,000 (%) | Insoluble content Amount of insoluble content relative to mixed solvent (%) | analysis Content of N element f THF soluble content (% by mass) |
| Ex. 1 | 1 | A1 | 100 | | | 0.24 | 22,500 | 2.1 | 0.0 | 8.7 | 1.4 |
| Ex. 2 | 2 | A2 | 100 | | | 0.26 | 24,100 | 4.2 | 0.0 | 8.9 | 0.9 |
| Ex. 3 | 3 | A3 | 100 | | | 0.37 | 39,200 | 4.2 | 0.0 | 9.6 | 0.3 |
| Ex. 4 | 4 | A1 | 50 | C1 | 50 | 0.15 | 33,400 | 4.8 | 0.0 | 8.7 | 0.6 |
| Ex. 5 | 5 | A1 | 40 | C1 | 60 | 0.13 | 34,700 | 4.7 | 0.0 | 8.9 | 0.4 |
| Ex. 6 | 6 | A4 | 90 | A2 | 10 | 0.39 | 34,600 | 4.1 | 0.0 | 8.6 | 0.4 |
| Ex. 7 | 7 | A5 | 100 | | | 0.29 | 20,800 | 2.4 | 0.0 | 8.7 | 0.7 |
| Ex. 8 | 8 | A6 | 100 | | | 0.21 | 25,600 | 3.3 | 0.0 | 9.0 | 2.2 |
| Ex. 9 | 9 | A7 | 100 | | | 0.32 | 38,900 | 4.9 | 0.0 | 8.9 | 1.7 |
| Ex. 10 | 10 | A8 | 100 | | | 0.24 | 30,800 | 3.2 | 0.0 | 8.6 | 1.6 |
| Ex. 11 | 11 | A9 | 100 | | | 0.20 | 22,000 | 4.1 | 0.0 | 8.8 | 2.7 |
| Ex. 12 | 12 | A10 | 100 | | | 0.22 | 18,700 | 0.1 | 0.0 | 8.4 | 1.3 |
| Ex. 13 | 13 | A11 | 100 | | | 0.23 | 70,300 | 13.8 | 0.8 | 18.3 | 1.6 |
| Ex. 14 | 14 | A1 | 80 | B1 | 20 | 0.24 | 27,900 | 16.7 | 1.5 | 18.9 | 1.2 |
| Ex. 15 | 15 | A5 | 80 | B2 | 20 | 0.25 | 28,100 | 10.5 | 1.2 | 17.6 | 0.5 |
| Ex. 16 | 16 | A6 | 80 | B3 | 20 | 0.24 | 32,500 | 5.2 | 0.4 | 11.3 | 2.0 |
| Comp. Ex. 1 | 17 | A12 | 100 | | | 0.46 | 20,100 | 3.2 | 0.0 | 8.6 | 0.0 |
| Comp. Ex. 2 | 18 | A13 | 100 | | | 0.17 | 31,400 | 4.7 | 0.0 | 9.0 | 3.3 |
| Comp. Ex. 3 | 19 | A1 | 35 | C1 | 65 | 0.11 | 23,200 | 3.7 | 0.0 | 8.7 | 0.3 |
| Comp. Ex. 4 | 20 | A14 | 100 | | | 0.21 | 31,400 | 7.2 | 0.0 | 8.7 | 1.1 |
| Comp. Ex. 5 | 21 | A15 | 100 | | | 0.24 | 37,200 | 4.2 | 0.0 | 8.2 | 2.3 |
| Comp. Ex. 6 | 22 | A16 | 100 | | | 0.26 | 38,100 | 4.1 | 0.0 | 8.4 | 2.3 |
| Comp. Ex. 7 | 23 | A17 | 100 | | | 0.42 | 23,500 | 5.7 | 0.0 | 7.4 | 1.3 |
| Comp. Ex. 8 | 24 | A18 | 100 | | | 0.38 | 23,800 | 8.3 | 0.0 | 9.2 | 1.1 |
| Comp. Ex. 9 | 25 | A4 | 100 | | | 0.46 | 38,200 | 4.5 | 0.0 | 8.8 | 0.3 |
| Comp. Ex. 10 | 26 | A19 | 80 | C2 | 20 | 0.29 | 52,600 | 6.2 | 0.0 | 9.0 | 0.4 |

TABLE 6

| | Toner/developer evaluated | | White Voids | Quality evaluation results: Low temp. fixability | Hot offset resistance | Heat resistant storage stability | Fixed image conveying damages |
|---|---|---|---|---|---|---|---|
| Ex. 1 | Toner 1 | Developer 1 | B | B | B | B | B |
| Ex. 2 | Toner 2 | Developer 2 | B | A | B | C | B |
| Ex. 3 | Toner 3 | Developer 3 | B | C | B | A | B |
| Ex. 4 | Toner 4 | Developer 4 | B | C | B | C | B |
| Ex. 5 | Toner 5 | Developer 5 | B | C | C | C | A |
| Ex. 6 | Toner 6 | Developer 6 | B | B | B | B | C |
| Ex. 7 | Toner 7 | Developer 7 | C | B | B | B | B |
| Ex. 8 | Toner 8 | Developer 8 | A | C | B | C | B |
| Ex. 9 | Toner 9 | Developer 9 | B | C | B | B | B |
| Ex. 10 | Toner 10 | Developer 10 | B | B | B | C | B |
| Ex. 11 | Toner 11 | Developer 11 | B | B | B | C | C |
| Ex. 12 | Toner 12 | Developer 12 | B | B | B | C | C |
| Ex. 13 | Toner 13 | Developer 13 | B | C | A | B | A |
| Ex. 14 | Toner 14 | Developer 14 | A | B | A | A | A |
| Ex. 15 | Toner 15 | Developer 15 | A | B | A | A | C |
| Ex. 16 | Toner 16 | Developer 16 | C | C | A | C | A |
| Ex. 17 | Toner 14 | Developer 14 | A | B | A | A | A |
| Comp. Ex. 1 | Toner 17 | Developer 17 | E | B | B | B | D |
| Comp. Ex. 2 | Toner 18 | Developer 18 | D | E | C | D | A |
| Comp. Ex. 3 | Toner 19 | Developer 19 | A | D | C | D | A |
| Comp. Ex. 4 | Toner 20 | Developer 20 | D | B | B | B | C |
| Comp. Ex. 5 | Toner 21 | Developer 21 | D | B | B | B | C |
| Comp. Ex. 6 | Toner 22 | Developer 22 | E | A | B | B | C |
| Comp. Ex. 7 | Toner 23 | Developer 23 | E | A | D | E | C |
| Comp. Ex. 8 | Toner 24 | Developer 24 | A | E | A | A | A |
| Comp. Ex. 9 | Toner 25 | Developer 25 | B | D | B | B | D |
| Comp. Ex. 10 | Toner 26 | Developer 26 | E | B | C | B | D |

Aspects of the present invention are as follows, for example.

<1> A toner, containing a binder resin, wherein the binder resin contains a crystalline resin, wherein the toner has a maximum endothermic peak temperature (P1) of from 50° C. to 80° C. and a total endothermic amount (Q) of from 35 J/g to 90 J/g at a first temperature elevation of differential scanning calorimetry, and wherein a ratio ($Q_p$/Q) of a total endothermic amount ($Q_p$) of the toner in a temperature range of from 20° C. to the maximum endothermic peak temperature (P1) to the total endothermic amount (Q) of the toner is from 0.65 to 0.83.

<2> The toner according to <1>, wherein the ratio ($Q_p$/Q) is from 0.70 to 0.80.

<3> The toner according to <1> or <2>, wherein a ratio ($Q_5$/Q) of a total endothermic amount ($Q_5$) of the toner in a temperature range of from 20° C. to [the maximum endothermic peak temperature (P1)−5° C.] at the first temperature elevation of differential scanning calorimetry to the total endothermic amount (Q) of the toner is from 0.25 to 0.50.

<4> The toner according to any one of <1> to <3>, wherein a ratio ($Q_{10}$/Q) of a total endothermic amount ($Q_{10}$) of the toner in a temperature range of from 20° C. to [the maximum endothermic peak temperature (P1)−10° C.] at the first temperature elevation of differential scanning calorimetry to the total endothermic amount (Q) of the toner is 0.10 or less.

<5> The toner according to any one of <1> to <4>, wherein the maximum endothermic peak temperature (P1) of the toner at the first temperature elevation of differential scanning calorimetry and a maximum exothermic peak temperature (P2) of the toner at a temperature decrease of differential scanning calorimetry satisfy Formulae (1) and (2) below:

$$P1-P2 \leq 30° \text{ C.} \quad \text{Formula(1); and}$$

$$P2 \geq 35° \text{ C.} \quad \text{Formula (2).}$$

<6> The toner according to any one of <1> to <5>, wherein in a diffraction spectrum of the toner obtained by X-ray diffractometry, a ratio [C/(A+C)] of spectrum integrated intensity (C) derived from a crystalline structure of the binder resin to a sum of the spectrum integrated intensity (C) and spectrum integrated intensity (A) derived from a non-crystalline structure of the binder resin is 0.15 or greater.

<7> The toner according to any one of <1> to <6>, wherein a tetrahydrofuran soluble content of the toner contains a component having a molecular weight of 100,000 or greater in a quantity of 1.0% or greater as a peak area in a molecular weight distribution measured by gel permeation chromatography, and wherein a weight-average molecular weight of the tetrahydrofuran soluble content of the toner measured by the gel permeation chromatography is from 20,000 to 70,000.

<8> The toner according to any one of <1> to <7>, wherein a tetrahydrofuran soluble content of the toner contains a component having a molecular weight of 250,000 or greater in a quantity of 1.0% or greater as a peak area in a molecular weight distribution measured by gel permeation chromatography.

<9> The toner according to any one of <1> to <8>, wherein a ratio ($Q_h$/Q) of a total endothermic amount ($Q_h$) of an insoluble content of the toner insoluble in a mixed solution of tetrahydrofuran and ethyl acetate [tetrahydrofuran/ethyl acetate=50/50 (on a mass basis)] at a second temperature elevation of differential scanning calorimetry to the total endothermic amount (Q) is from 0.20 to 1.25.

<10> The toner according to any one of <1> to <9>, wherein an insoluble content of the toner insoluble in a mixed solution of tetrahydrofuran and ethyl acetate [tetrahydrofuran/ethyl acetate=50/50 (on a mass basis)] is 5.0% by mass or greater.

<11> The toner according to any one of <1> to <10>, wherein the crystalline resin contains a urethane bond, a urea bond, or both thereof.

<12> The toner according to any one of <1> to <11>, wherein a content of N element in a tetrahydrofuran soluble content of the toner by a CHN analysis is from 0.3% by mass to 2.0% by mass.

<13> The toner according to <11> or <12>, wherein the crystalline resin that contains a urethane bond, a urea bond, or both thereof contains a crystalline resin that contains: a urethane bond, a urea bond, or both thereof, and a crystalline polyester unit.

<14> The toner according to <13>, wherein the crystalline resin that contains: a urethane bond, a urea bond, or both thereof; and a crystalline polyester unit contains a crystalline resin that contains a polyurethane unit and a crystalline polyester unit.

<15> A developer, containing:

a toner according to any one of <1> to <14>; and a carrier.

<16> An image forming apparatus, including:

an electrostatic latent image bearing member;

an electrostatic latent image forming unit configured to form an electrostatic latent image on the electrostatic latent image bearing member; and a developing unit containing a toner and configured to develop the electrostatic latent image formed on the electrostatic latent image bearing member to form a visible image, wherein the toner is the toner according to any one of <1> to <14>.

<17> A process cartridge, including:

an electrostatic latent image bearing member; and a developing unit containing a toner and configured to develop an electrostatic latent image formed on the electrostatic latent image bearing member to form a visible image, wherein the process cartridge is detachably mountable on an image forming apparatus body, and wherein the toner is the toner according to any one of <1> to <14>.

REFERENCE SIGNS LIST

10 electrostatic latent image bearing member
61 developing device

The invention claimed is:

1. A toner, comprising:

a binder resin, wherein the binder resin comprises a crystalline resin, wherein the toner has a maximum endothermic peak temperature (P1) of from 50° C. to 80° C. and a total endothermic amount (Q) of from 35 J/g to 90 J/g at a first temperature elevation of differential scanning calorimetry, and wherein a ratio ($Q_p$/Q) of a total endothermic amount ($Q_p$) of the toner in a temperature range of from 20° C. to the maximum endothermic peak temperature (P1) to the total endothermic amount (Q) of the toner is from 0.65 to 0.83, and wherein the maximum endothermic peak temperature (P1) of the toner at the first temperature elevation of differential scanning calorimetry and a maximum exothermic peak temperature (P2) of the toner at a temperature decrease of differential scanning calorimetry satisfy the Formulae (1) and (2) below:

$P1-P2 \leq 30°$ C. Formula (1), and $P2 \geq 35°$ C. Formula (2).

2. The toner according to claim 1, wherein the ratio ($Q_p$/Q) is from 0.70 to 0.80.

3. The toner according to claim 1, wherein a ratio ($Q_5$/Q) of a total endothermic amount ($Q_5$) of the toner in a temperature range of from 20° C. to [the maximum endothermic peak temperature (P1)-5° C.] at the first temperature elevation of differential scanning calorimetry to the total endothermic amount (Q) of the toner is from 0.25 to 0.50.

4. The toner according to claim 1, wherein a ratio ($Q_{10}$/Q) of a total endothermic amount ($Q_{10}$) of the toner in a temperature range of from 20° C. to [the maximum endothermic peak temperature (P1)-10° C.] at the first temperature elevation of differential scanning calorimetry to the total endothermic amount (Q) of the toner is 0.10 or less.

5. The toner according to claim 1, wherein in a diffraction spectrum of the toner obtained by X-ray diffractometry, a ratio [C/(A+C)] of spectrum integrated intensity (C) derived from a crystalline structure of the binder resin to a sum of the spectrum integrated intensity (C) and spectrum integrated intensity (A) derived from a non-crystalline structure of the binder resin is 0.15 or greater.

6. The toner according to claim 1, wherein a tetrahydrofuran soluble content of the toner comprises a component having a molecular weight of 100,000 or greater in a quantity of 1.0% or greater as a peak area in a molecular weight distribution measured by gel permeation chromatography, and wherein a weight-average molecular weight of the tetrahydrofuran soluble content of the toner measured by the gel permeation chromatography is from 20,000 to 70,000.

7. The toner according to claim 1, wherein a tetrahydrofuran soluble content of the toner comprises a component having a molecular weight of 250,000 or greater in a quantity of 1.0% or greater as a peak area in a molecular weight distribution measured by gel permeation chromatography.

8. The toner according to claim 1, wherein a ratio ($Q_h$/Q) of a total endothermic amount ($Q_h$) of an insoluble content of the toner insoluble in a mixed solution of tetrahydrofuran and ethyl acetate [tetrahydrofuran/ethyl acetate=50/50 on a mass basis] at a second temperature elevation of differential scanning calorimetry to the total endothermic amount (Q) is from 0.20 to 1.25.

9. The toner according to claim 1, wherein an insoluble content of the toner insoluble in a mixed solution of tetrahydrofuran and ethyl acetate [tetrahydrofuran/ethyl acetate=50/50 on a mass basis] is 5.0% by mass or greater.

10. The toner according to claim 1, wherein the crystalline resin comprises at least one of a urethane bond and a urea bond.

11. The toner according to claim 1, wherein a content of N element in a tetrahydrofuran soluble content of the toner by a CHN analysis is from 0.3% by mass to 2.0% by mass.

12. The toner according to claim 10, wherein the crystalline resin that comprises at least one of a urethane bond and a urea bond comprises a crystalline resin that comprises at least one of a urethane bond and a urea bond and a crystalline polyester unit.

13. The toner according to claim 12, wherein the crystalline resin that comprises at least one of a urethane bond and a urea bond and a crystalline polyester unit comprises a crystalline resin that comprises a polyurethane unit and a crystalline polyester unit.

14. A developer, comprising:

a toner according to claim 1; and a carrier.

15. An image forming apparatus, comprising:

an electrostatic latent image bearing member;

an electrostatic latent image forming unit configured to form an electrostatic latent image on the electrostatic latent image bearing member; and a developing unit including a toner and configured to develop the electrostatic latent image formed on the electrostatic latent image bearing member to form a visible image, wherein the toner is the toner according to claim 1.

16. A process cartridge, comprising:

an electrostatic latent image bearing member; and a developing unit including a toner and configured to develop an electrostatic latent image formed on the electrostatic latent image bearing member to form a visible image, wherein the process cartridge is detachably mountable on an image forming apparatus body, and wherein the toner is the toner according claim 1.

* * * * *